US012011716B2

(12) United States Patent
Rothberg et al.

(10) Patent No.: US 12,011,716 B2
(45) Date of Patent: Jun. 18, 2024

(54) PERISTALTIC PUMPING OF FLUIDS AND ASSOCIATED METHODS, SYSTEMS, AND DEVICES

(71) Applicant: Quantum-Si Incorporated, Guilford, CT (US)

(72) Inventors: Jonathan M. Rothberg, Miami Beach, FL (US); Jonathan C. Schultz, Guilford, CT (US); John H. Leamon, Stonington, CT (US); Todd Roswech, Ivoryton, CT (US); Xiaoxiao Ma, Branford, CT (US)

(73) Assignee: Quantum-Si Incorporated, Guilford, CT (US)

( * ) Notice: Subject to any disclaimer, the term of this patent is extended or adjusted under 35 U.S.C. 154(b) by 242 days.

(21) Appl. No.: 17/083,106

(22) Filed: Oct. 28, 2020

(65) Prior Publication Data

US 2021/0121874 A1 Apr. 29, 2021

Related U.S. Application Data

(60) Provisional application No. 62/927,385, filed on Oct. 29, 2019.

(51) Int. Cl.
*G01N 33/68* (2006.01)
*A01N 1/02* (2006.01)
(Continued)

(52) U.S. Cl.
CPC ..... *B01L 3/50273* (2013.01); *F04B 43/1223* (2013.01); *G01N 35/1009* (2013.01);
(Continued)

(58) Field of Classification Search
CPC ..... B01L 3/50273; B01L 2200/027; B01L 2300/0861; B01L 2300/123; F04B 43/1223; F04B 13/00; F04B 43/14; G01N 35/1009
See application file for complete search history.

(56) References Cited

U.S. PATENT DOCUMENTS 3,437,050 A 4/1969 Hrdina
3,791,400 A 2/1974 Hrdina
(Continued)

FOREIGN PATENT DOCUMENTS

CA 2552262 A1 8/2005
CA 2523089 A1 4/2006
(Continued)

OTHER PUBLICATIONS

International Preliminary Report on Patentability for Application No. PCT/US2020/057768 dated May 12, 2022.
(Continued)

*Primary Examiner* — Jennifer Wecker
*Assistant Examiner* — Oyeleye Alexander Alabi
(74) *Attorney, Agent, or Firm* — Foley Hoag LLP; Hathaway P. Russell; Brendan T. Jones

(57) ABSTRACT

Embodiments described herein generally relate to apparatuses, cartridges, and pumps for peristaltic pumping of fluids and associated methods, systems, and devices. The pumping of fluids is, in certain cases, an important aspect of a variety of applications, such as bioanalytical applications (e.g., biological sample analysis, sequencing, identification). The inventive features described herein may, in some embodiments, provide an ability to pump fluids in ways that combine certain advantages of robotic fluid handling systems (e.g., automation, programmability, configurability, flexibility) with certain advantages of microfluidics (e.g.,
(Continued)

small fluid volumes with high fluid resolution, precision, monolithic consumables, limiting of the wetting of components to consumables).

15 Claims, 24 Drawing Sheets

(51) Int. Cl.

| | |
|---|---|
| ***B01L 3/00*** | (2006.01) |
| ***C07C 309/65*** | (2006.01) |
| ***C07C 309/73*** | (2006.01) |
| ***F04B 43/12*** | (2006.01) |
| ***G01N 1/40*** | (2006.01) |
| ***G01N 21/33*** | (2006.01) |
| ***G01N 21/64*** | (2006.01) |
| ***G01N 33/52*** | (2006.01) |
| ***G01N 35/10*** | (2006.01) |

(52) U.S. Cl.
CPC . *B01L 2200/027* (2013.01); *B01L 2300/0861* (2013.01); *B01L 2300/123* (2013.01)

(56) References Cited

U.S. PATENT DOCUMENTS 4,148,703 A 4/1979 Trop et al.
4,390,403 A 6/1983 Batchelder
4,390,404 A 6/1983 Esho et al.
4,732,656 A 3/1988 Hurd
4,830,726 A 5/1989 Stamato et al.
4,911,817 A 3/1990 Kindlmann
4,971,671 A 11/1990 Slater et al.
5,039,488 A 8/1991 Kohr
5,084,157 A 1/1992 Clark et al.
5,185,071 A 2/1993 Serwer
5,229,297 A 7/1993 Schnipelsky et al.
5,286,434 A 2/1994 Slater
5,302,510 A 4/1994 Klevan
5,384,022 A 1/1995 Rajasekaran
5,453,162 A 9/1995 Sabanayagam et al.
5,609,743 A 3/1997 Sasagawa
5,641,628 A 6/1997 Bianchi
5,707,804 A 1/1998 Mathies et al.
5,839,467 A 11/1998 Saaski et al.
5,851,840 A 12/1998 Sluka et al.
5,938,904 A 8/1999 Bader
6,033,861 A 3/2000 Schafer et al.
6,036,831 A 3/2000 Bishop
6,110,670 A 8/2000 Van Broeckhoven et al.
6,120,992 A 9/2000 Wagner
6,146,511 A 11/2000 Slater
6,153,442 A 11/2000 Pirio et al.
6,193,866 B1 2/2001 Bader
6,248,518 B1 6/2001 Parkhurst et al.
6,255,083 B1 7/2001 Williams
6,258,540 B1 7/2001 Lo et al.
6,333,153 B1 12/2001 Fishel et al.
6,340,566 B1 1/2002 McCutchen-Maloney
6,558,946 B1 5/2003 Krishnamurthy
6,693,620 B1 2/2004 Herb
6,762,048 B2 7/2004 Williams
6,787,308 B2 9/2004 Balasubramanian et al.
6,824,664 B1 11/2004 Austin
6,827,830 B1 12/2004 Slater
6,846,638 B2 1/2005 Shipwash
6,869,764 B2 3/2005 Williams et al.
6,881,317 B2 4/2005 Huang et al.
6,893,546 B2 5/2005 Jullien
6,927,028 B2 8/2005 Dennis et al.
6,936,702 B2 8/2005 Williams et al.
7,052,847 B2 5/2006 Korlach et al.
7,056,661 B2 6/2006 Korlach et al.
7,175,747 B2 2/2007 Bayerl et al.
7,198,702 B1 4/2007 Washizu
7,229,799 B2 6/2007 Williams
7,361,466 B2 4/2008 Korlach et al.
7,371,533 B2 5/2008 Slater
7,427,343 B2 9/2008 Han
7,442,506 B2 10/2008 Dhallan
7,452,668 B2 11/2008 Boles et al.
7,785,869 B2 8/2010 Belgrader et al.
7,838,647 B2 11/2010 Hahn et al.
7,888,017 B2 2/2011 Quake et al.
7,935,484 B2 5/2011 Gocke et al.
7,968,702 B2 6/2011 Wegener et al.
8,008,018 B2 8/2011 Quake et al.
8,034,623 B2 10/2011 Oh et al.
8,084,734 B2 12/2011 Vertes et al.
8,133,371 B2 3/2012 Marziali et al.
8,153,375 B2 4/2012 Travers et al.
8,182,666 B2 5/2012 Marziali et al.
8,192,961 B2 6/2012 Williams
8,195,415 B2 6/2012 Fan et al.
8,252,910 B2 8/2012 Korlach et al.
8,257,954 B2 9/2012 Clark et al.
8,309,330 B2 11/2012 Travers et al.
8,354,252 B2 1/2013 Wegener et al.
8,420,366 B2 4/2013 Clark et al.
8,455,193 B2 6/2013 Travers et al.
8,480,871 B2 7/2013 Marziali et al.
8,518,228 B2 8/2013 Marziali et al.
8,529,744 B2 9/2013 Marziali et al.
8,530,154 B2 9/2013 Williams
8,562,918 B2 10/2013 Jovanovich et al.
8,581,179 B2 11/2013 Franzen
8,846,881 B2 9/2014 Korlach et al.
8,906,614 B2 12/2014 Wegener et al.
8,927,212 B2 1/2015 Kong et al.
8,980,584 B2 3/2015 Williams
9,011,661 B2 4/2015 Marziali et al.
9,062,091 B2 6/2015 Bjornson et al.
9,186,685 B2 11/2015 Marziali et al.
9,243,288 B2 1/2016 Ness et al.
9,404,146 B2 8/2016 Travers et al.
9,434,938 B2 9/2016 Marziali et al.
9,435,810 B2 9/2016 Havranek et al.
9,464,107 B2 10/2016 Wegener et al.
9,506,934 B2 11/2016 Wong et al.
9,542,527 B2 1/2017 Travers et al.
9,551,031 B2 1/2017 Korlach et al.
9,551,660 B2 1/2017 Kong et al.
9,555,354 B2 1/2017 Marziali et al.
9,566,335 B1 2/2017 Emili et al.
9,582,640 B2 2/2017 Travers et al.
9,600,626 B2 3/2017 Travers et al.
9,678,080 B2 6/2017 Bjornson et al.
9,719,073 B2 8/2017 Emig et al.
9,759,658 B2 9/2017 Rothberg et al.
9,845,501 B2 12/2017 Williams
9,879,319 B2 1/2018 Korlach et al.
9,885,657 B2 2/2018 Rothberg et al.
9,910,956 B2 3/2018 Travers et al.
9,957,291 B2 5/2018 Sebo et al.
10,023,605 B2 7/2018 Bjornson et al.
10,066,258 B2 9/2018 Kong et al.
10,150,872 B2 12/2018 Zheng et al.
10,161,002 B2 12/2018 Korlach et al.
10,283,928 B2 5/2019 Rothberg et al.
10,337,054 B2 7/2019 Marziali et al.
10,246,742 B2 8/2019 Rothberg et al.
10,400,266 B2 9/2019 Marziali et al.
10,408,208 B2 9/2019 Williams et al.
10,481,162 B2 11/2019 Emili et al.
10,544,449 B2 1/2020 Shen et al.
10,545,153 B2 1/2020 Marcotte et al.
10,551,624 B2 2/2020 Rothberg et al.
10,570,445 B2 2/2020 Kong et al.
10,676,788 B2 6/2020 Shen et al.
10,738,351 B2 8/2020 Marziali et al.
10,745,750 B2 8/2020 Korlach et al.
10,787,573 B2 9/2020 Zheng et al.
10,829,800 B2 11/2020 Marziali et al.

(56) References Cited

U.S. PATENT DOCUMENTS 10,845,308 B2 11/2020 Rothberg et al.
11,358,981 B2 6/2022 Huang et al.
2001/0045359 A1 11/2001 Cheng
2002/0036139 A1 3/2002 Becker
2002/0081280 A1 6/2002 Becker
2002/0119448 A1 8/2002 Sorge
2002/0179445 A1 12/2002 Alajoki
2003/0027178 A1 2/2003 Vasmatzis
2003/0215855 A1 11/2003 Dubrow et al.
2005/0042633 A1 2/2005 Williams
2005/0124011 A1 6/2005 Morris et al.
2005/0164241 A1 7/2005 Hahn et al.
2005/0164402 A1 7/2005 Belisle
2005/0247563 A1 11/2005 Shuber
2005/0247564 A1 11/2005 Volkel
2005/0266456 A1 12/2005 Williams et al.
2005/0277204 A1 12/2005 Hollis et al.
2006/0246490 A1 11/2006 Anderson et al.
2006/0246533 A1 11/2006 Fathollahi et al.
2006/0257263 A1* 11/2006 Ito ..... B01F 25/31322 417/3
2007/0072196 A1 3/2007 Xu et al.
2007/0098600 A1 5/2007 Kayyem et al.
2007/0207041 A1 9/2007 Gao et al.
2007/0215472 A1 9/2007 Slater
2007/0218494 A1 9/2007 Slater
2007/0219367 A1 9/2007 Shchepinov et al.
2007/0253835 A1 11/2007 Habr et al.
2008/0015117 A1 1/2008 Chibber
2008/0076143 A1 3/2008 Timperman
2008/0108063 A1 5/2008 Lucero et al.
2008/0314751 A1 12/2008 Bukshpan et al.
2009/0120795 A1 5/2009 Marziali
2009/0139867 A1 6/2009 Marziali
2009/0152116 A1 6/2009 Boles et al.
2009/0263802 A1 10/2009 Drmanac
2010/0009872 A1 1/2010 Eid et al.
2010/0029494 A1 2/2010 Cherkasov et al.
2010/0035254 A1 2/2010 Williams
2010/0068819 A1 3/2010 Hoffmann
2010/0209263 A1 8/2010 Mazur
2010/0233701 A1 9/2010 Heng et al.
2010/0273219 A1 10/2010 May et al.
2010/0285537 A1 11/2010 Zimmermann
2010/0323913 A1 12/2010 Young et al.
2011/0003343 A1 1/2011 Nikiforov et al.
2011/0048950 A1 3/2011 Marziali
2011/0152111 A1 6/2011 Fan et al.
2011/0245482 A1 10/2011 Hahn et al.
2011/0272282 A1 11/2011 Marziali
2011/0281776 A1 11/2011 Eshoo et al.
2012/0020822 A1 1/2012 Richardson et al.
2012/0035062 A1 2/2012 Schultz et al.
2012/0048735 A1 3/2012 Marziali et al.
2012/0064523 A1 3/2012 Ecker et al.
2012/0160682 A1 6/2012 Marziali et al.
2012/0199481 A1 8/2012 Marziali et al.
2012/0295265 A1 11/2012 Marziali et al.
2012/0322692 A1 12/2012 Pham et al.
2012/0329064 A1 12/2012 Marziali et al.
2013/0064701 A1* 3/2013 Konishi ..... F04B 43/14 417/474
2013/0224740 A1 8/2013 Thierry et al.
2013/0316912 A1 11/2013 Bjornson et al.
2013/0323742 A1 12/2013 Marziali et al.
2014/0081038 A1* 3/2014 Reintjens ..... B01J 19/243 556/471
2014/0328707 A1* 11/2014 Becker ..... F16K 31/126 417/476
2014/0329694 A1 11/2014 Buermann et al.
2014/0370519 A1 12/2014 Vangbo et al.
2015/0087526 A1 3/2015 Hesselberth
2015/0141267 A1 5/2015 Rothberg et al.
2015/0309058 A1 10/2015 Kain et al.
2016/0084761 A1 5/2016 Rothberg et al.
2016/0133668 A1 5/2016 Rothberg et al.
2016/0186240 A1 6/2016 Andreyev et al.
2016/0231320 A1 8/2016 Young et al.
2016/0289744 A1 10/2016 Marziali et al.
2016/0344156 A1 11/2016 Rothberg et al.
2016/0367991 A1 12/2016 Petersen et al.
2017/0073742 A1 3/2017 Marziali et al.
2017/0136433 A1 5/2017 Sun et al.
2017/0191125 A1 7/2017 Vijayan et al.
2017/0276686 A1 9/2017 Marcotte et al.
2018/0024155 A1* 1/2018 McGuinness ..... G01N 35/08 422/507
2018/0172906 A1 6/2018 Rothberg et al.
2018/0173000 A1 6/2018 Rothberg et al.
2018/0175582 A1 6/2018 Rothberg et al.
2018/0180546 A1 6/2018 Rothberg et al.
2018/0209552 A1 7/2018 Gould et al.
2018/0211003 A1 7/2018 Travers et al.
2018/0299460 A1 10/2018 Emili
2018/0321264 A1* 11/2018 Di Tullio ..... B01L 3/502738
2018/0326412 A1 11/2018 Rothberg et al.
2018/0346507 A1 12/2018 Sebo et al.
2019/0010183 A1 1/2019 Bjornson et al.
2019/0025511 A1 1/2019 Rothberg et al.
2019/0185916 A1 6/2019 Marziali et al.
2019/0201898 A1 7/2019 Cucchi et al.
2019/0210641 A1 7/2019 Marziali et al.
2019/0211389 A1 7/2019 Chen et al.
2019/0234978 A1 8/2019 Staul et al.
2019/0249153 A1 8/2019 Kamtekar et al.
2019/0249234 A1 8/2019 Marziali et al.
2019/0338342 A1 11/2019 Marziali et al.
2019/0351413 A1 11/2019 Delattre et al.
2020/0123593 A1 4/2020 Rothberg et al.
2020/0123594 A1 4/2020 Leamon
2020/0124864 A1 4/2020 Rothberg et al.
2020/0141944 A1 5/2020 Emili et al.
2020/0148727 A1 5/2020 Tullman et al.
2021/0121875 A1 4/2021 Rothberg et al.
2021/0121879 A1 4/2021 Rothberg et al.
2021/0147474 A1 5/2021 Dyer et al.
2021/0148921 A1 5/2021 Reed et al.
2021/0148922 A1 5/2021 Dyer et al.
2021/0164035 A1 6/2021 Rothberg et al.
2021/0221839 A1 7/2021 Huang et al.
2021/0331170 A1 10/2021 Rothberg et al.
2021/0354133 A1 11/2021 Rothberg et al.
2021/0354134 A1 11/2021 Rothberg et al.
2021/0379591 A1 12/2021 Rothberg et al.
2022/0228188 A1 7/2022 Millham et al.
2022/0324910 A1 10/2022 Omer et al.
2022/0339627 A1 10/2022 Ma et al.
2022/0341959 A1 10/2022 Ma et al.
2023/0192761 A1 6/2023 Huang et al.

FOREIGN PATENT DOCUMENTS

CA 2496294 A1 8/2006
CA 2641326 A1 8/2006
CA 2713313 A1 8/2009
CA 2742460 A1 5/2010
CA 3 056 256 A1 10/2018
CN 201 511 547 U 6/2010
CN 102203421 A 9/2011
CN 102939160 A 2/2013
CN 103163308 A 6/2013
CN 103323608 A 9/2013
CN 206292041 U 6/2017
CN 207 295 166 U 5/2018
CN 109311009 A 2/2019
EP 356187 A2 2/1990
EP 1720636 A1 11/2006
EP 1859249 A1 11/2007
EP 2238434 A1 10/2010
EP 2458004 A1 5/2012
EP 2 568 178 A1 3/2013
GB 2249395 A 5/1992
JP 7-167837 7/1995
JP 2000-505545 A 5/2000

(56) References Cited

FOREIGN PATENT DOCUMENTS

| | | | | |
|---|---|---|---|---|
| JP | 2001-165906 | A | 6/2001 | |
| JP | 2002-502020 | A | 1/2002 | |
| JP | 2003-062401 | A | 3/2003 | |
| JP | 2003-066004 | A | 3/2003 | |
| JP | 2003-513240 | A | 4/2003 | |
| JP | 2003-215099 | A | 7/2003 | |
| JP | 2003-247980 | A | 9/2003 | |
| TW | 200 942 687 | A | 10/2009 | |
| WO | WO 1995/14923 | A1 | 6/1995 | |
| WO | WO 1997/27933 | A1 | 8/1997 | |
| WO | WO 1999/38874 | A2 | 8/1999 | |
| WO | WO 1999/45374 | A2 | 9/1999 | |
| WO | WO 2001/31325 | A1 | 5/2001 | |
| WO | WO 2003/0019172 | A2 | 3/2003 | |
| WO | WO 2004/009622 | A2 | 1/2004 | |
| WO | WO 2005/044836 | A2 | 5/2005 | |
| WO | WO 2005/072854 | A1 | 8/2005 | |
| WO | WO 2006/063625 | A1 | 6/2006 | |
| WO | WO 2006/081691 | A1 | 8/2006 | |
| WO | WO 2007/044071 | A2 | 4/2007 | |
| WO | WO 2007/070572 | A2 | 6/2007 | |
| WO | WO 2007/092473 | A2 | 8/2007 | |
| WO | WO-2008063070 | A1 * | 5/2008 | ..... B01J 19/0046 |
| WO | WO 2009/094772 | A1 | 8/2009 | |
| WO | WO 2010/051649 | A1 | 5/2010 | |
| WO | WO 2010/065322 | A1 | 6/2010 | |
| WO | WO 2010/104798 | A1 | 9/2010 | |
| WO | WO 2010/115016 | A2 | 10/2010 | |
| WO | WO 2010/121381 | A1 | 10/2010 | |
| WO | WO 2013/002616 | A2 | 1/2013 | |
| WO | WO 2013/163424 | A1 | 10/2013 | |
| WO | WO 2017/181100 | A1 | 10/2017 | |
| WO | WO 2019/040825 | A1 | 2/2019 | |
| WO | WO 2016/200166 | A1 | 10/2019 | |
| WO | WO 2020/073016 | A1 | 4/2020 | |

OTHER PUBLICATIONS

International Preliminary Report on Patentability for Application No. PCT/US2020/057773 dated May 12, 2022.

International Preliminary Report on Patentability for Application No. PCT/US2020/057708 dated May 12, 2022.

International Preliminary Report on Patentability for Application No. PCT/US2020/057722 dated May 12, 2022.

International Search Report and Written Opinion dated Aug. 16, 2021 for Application No. PCT/US2021/028471.

International Search Report and Written Opinion dated Apr. 11, 2022 for Application No. PCT/US2022/012986.

Andersen et al., 2008, Combining a symptoms index with CA 125 to improve detection of ovarian cancer, Cancer, 113(3):484-489. Author Manuscript, 11 pages.

Asbury et al., "Trapping of DNA by dielectrophoresis", Electrophoresis, 2002, 23:2658-2666.

Asbury et al., "Trapping of DNA in Nonuniform Oscillating Electric Fields", Biophysical Journal, 1998, 74:1024-1030.

Astumian et al., "Fluctuation Driven Ratchets: Molecular Motors", Physical Review Letters, 1994, 72(11):1766-1769.

Baba et al., "Capillary Affinity Gel Electrophoresis", Molecular Biotechnology, 1996, (9):1-11.

Bier et al., "Biasing brownian motion in different directions in a 3-state fluctuating potential and an application for the separation of small particles", Physical Review Letters, 1996, 76(22):4277-4280.

Broemeling et al., "An instrument for automated purification of nucleic acids from contaminated forensic samples", JALA, 2008,13:40-48.

Carle et al., "Electrophoretic separation of large DNA molecules by periodic inversion of the electric field", Science, 1986, 232(4746):65-68.

Chacron et al., "Particle trapping and self-focusing in temporarily asymmetric ratchets with strong field gradients", Physical Review E, 1997, 56(3):3446-3450.

Chakrabarti et al., "Highly Selective Isolation of Unknown Mutations in Diverse DNA Fragments: Toward New Multiplex Screening in Cancer", American Association for Cancer Reserch, 2000, 60:3732-3737.

Chan et al., "Size Distributions of Maternal and Fetal DNA in Maternal Plasma," Molecular Diagnostics and Genetics, Clinical Chemistry, 2004, 50(1):88-92.

Chu, "Bag model for DNA migration during pulsed-field electrophoresis", Proc. Natl. Acad. Sci., 1991, 88:11071-11075.

Frank, Somatic mosaicism and disease. Curr Biol. Jun. 16, 2014;24(12):R577-R581. doi: 10.1016/j.cub.2014.05.021.

Frumin et al., "Anomalous size dependence of the non linear mobility of DNA", Phys Chem Commun, 2000, 11(3):61-63.

Frumin et al., "Nonlinear focusing of DNA macromolecules", Physical Review E—Statistical, Nonlinear and Soft Matter Physics, 2001, 64(2 Part 1):021902-1-5.

Griess et al., "Cyclic capillary electrophoresis", Electrophoresis, 2002, 23:2610-2617.

Jorgez et al., "Quantity versus quality: Optimal methods for cell-free DNA isolation from plasma of pregnant women," American College of Medical Genetics, 2006, 8(10):615-619.

Kennedy et al., Somatic Mutations in Aging, Cancer and Neurodegeneration, Mech. Ageing Dev., Apr. 2012;133(4):118-26. doi: 10.1016/j.mad.2011.10.009. Epub Nov. 3, 2011. Author Manuscript, 19 pages.

Kitzman et al., "Noninvasive Whole-Genome Sequencing of a Human Fetus," Sci Transl Med 4, 137ra76 (2012); DOI: 10.1126/scitranslmed.3004323, 9 pages.

Kopecka et al., "Capillary electrophoresis sequencing of small ssDNA molecules versus the Ogston regime: fitting data and interpreting parameters", Electrophoresis, 2004, 25(14):2177-2185.

Lalande et al., "Pulsed-field electrophoresis: Application of a computer model to the separation of large DNA molecules," Proc. Natl. Acad. Sci. USA, 1987, 84:8011-8015.

Lun et al., "Microfluidics Digital PCR Reveals a Higher than Expected Fraction of Fetal DNA in Maternal Plasma," Molecular Diagnostics and Genetics, Clinical Chemistry, 2008, 54(10):1664-1672.

Magnasco, "Forced thermal ratchets", Physical Review Letters, 1993, 71(10):1477-1481.

Makridakis, "PCR-free method detects high frequency of genomic instability in prostate cancer," Nucleic Acids Research, 2009, 37(22):7441-7446.

Nollau et al., "Methods for detection of point mutations: performance and quality assessment," Department of Clinical Chemistry, 1997, 43(7):1114-1128.

Parsons et al., Evaluation of MutS as a tool for direct measurement of point mutations in genomic DNA. Mutat Res. Mar. 21, 1997;374(2):277-85. doi: 10.1016/s0027-5107(96)00245-x.

Pel et al., "Nonlinear electrophoretic response yields a unique parameter for separation of biomolecules", PNAS, 2009, 106(35):14796-14801.

Pel, "A novel electrophoretic mechanism and separation parameter for selective nucleic acid concentration based on synchronous coefficient of drag alteration (SCODA)", (Ph.D. Thesis published in 2009), Vancouver: University of British Columbia, 2009.

Rousseau et al., "Gel electrophoretic mobility of single-stranded DNA: The two reptation field-dependent factors", Electrophoresis, 2000, 21(8):1464-1470.

Sikora et al., "Detection of Increased Amounts of Cell-Free DNA with Short PCR Amplicons," Clinical Chemistry, 2010, 56(1):136-138.

Slater et al., "Recent developments in DNA electrophoretic separations", Electrophoresis, 1998, 19(10):1525-1541.

So et al., "Efficient genomic DNA extraction from low target concentration bacterial cultures using SCODA DNA extraction technology", Cold Spring Harb Protoc, 2010, 1150-1153.

Stanislawska-Sachadyn, MutS as a tool for mutation detection. Acta Biochim Pol. 2005;52(3):575-83. Epub Aug. 4, 2005.

Tessier et al., "Strategies for the separation of polyelectrolytes based on non-linear dynamics and entropic ratchets in a simple microfluidic device", Applied Physics A—Materials Science & Processing, 2002, 75:285-291.

(56) References Cited

OTHER PUBLICATIONS

Thompson et al., "Winnowing DNA for Rare Sequences: Highly Specific Sequence and Methylation Based Enrichment", PLOS One, vol. 7, No. 2, Feb. 15, 2012.
Turmel et al., "Molecular detrapping and band narrowing with high frequency modulation of pulsed field electrophoresis", Nucleic Acids Research, 1990, 18(3):569-575.
Viovy, "Electrophoresis of DNA and other polyelectrolytes: Physical mechanisms", Review of Modern Physics, 2000, 72(3):813-872.
Wright, "Cell-free fetal nucleic acids for non-invasive prenatal diagnosis," Report of the UK export working group, Jan. 2009, 64 pages.
Yobas et al., "Nucleic Acid Extraction, Amplification, and Detection on Si-Based Microfluidic Platforms," IEEE Journal of Solid-State Circuits, vol. 42, No. 8, Aug. 2007, 12 pages.
Zhong et al., "MutS-Mediated Enrichment of Mutated DNA Produced by Directed Evolution in Vitro". World J Microbiol Biotechnol, 2011;27:1367-72.
Invitation to Pay Additional Fees for Application No. PCT/US2020/057768 dated Feb. 1, 2021.
International Search Report and Written Opinion for Application No. PCT/US2020/057768 dated Mar. 31, 2021.
Invitation to Pay Additional Fees for Application No. PCT/US2020/057773 dated Feb. 12, 2021.
International Search Report and Written Opinion for Application No. PCT/US2020/057773 dated Apr. 6, 2021.
Invitation to Pay Additional Fees for Application No. PCT/US2020/057708 dated Feb. 15, 2021.
International Search Report and Written Opinion for Application No. PCT/US2020/057708 dated Apr. 7, 2021.
International Search Report and Written Opinion for Application No. PCT/US2020/057722 dated Feb. 18, 2021.
[No Author Listed], Differential screw. Wikipedia. Last edited Jan. 10, 2021; https://en.wikipedia.org/wiki/Differential_screw. Last Accessed Apr. 15, 2021. 3 pages.
[No Author Listed], Four Bar Mechanism. Chapter 7.1. https://ocw.metu.edu.tr/pluginfile.php/6885/mod_resource/content/1/ch7/7-1.htm. Accessed Apr. 15, 2021. 14 pages.
[No Author Listed], Grashof's Law. ME Mechanical. https://me-mechanicalengineering.com/grashofs-law/. Accessed Apr. 15, 2021. 7 pages.
Antos et al., Site-specific N- and C-terminal labeling of a single polypeptide using sortases of different specificity. J Am Chem Soc. Aug. 12, 2009;131(31):10800-1. doi: 10.1021/ja902681k.
Basile et al., Rapid online nonenzymatic protein digestion combining microwave heating acid hydrolysis and electrochemical oxidation. Anal Chem. Jan. 1, 2011;83(1):359-67. doi: 10.1021/ac1024705. Epub Dec. 7, 2010. Supplemental Information: 17 pages.
Becer et al., Click chemistry beyond metal-catalyzed cycloaddition. Angew Chem Int Ed Engl. 2009;48(27):4900-8. doi: 10.1002/anie.200900755.
Berge et al., Pharmaceutical salts. J Pharm Sci. Jan. 1977;66(1):1-19. doi: 10.1002/jps.2600660104.
Borgo et al., Computer-aided design of a catalyst for Edman degradation utilizing substrate-assisted catalysis. Protein Science. Dec. 2015; 24:571-579.
Bornstein et al., Cleavage at Asn-Gly bonds with hydroxylamine. Methods Enzymol. 1977;47:132-45. doi: 10.1016/0076-6879(77)47016-2.
Chen et al., Selective chemical labeling of proteins. Org Biomol Chem. Jun. 28, 2016;14(24):5417-39. doi: 10.1039/c6ob00126b. Epub Mar. 4, 2016.
Degani et al., Cyanylation of sulfhydryl groups by 2-nitro-5-thiocyanobenzoic acid. High-yield modification and cleavage of peptides at cysteine residues. Biochemistry. Jan. 1, 1974;13(1):1-11. doi: 10.1021/bi00698a001.
Devaraj et al., The Future of Bioorthogonal Chemistry. ACS Cent Sci. Aug. 22, 2018;4(8):952-959. doi: 10.1021/acscentsci.8b00251. Epub Jul. 23, 2018.
Ehrlich M., DNA methylation in cancer: too much, but also too little. Oncogene. Aug. 12, 2002;21(35):5400-13. doi: 10.1038/sj.onc.1205651.
Evans R., The Rise of Azide-Alkyne 1,3-Dipolar 'Click' Cycloaddition and its Application to Polymer Science and Surface Modification. Australian Journal of Chemistry 2007; 60: 384-395.
Fischnaller et al., Enrichment and desalting of tryptic protein digests and the protein depletion using boron nitride. Anal Chim Acta. May 1, 2014;823:40-50. doi: 10.1016/j.aca.2014.03.008. Epub Mar. 12, 2014.
Fontana et al., [34] Modification of tryptophan with BNPS-skatole (2-(2-nitrophenylsulfenyl)-3-methyl-3-bromoindolenine). Methods Enzymol. 1972;25:419-23. doi: 10.1016/S0076-6879(72)25037-6.
Fontana et al., Cleavage at tryptophan with o-iodosobenzoic acid. Methods Enzymol. 1983;91:311-8. doi: 10.1016/s0076-6879(83)91028-5.
Fredolini et al., Immunocapture strategies in translational proteomics. Expert Rev Proteomics. 2016;13(1):83-98. doi: 10.1586/14789450.2016.1111141. Epub Nov. 11, 2015.
Fredolini et al., Systematic assessment of antibody selectivity in plasma based on a resource of enrichment profiles. Sci Rep. Jun. 6, 2019;9(1):8324. doi: 10.1038/s41598-019-43552-5.
Giansanti et al., Six alternative proteases for mass spectrometry-based proteomics beyond trypsin. Nat Protoc. May 2016; 11(5):993-1006. doi: 10.1038/nprot.2016.057. Epub Apr. 28, 2016.
Gilmore et al., N-terminal protein modification through a biomimetic transamination reaction. Angew Chem Int Ed Engl. Aug. 11, 2006;45(32):5307-11. doi: 10.1002/anie.200600368. Erratum in: Angew Chem Int Ed Engl. 2008;47(41):7788.
Gross et al., Selective cleavage of the methionyl peptide bonds in ribonuclease with cyanogen bromide1. Journal of the American Chemical Society. 1961; 83(6): 1510-1511.
Harney et al., Small-protein Enrichment Assay Enables the Rapid, Unbiased Analysis of Over 100 Low Abundance Factors from Human Plasma. Mol Cell Proteomics. Sep. 2019;18(9):1899-1915. doi: 10.1074/mcp.TIR119.001562. Epub Jul. 15, 2019.
Ho et al., N-Myristoyl Transferase (NMT)-Catalyzed Labeling of Bacterial Proteins for Imaging in Fixed and Live Cells. Enzyme-Mediated Ligation Methods, Springer. 2019; 315-326.
Huang et al., Cleavage at tryptophanyl residues with dimethyl sulfoxide-hydrochloric acid and cyanogen bromide. Methods Enzymol. 1983;91:318-24. doi: 10.1016/s0076-6879(83)91029-7.
Hustoft et al., A Critical Review of Trypsin Digestion for LC-MS Based Proteomics. Integrative Proteomics. 2012; 73-92. www.intechopen.com.
Hustoft et al., Open tubular lab-on-column/mass spectrometry for targeted proteomics of nanogram sample amounts. PLoS One. Sep. 15, 2014;9(9):e106881. doi: 10.1371/journal.pone.0106881.
Hustoft et al., Critical assessment of accelerating trypsination methods. J Pharm Biomed Anal. Dec. 15, 2011;56(5):1069-78. doi: 10.1016/j.jpba.2011.08.013. Epub Aug. 11, 2011.
Inglis et al., Cleavage at aspartic acid. Methods Enzymol. 1983;91:324-32. doi: 10.1016/s0076-6879(83)91030-3.
Iwasaki et al., The cleavage of tyrosyl-peptide bonds by electrolytic oxidation. Journal of the American Chemical Society. 1983; 85(22): 3701-3702.
Jankovska et al., Affinity depletion versus relative protein enrichment: a side-by-side comparison of two major strategies for increasing human cerebrospinal fluid proteome coverage. Clin Proteomics. Feb. 26, 2019;16:9. doi: 10.1186/s12014-019-9229-1.
Jiang et al., A one-step preparation method of monolithic enzyme reactor for highly efficient sample preparation coupled to mass spectrometry-based proteomics studies. J Chromatogr A. Sep. 18, 2015;1412:75-81. doi: 10.1016/j.chroma.2015.07.121. Epub Aug. 5, 2015.
Kolb et al., Click Chemistry: Diverse Chemical Function from a Few Good Reactions. Angew Chem Int Ed Engl. Jun. 1, 2001;40(11):2004-2021. doi: 10.1002/1521-3773(20010601)40:11<2004::aid-anie2004>3.3.co;2-x.
Koushik et al., Cerulean, Venus, and VenusY67C FRET reference standards. Biophys J. Dec. 15, 2006;91(12):L99-L101. doi: 10.1529/biophysj.106.096206. Epub Oct. 13, 2006. PMID: 17040988; PMCID: PMC1779932.

(56) References Cited

OTHER PUBLICATIONS

Ly et al., Protein and peptide fractionation, enrichment and depletion: tools for the complex proteome. Proteomics. Feb. 2011;11(4):513-34. doi: 10.1002/pmic.201000394. Epub Jan. 17, 2011.
Marino et al., Protein Termini and Their Modifications Revealed by Positional Proteomics. ACS Chem Biol. Aug. 21, 2015;10(8):1754-64. doi: 10.1021/acschembio.5b00189. Epub Jul. 6, 2015.
Marziali et al., "Novel electrophoresis mechanism based on synchronous alternating drag perturbation", Electrophoresis, 2005, 26:82-90.
Monzo et al., Proteolytic enzyme-immobilization techniques for MS-based protein analysis. TrAC Trends in Analytical Chemistry 2009; 28(7): 854-864.
Moore et al., Extraction, Enrichment, Solubilization, and Digestion Techniques for Membrane Proteomics. J Proteome Res. Apr. 1, 2016;15(4):1243-52. doi: 10.1021/acs.jproteome.5b01122. Epub Mar. 24, 2016. Supplemental Information: 40 pages.
Omenn et al., Modification of the single tryptophan residue of staphylococcal nuclease by a new mild oxidizing agent. J Biol Chem. Apr. 25, 1970;245(8):1895-902.
Polaskova et al., High-abundance protein depletion: comparison of methods for human plasma biomarker discovery. Electrophoresis. Jan. 2010;31(3):471-82. doi: 10.1002/elps.200900286.
Poon et al., Differential DNA methylation between fetus and mother as a strategy for detecting fetal DNA in maternal plasma. Clin Chem. Jan. 2002;48(1):35-41.
Rodriguez et al., The solvent in CNBr cleavage reactions determines the fragmentation efficiency of ketosteroid isomerase fusion proteins used in the production of recombinant peptides. Protein Expr Purif. Apr. 2003;28(2):224-31. doi: 10.1016/s1046-5928(02)00700-3.
Saito et al., Dual-labeled oligonucleotide probe for sensing adenosine via FRET: a novel alternative to SNPs genotyping. Chem Commun (Camb). Jun. 7, 2007;(21):2133-5. doi: 10.1039/b618465k. Epub Feb. 28, 2007. PMID: 17520113.
Sato et al., Polyproline-rod approach to isolating protein targets of bioactive small molecules: isolation of a new target of indomethacin. J Am Chem Soc. Jan. 31, 2007;129(4):873-80. doi: 10.1021/ja0655643. PMID: 17243824.
Saveliev et al., Trypsin/Lys-C protease mix for enhanced protein mass spectrometry analysis. Nature Methods. 2013; 10(11): i-ii.
Stryer et al., Energy transfer: a spectroscopic ruler. Proc Natl Acad Sci U S A. Aug. 1967;58(2):719-26. doi: 10.1073/pnas.58.2.719. PMID: 5233469; PMCID: PMC335693.
Swaminathan et al., A theoretical justification for single molecule peptide sequencing. PLoS Comput Biol. Feb. 25, 2015;11(2):e1004080. doi: 10.1371/journal.pcbi.1004080.
Swaney et al., Value of using multiple proteases for large-scale mass spectrometry-based proteomics. J Proteome Res. Mar. 5, 2010;9(3):1323-9. doi: 10.1021/pr900863u.
Tang et al., Site-Specific C-Terminal Labeling of Peptides and Proteins using Asparaginyl Endopeptidase in a Chemo-Enzymatic Sequence. 2019; 5 pages.
Tsiatsiani et al., Proteomics beyond trypsin. FEBS J. Jul. 2015;282(14):2612-26. doi: 10.1111/febs.13287. Epub Apr. 14, 2015.
Tsuruoka et al., Optimization of the rate of DNA hybridization and rapid detection of methicillin resistant *Staphylococcus aureus* DNA using fluorescence polarization. J Biotechnol. Jul. 31, 1996;48(3):201-8. doi: 10.1016/0168-1656(96)01510-6.
Walton et al., Electrosynthetic modification of proteins: electrooxidations at methionine and tryptophan in hen egg-white lysozyme. Electrochimica acta. 1997; 42(15): 2285-2294.
Williams et al., An artificial processivity clamp made with streptavidin facilitates oriented attachment of polymerase-DNA complexes to surfaces. Nucleic Acids Res. Oct. 2008;36(18):e121. doi: 10.1093/nar/gkn531. Epub Aug. 22, 2008. PMID: 18723573; PMCID: PMC2566871.
Winter et al., Optimization of cell lysis and protein digestion protocols for the analysis of HeLa S3 cells by LC-MS/MS. Proteomics. Dec. 2011;11(24):4726-30. doi: 10.1002/pmic.201100162. Epub Nov. 23, 2011.
Xu et al., Chemoenzymatic labeling of protein C-termini for positive selection of C-terminal peptides. ACS Chem Biol. Oct. 21, 2011;6(10):1015-20. doi: 10.1021/cb200164h. Epub Aug. 10, 2011. Supplemental Information: 19 pages.
Yao et al., Single-molecule protein sequencing through fingerprinting: computational assessment. Phys Biol. Aug. 12, 2015;12(5):055003. doi: 10.1088/1478-3975/12/5/055003.
Zhang et al., Planar Linkages. Introduction to Mechanisms. Chapter 5. Accessed Apr. 15, 2021. https://www.cs.cmu.edu/~rapidproto/mechanisms/chpt5.html. 10 pages.
International Preliminary Report on Patentability dated Nov. 3, 2022 for Application No. PCT/US2021/028471.
Invitation to Pay Additional Fees dated Jun. 24, 2022 for Application No. PCT/US2022/025517.
International Search Report and Written Opinion dated Sep. 1, 2022 for Application No. PCT/US2022/025517.
Ghatak et al., A simple method of genomic DNA extraction from human samples for PCR-RFLP analysis. J Biomol Tech. Dec. 2013;24(4):224-31. doi: 10.7171/jbt.13-2404-001.
International Preliminary Report on Patentability dated Aug. 3, 2023 for Application No. PCT/US2022/012986.
Amstad et al., The microfluidic post-array device: high throughput production of single emulsion drops. Lab Chip. Feb. 21, 2014;14(4):705-9. doi: 10.1039/c3lc51213d.
Gunther et al., Depletion of highly abundant proteins from human cerebrospinal fluid: a cautionary note. Mol Neurodegener. Oct. 15, 2015;10:53. doi: 10.1186/s13024-015-0050-7.
Loutherback, Microfluidic Devices for High Throughput Cell Sorting and Chemical Treatment. Dissertation, Princeton University; 2011. 108 pages.
Non-Final Office Action mailed Dec. 19, 2023 for U.S. Appl. No. 17/083,126.

* cited by examiner

T

A

C

G

PERISTALTIC PUMPING OF FLUIDS AND ASSOCIATED METHODS, SYSTEMS, AND DEVICES

RELATED APPLICATIONS

This application claims priority under 35 U.S.C. § 119(e) to U.S. Provisional Application No. 62/927,385, filed Oct. 29, 2019, and entitled, "Peristaltic Pumping of Fluids and Associated Methods, Systems, and Devices," which is incorporated herein by reference in its entirety for all purposes.

FIELD

Embodiments described herein generally relate to apparatuses, cartridges, and pumps for peristaltic pumping of fluids and associated methods, systems, and devices.

BACKGROUND

Microfluidics generally involves controlling the flow of fluid(s) that is/are geometrically constrained in at least one dimension (e.g., in two dimensions). For example, microfluidics may involve controlling the flow of fluid(s) in container(s) (e.g., channel(s)) having at least one dimension typically below 1 mm in size. The ability to transport fluids with a relatively high fluid flow resolution, e.g., on the order of 1 mL or less, may be advantageous in biomedical applications, for example, in which a relatively small number of molecules (e.g., nucleic acids, peptides, proteins) are to be prepared and/or detected. However, conventional systems and methods of pumping fluids on a microfluidic scale may suffer limitations that hinder miniaturization of devices comprising conventional microfluidic pumping systems and/or decrease throughput of samples through conventional microfluidic pumping systems.

Accordingly, improved systems and methods are needed.

SUMMARY

Embodiments described herein generally relate to apparatuses, cartridges, and pumps for peristaltic pumping of fluids and associated methods, systems, and devices.

In some aspects, apparatuses are described. In some embodiments, the apparatus comprises a roller and a crank-and-rocker mechanism connected to the roller by a connecting arm.

In some embodiments, the apparatus comprises a roller, a crank, a rocker, and a connecting arm configured so as to join the crank to the rocker and the roller.

In some aspects, cartridges are described. In some embodiments, the cartridge comprises a base layer having a surface comprising channels, wherein at least a portion of at least some of the channels have a substantially triangularly-shaped cross-section having a single vertex at a base of the channel and having two other vertices at the surface of the base layer, and have a surface layer, comprising an elastomer, configured to substantially seal off a surface opening of the channel.

In some aspects, peristaltic pumps are described. In some embodiments, the peristaltic pump comprises (i) a roller; and (ii) a cartridge, comprising a base layer having a surface comprising channels, wherein at least a portion of at least some of the channels have a substantially triangularly-shaped cross-section having a single vertex at a base of the channel and having two other vertices at the surface of the base layer, and have a surface layer, comprising an elastomer, configured to substantially seal off a surface opening of the channel.

In other aspects, methods of making an apparatus are described. In some embodiments, the method comprises connecting a crank arm, a rocker arm, and a roller to a connecting arm, and connecting a shaft of the rocker arm to a shaft of the crank arm such that the axis of rotation of the rocker shaft is held stationary relative to the axis of rotation of the crank shaft.

In another aspect, methods of making a cartridge are described. In some embodiments, the method comprises assembling a surface article comprising a surface layer with a base layer to form the cartridge, wherein the surface layer comprises an elastomer, wherein the base layer comprises one or more channels, and wherein at least some of the one or more channels have a substantially triangularly-shaped cross-section.

In another aspect, methods of making a pump are described. In some embodiments, the method comprises assembling a surface article comprising a surface layer with a base layer to form a cartridge, assembling an apparatus comprising a roller, and positioning the cartridge below the roller, wherein the surface layer comprises an elastomer, wherein the base layer comprises one or more channels, and wherein at least some of the one or more channels have a substantially triangularly-shaped cross-section.

In another aspect, methods are described. In some embodiments, the method comprises rotating the crank of an apparatus or peristaltic pump described herein such that the roller engages with and/or disengages from a substrate surface.

In another aspect, methods are described. In some embodiments, the method comprises deforming a first portion of a surface layer comprising an elastomer into a channel containing a fluid, such that an inner surface of the first portion of the surface layer contacts a first portion of walls and/or a base of the channel proximal to the inner surface of the first portion of the surface layer, and translating this deformation to a second portion of the surface layer such that an inner surface of the second portion of the surface layer contacts a second portion of the walls and/or base of the channel proximal to the inner surface of the second portion of the surface layer, wherein the surface layer is configured to seal off a surface opening of the channel.

The foregoing and other aspects, embodiments, and features of the present teachings can be more fully understood from the following description in conjunction with the accompanying drawings. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

The skilled artisan will understand that the figures, described herein, are for illustration purposes only. It is to be understood that, in some instances, various aspects of the invention may be shown exaggerated or enlarged to facilitate an understanding of the invention. In the drawings, like reference characters generally refer to like features, functionally similar and/or structurally similar elements throughout the various figures. The drawings are not necessarily to scale, emphasis instead being placed upon illustrating the principles of the teachings. The drawings are not intended to limit the scope of the present teachings in any way.

The features and advantages of the present invention will become more apparent from the detailed description set forth below when taken in conjunction with the drawings.

When describing embodiments in reference to the drawings, direction references ("above," "below," "top," "bottom," "left," "right," "horizontal," "vertical," etc.) may be used. Such references are intended merely as an aid to the reader viewing the drawings in a normal orientation. These directional references are not intended to describe a preferred or only orientation of an embodied device. A device may be embodied in other orientations.

As is apparent from the detailed description, the examples depicted in the figures and further described for the purpose of illustration throughout the application describe non-limiting embodiments, and in some cases may simplify certain processes or omit features or steps for the purpose of clearer illustration.

Figure 1A:
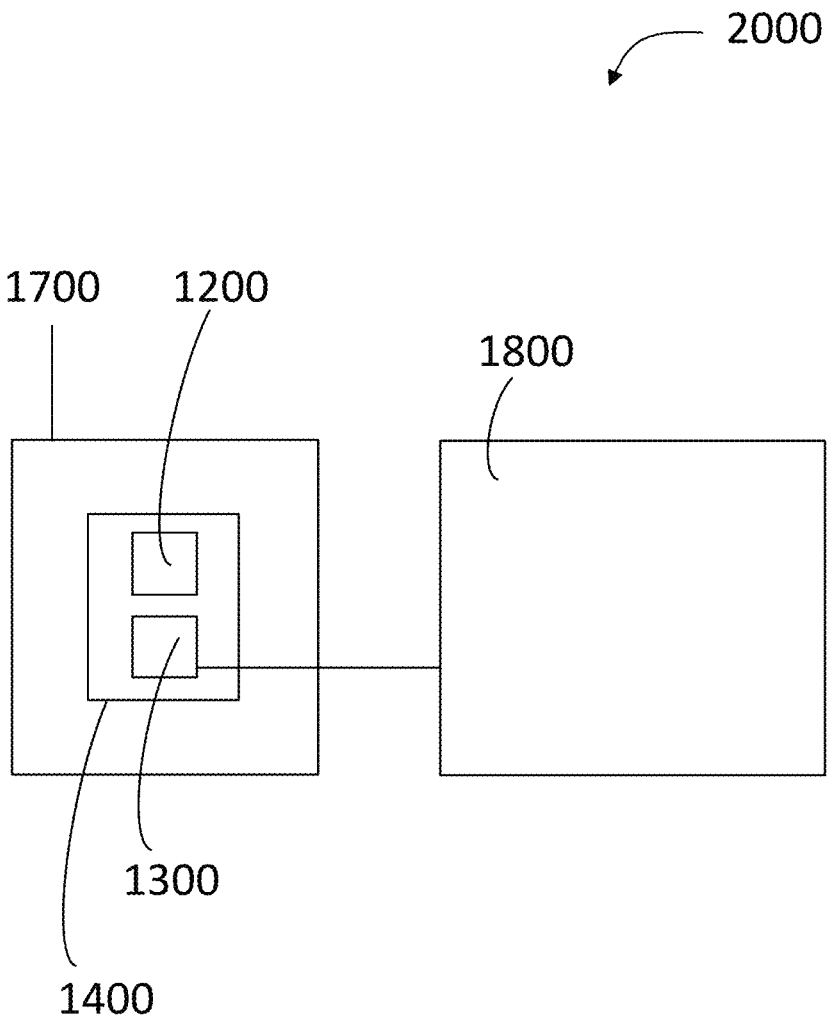
Figure 1B:
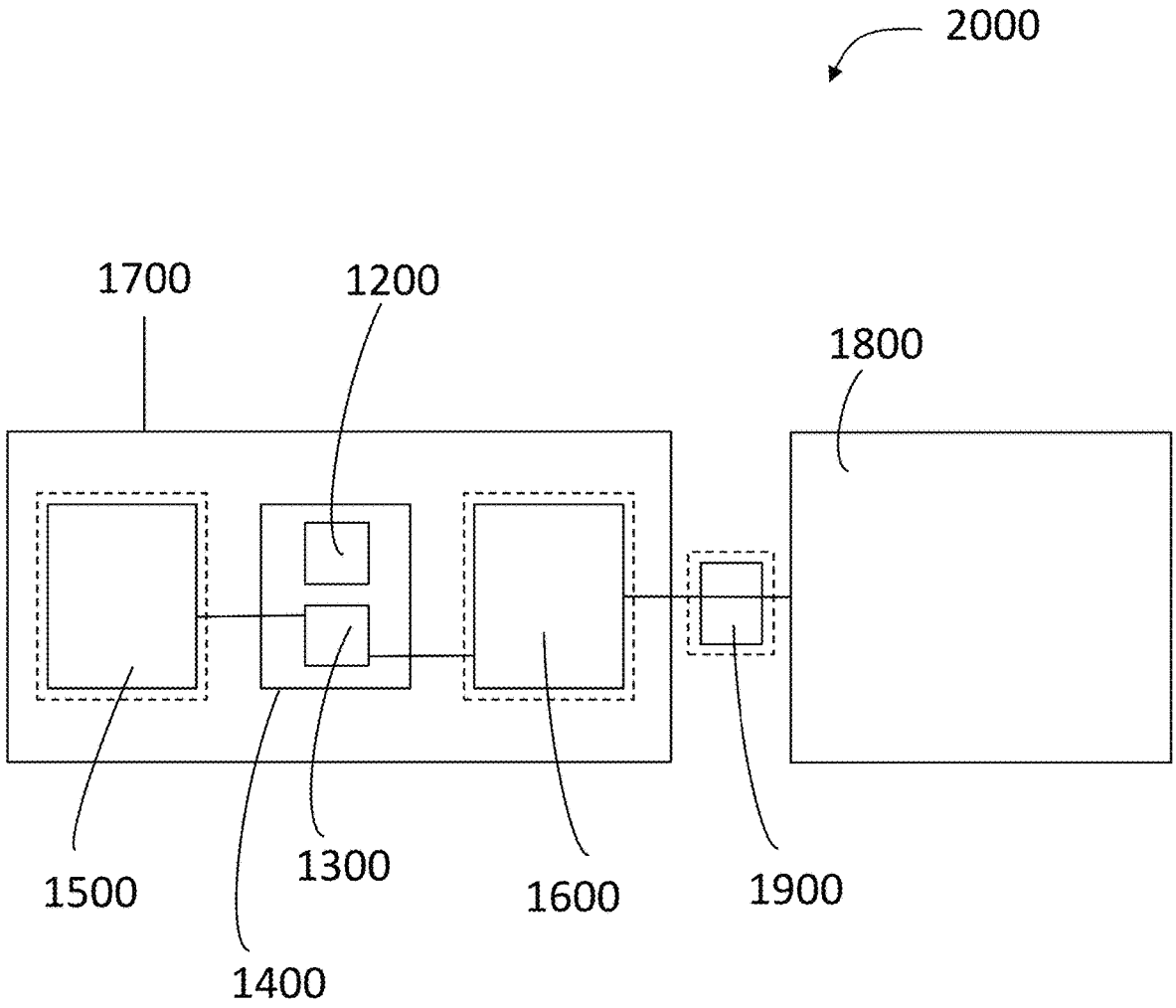
Figure 2A:
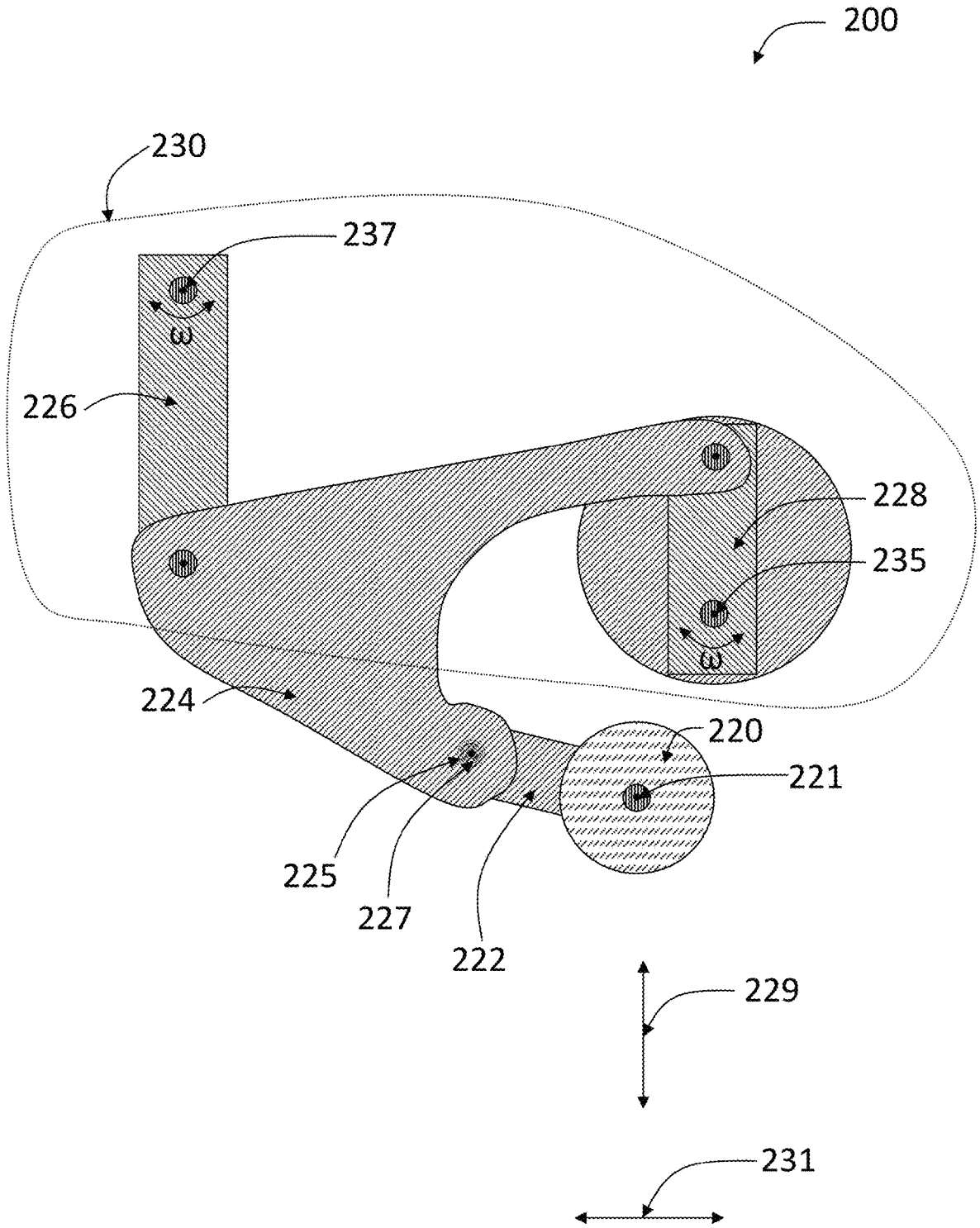
Figure 2B:
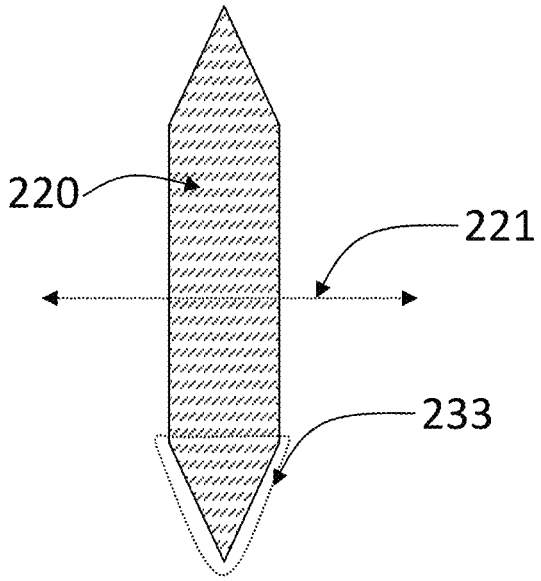
Figure 3A:
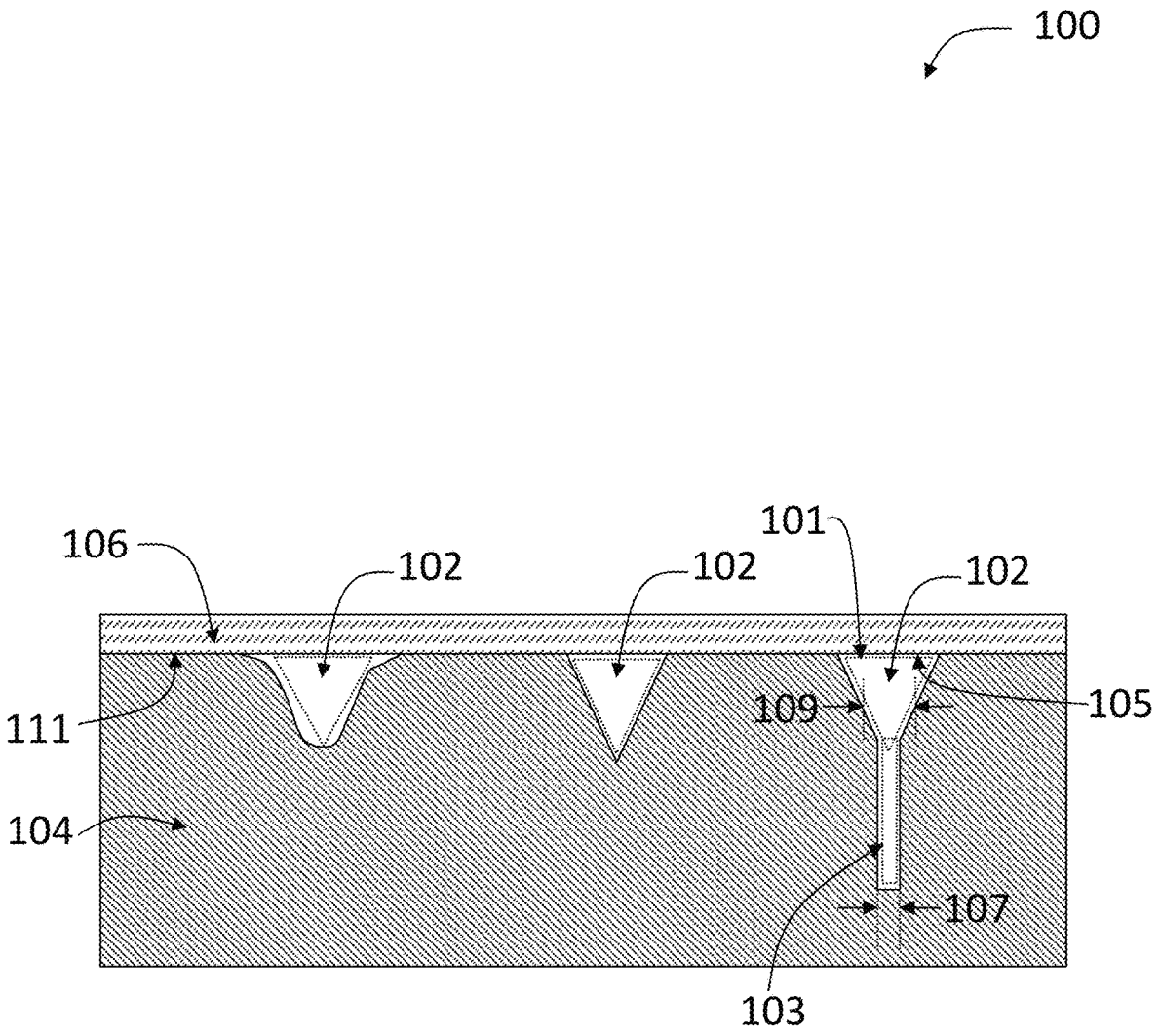
Figure 3B:
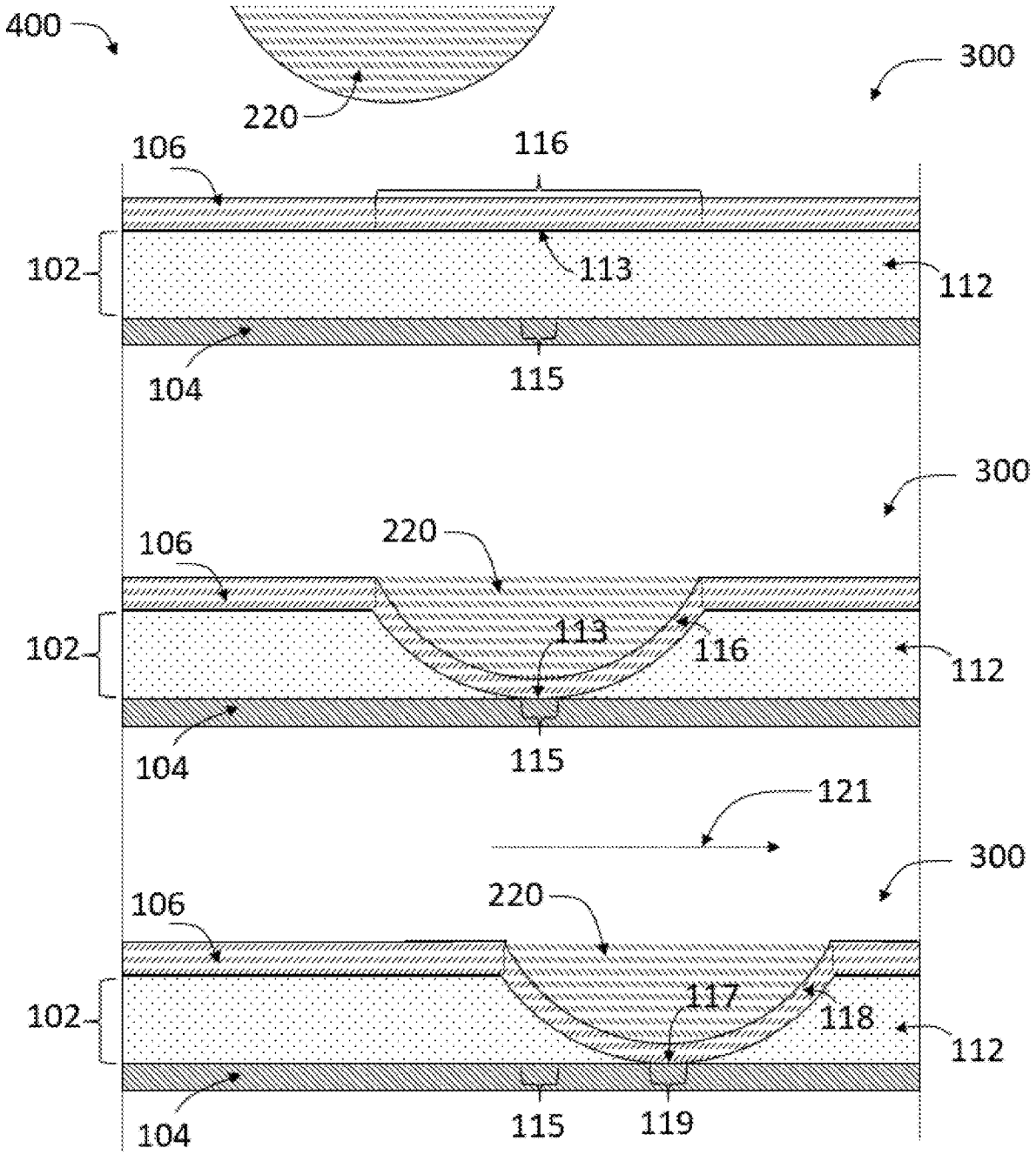
Figure 3C:
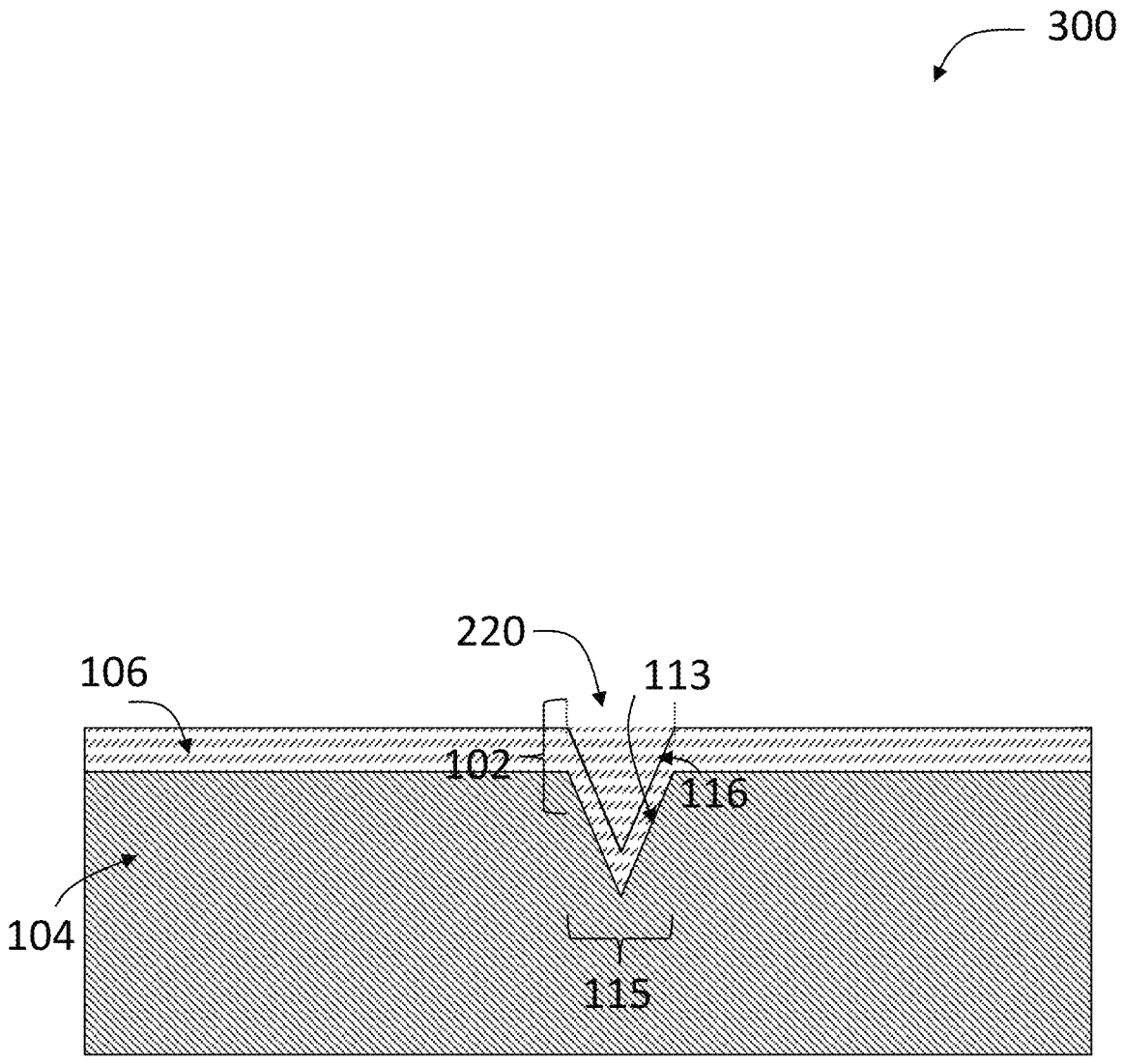
Figure 4A:
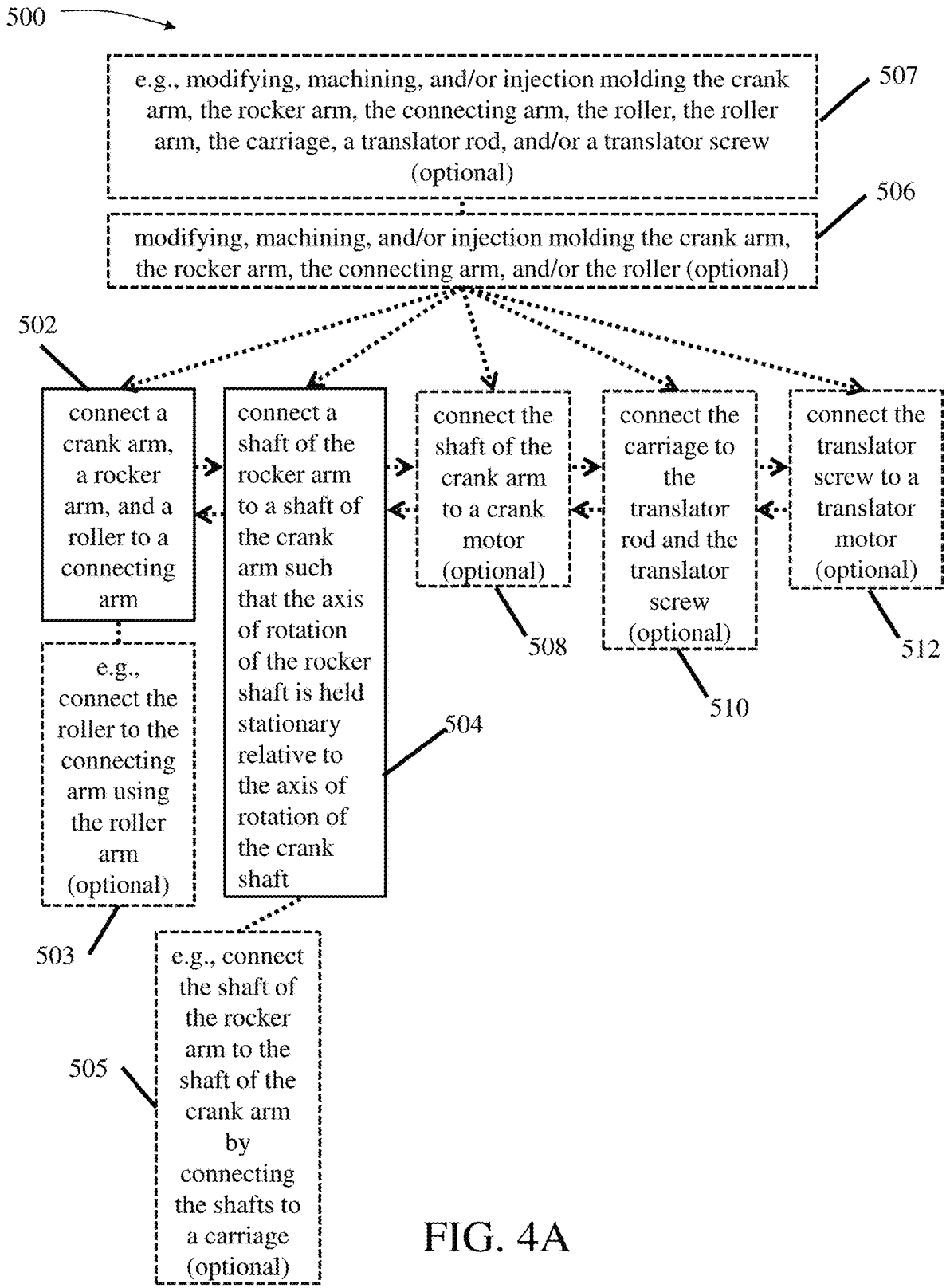
Figure 4B:
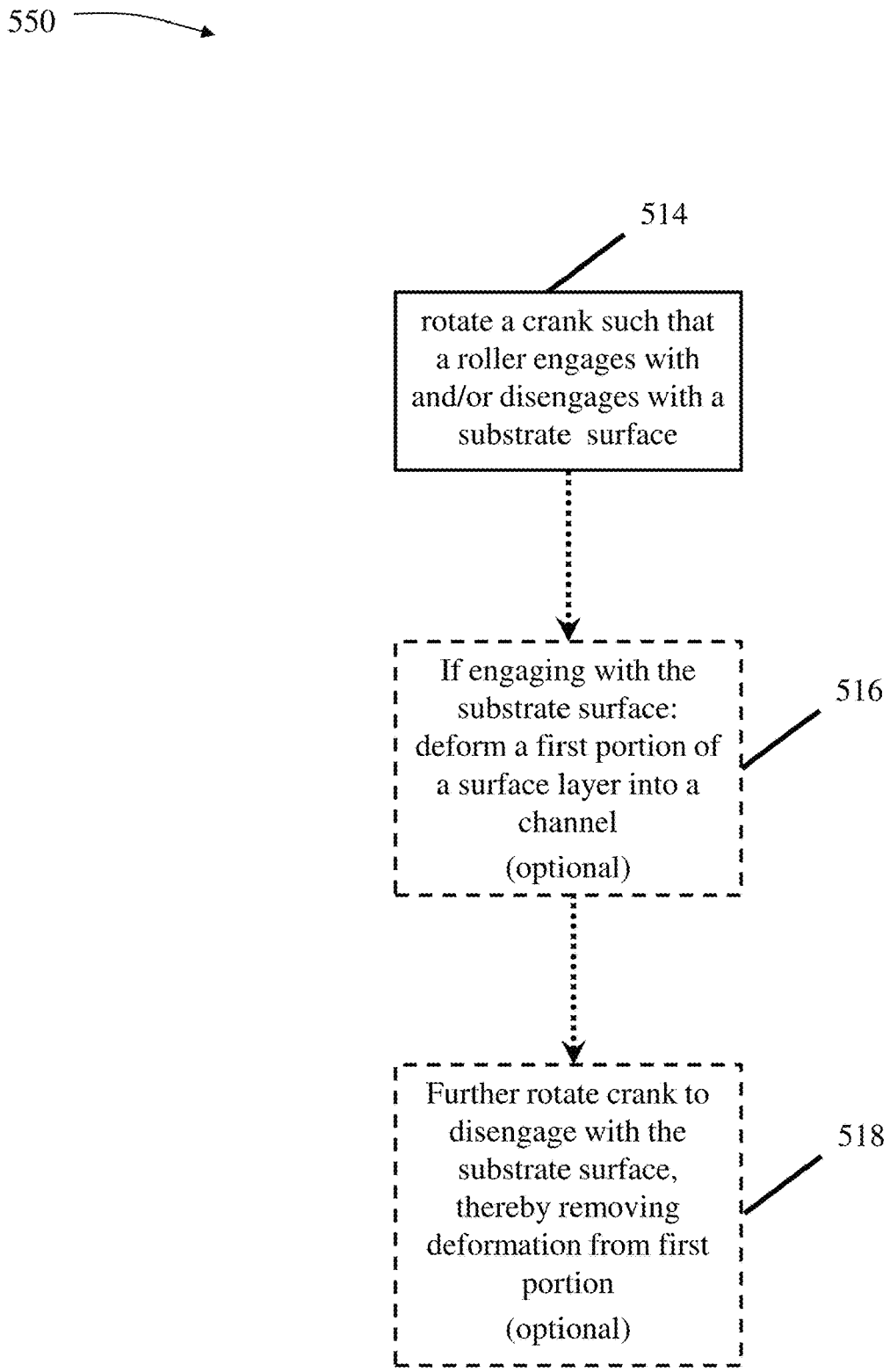
Figure 4C:
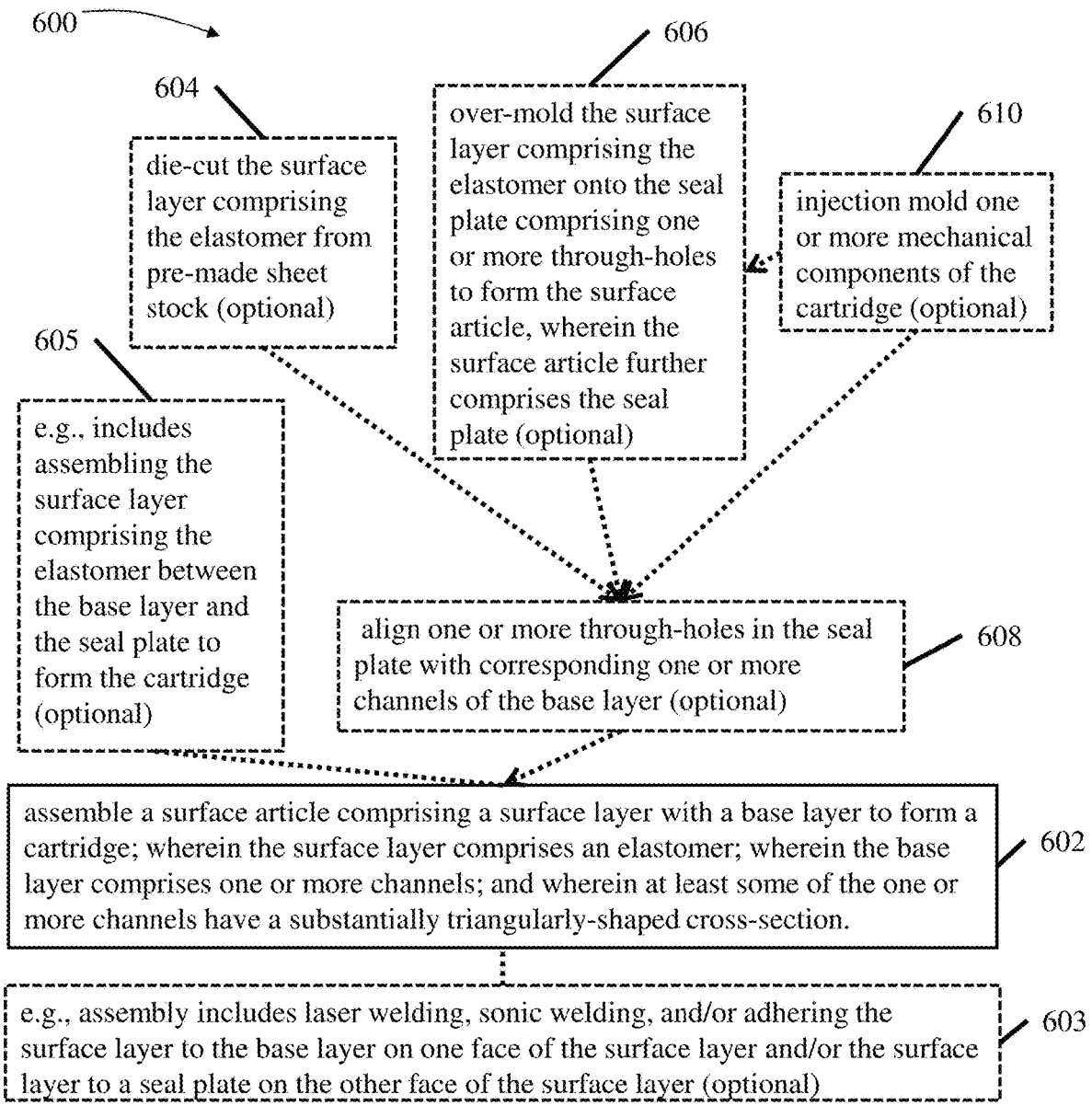
Figure 4D:
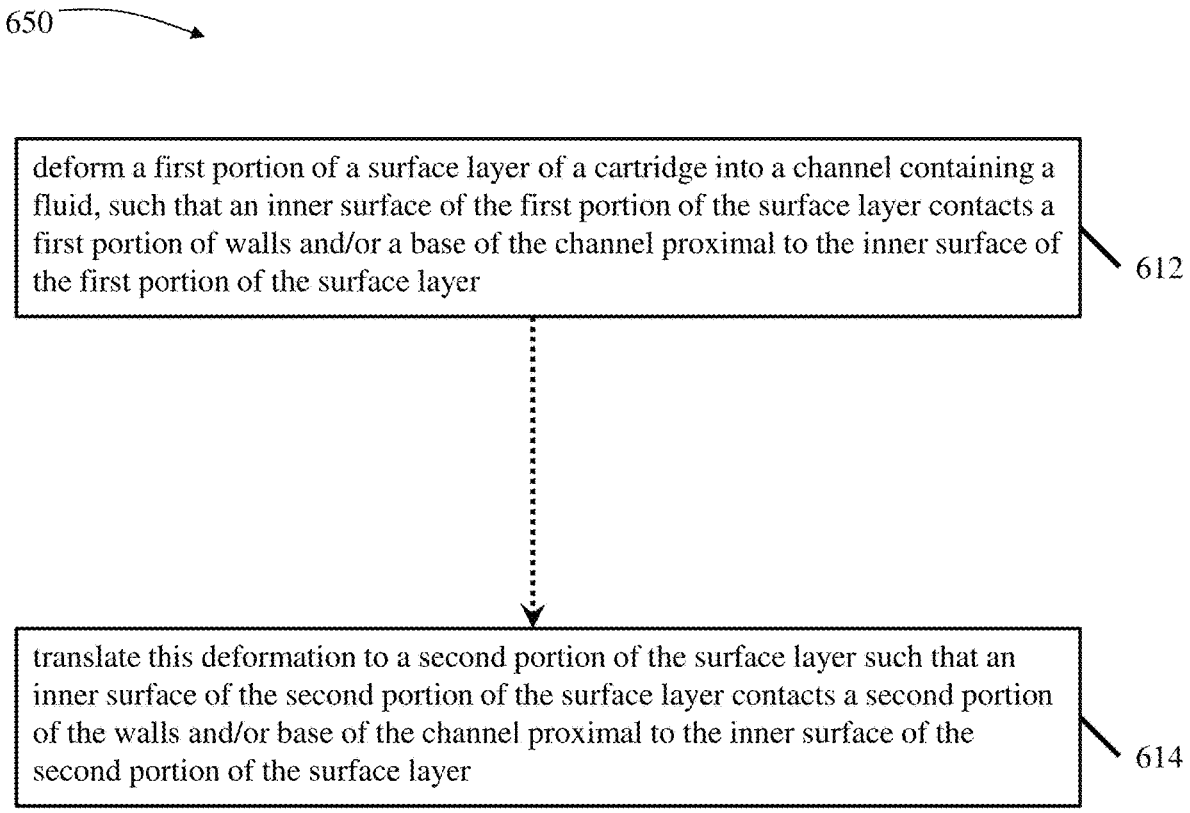
Figure 5:
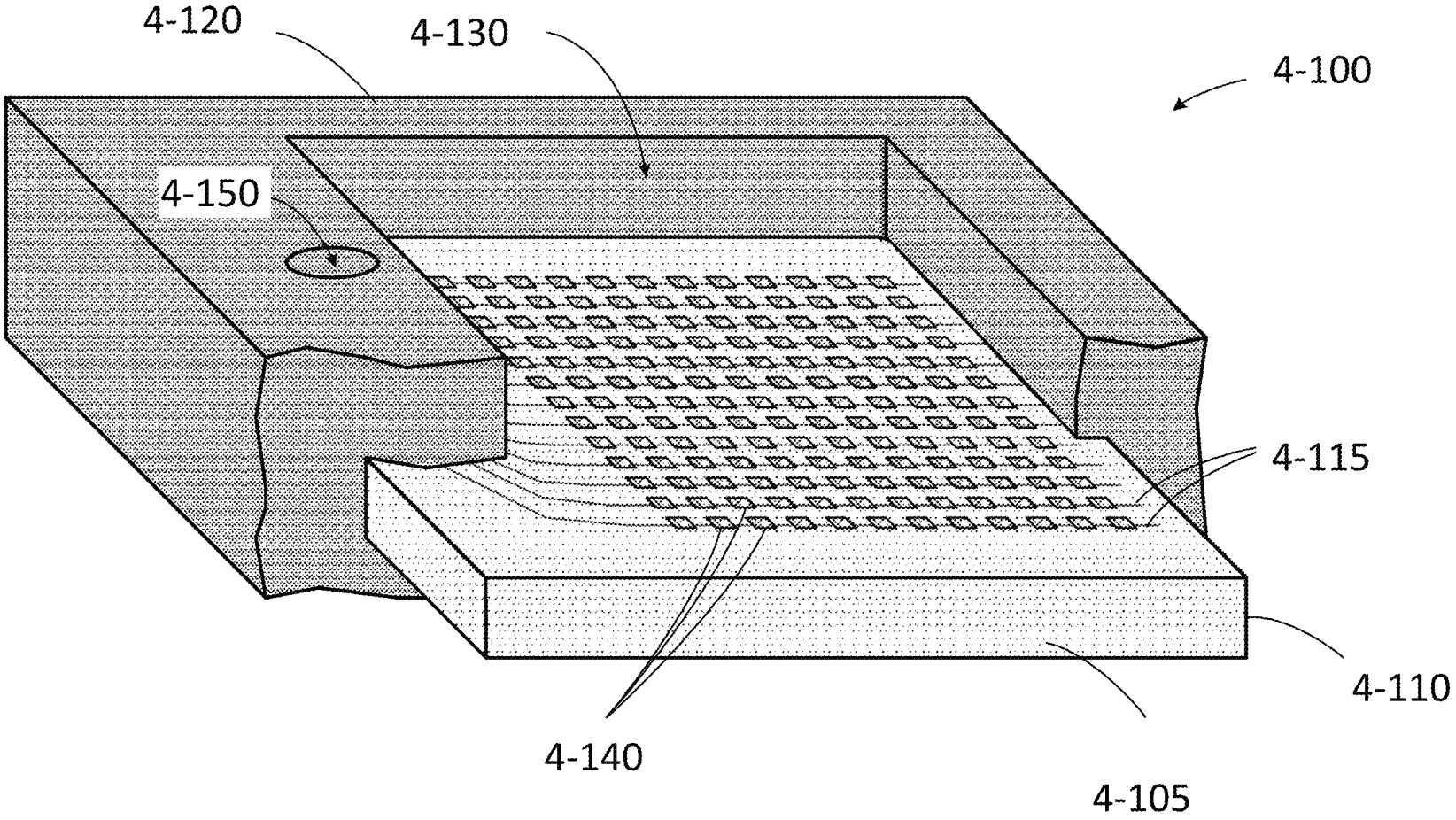
Figure 6A:
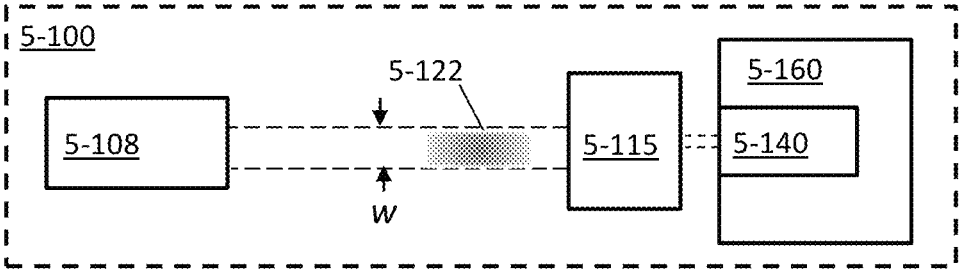
Figure 6B:
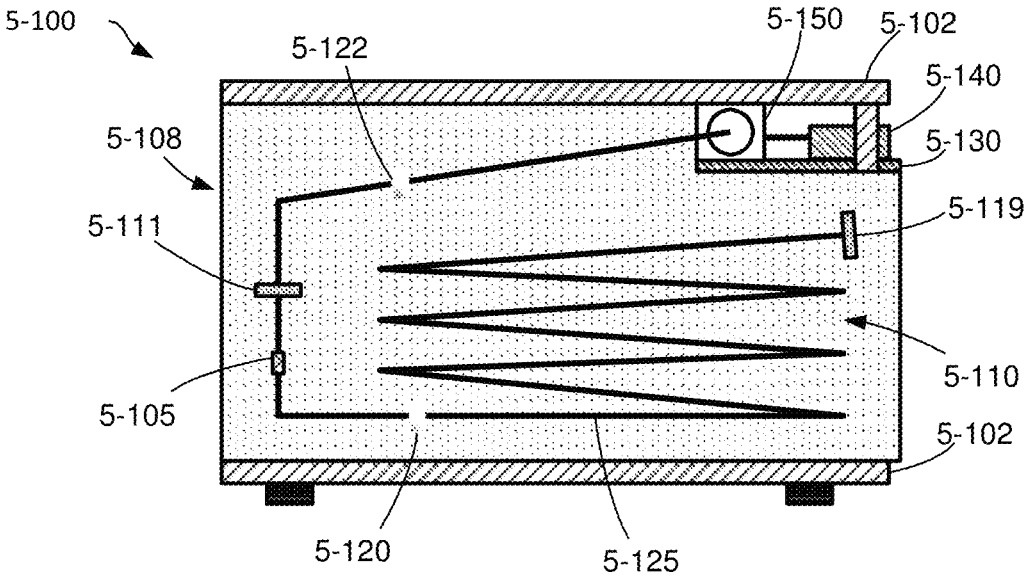
Figure 6C:
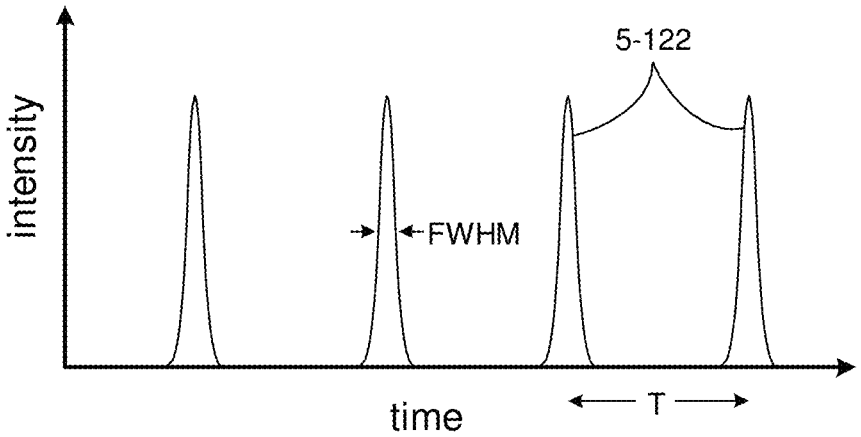
Figure 6D:
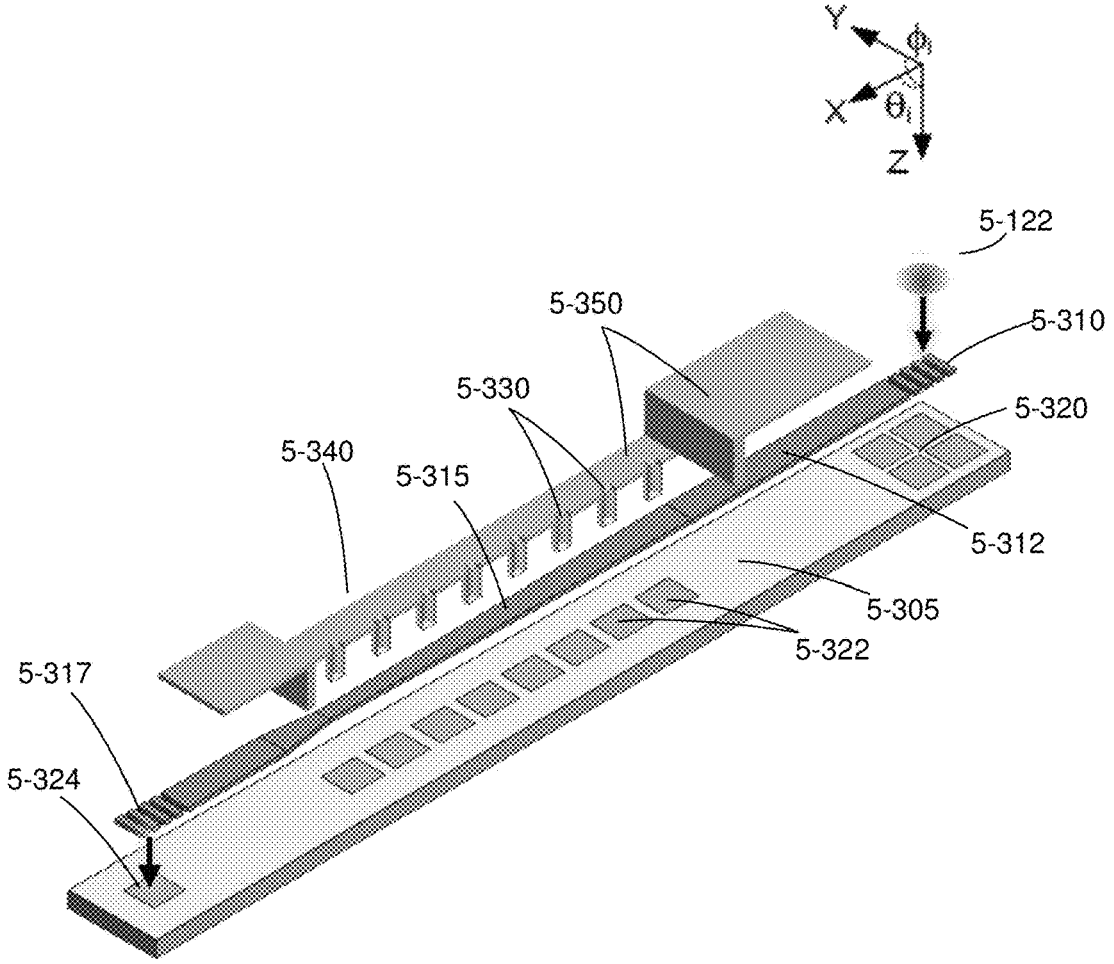
Figure 6E:
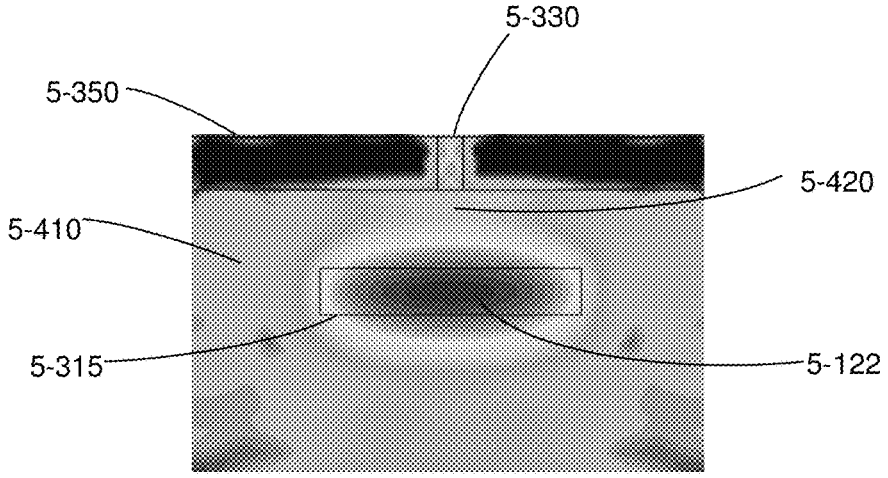
Figure 6F:
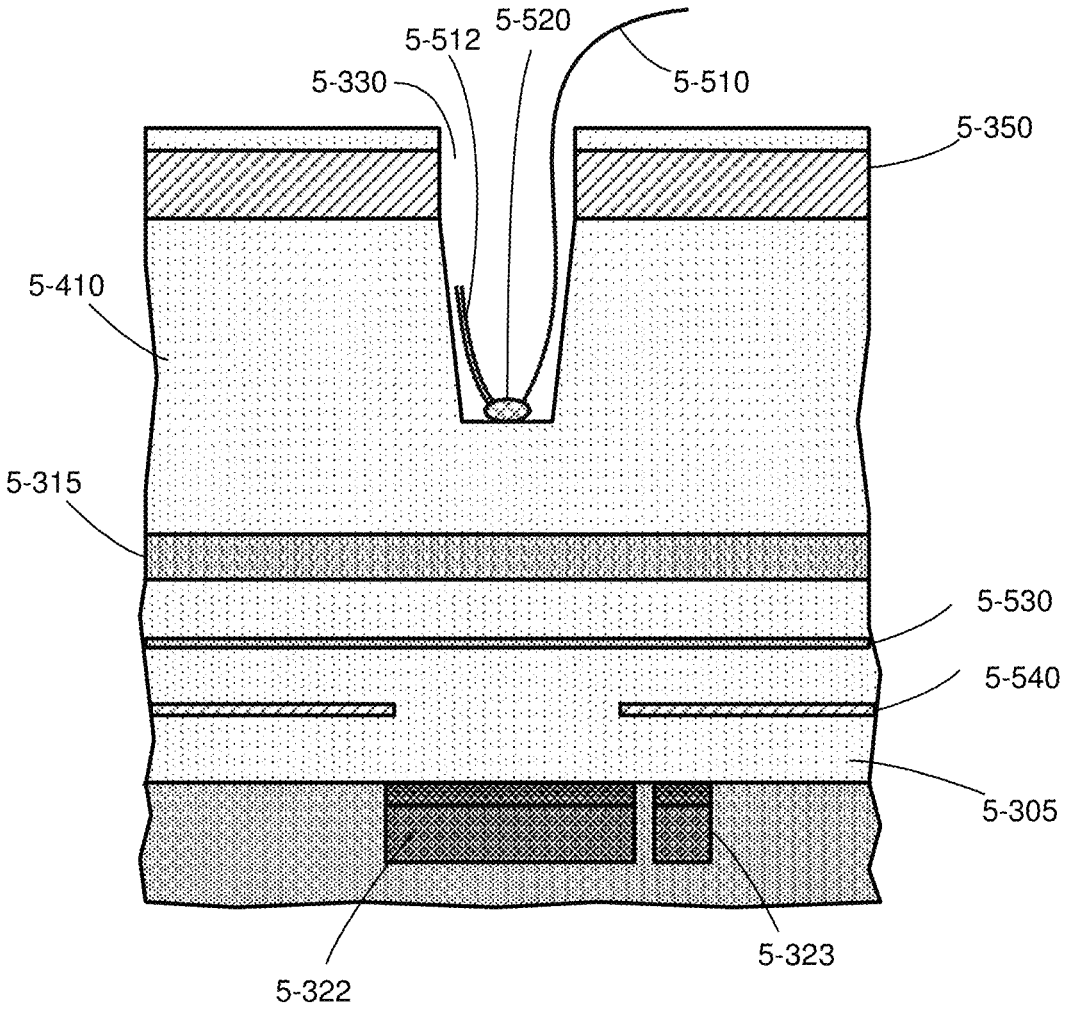
Figure 6G:
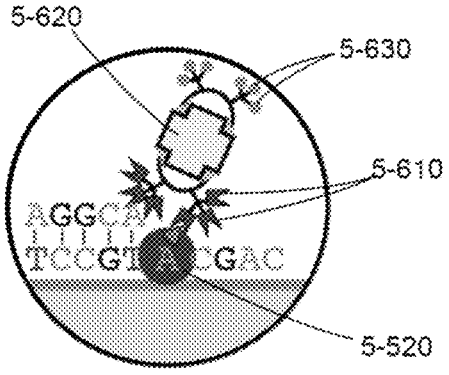
Figure 6H:
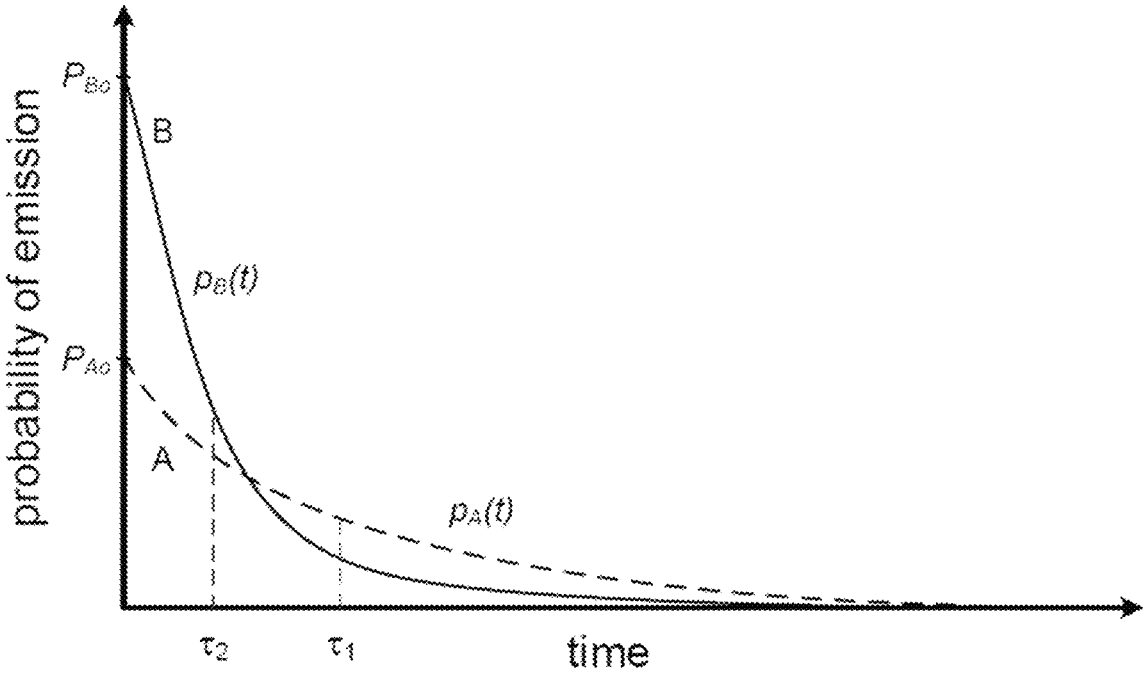
Figure 6I:
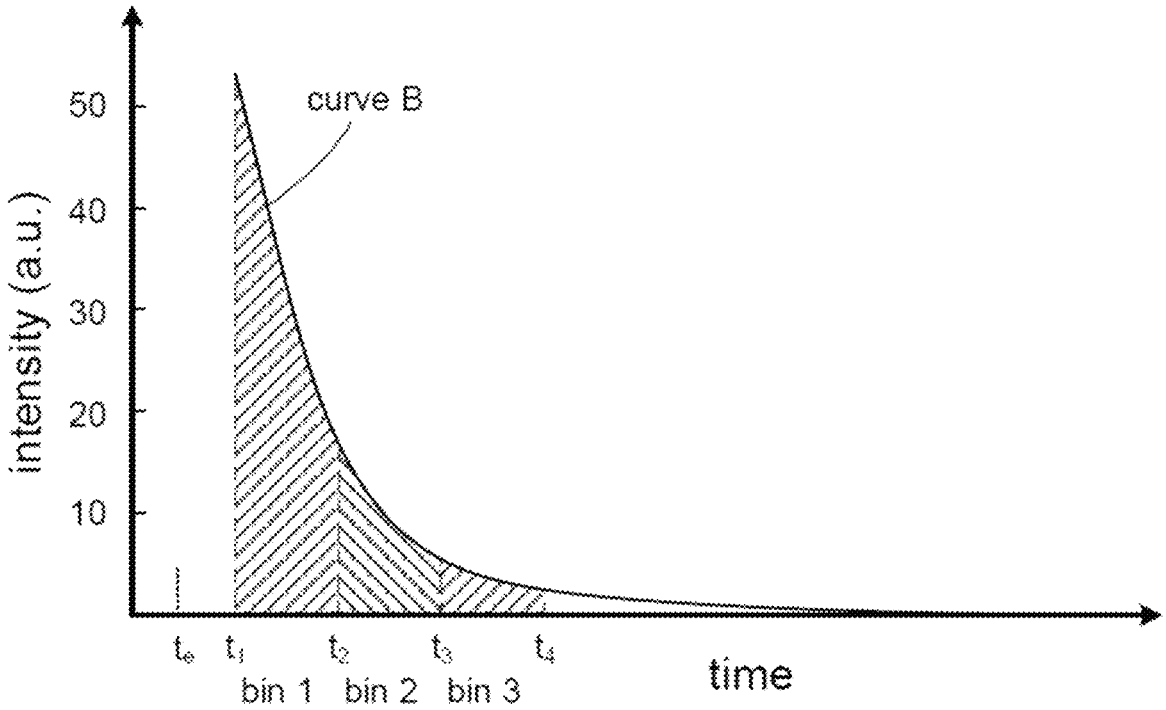
Figure 6J:
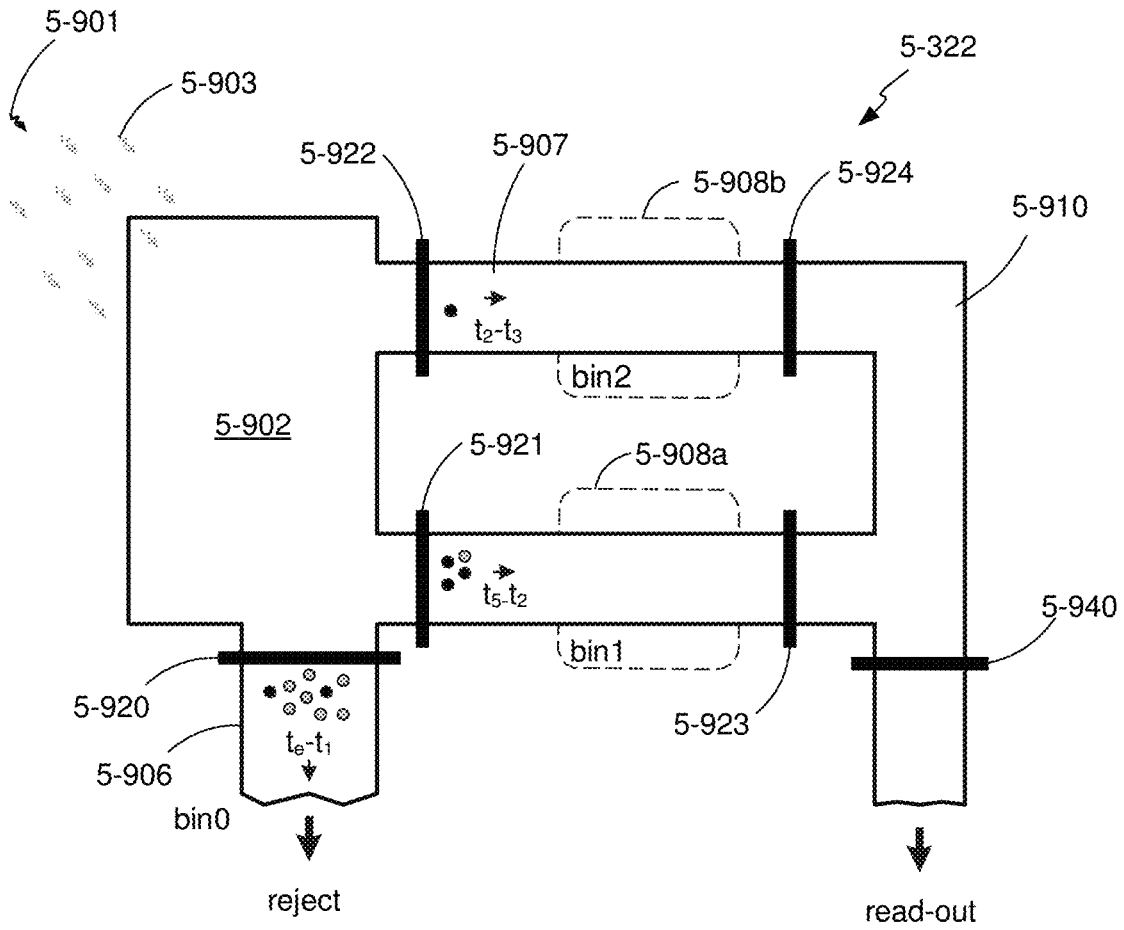
Figure 6K:
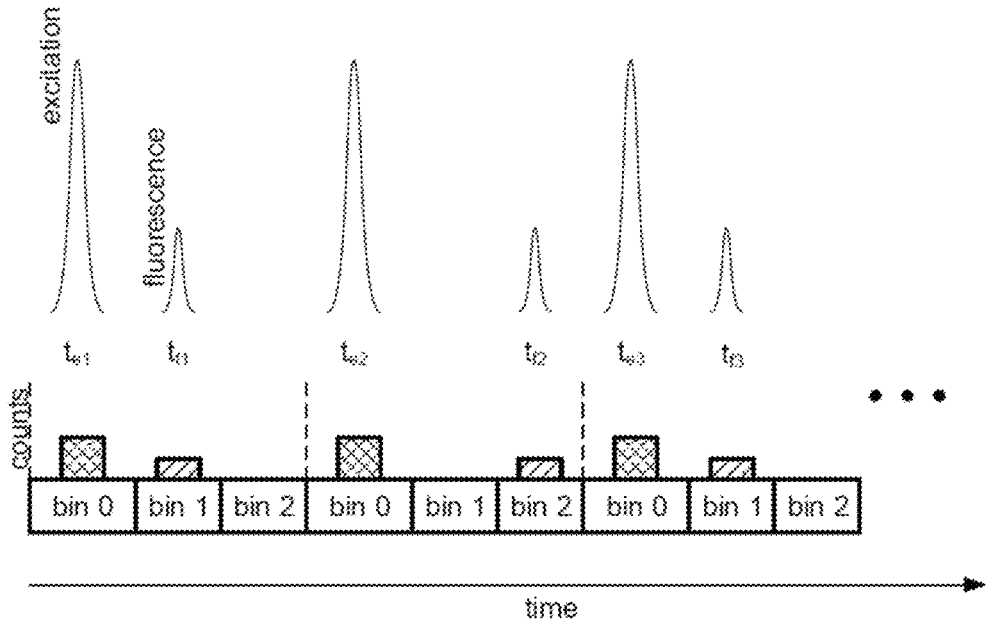
Figure 6L:
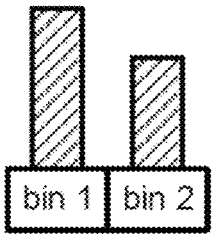
Figure 7A:
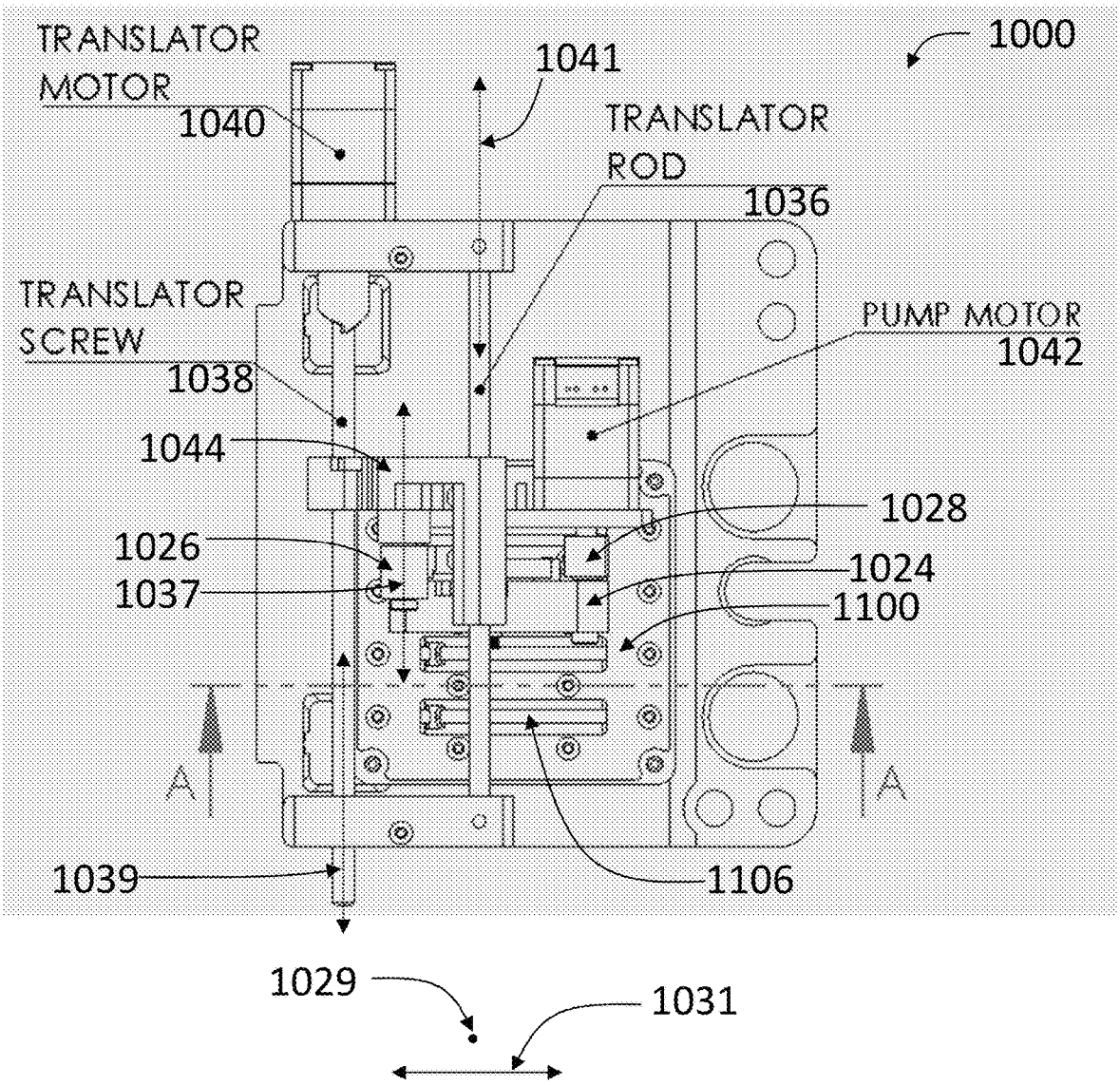
Figure 7B:
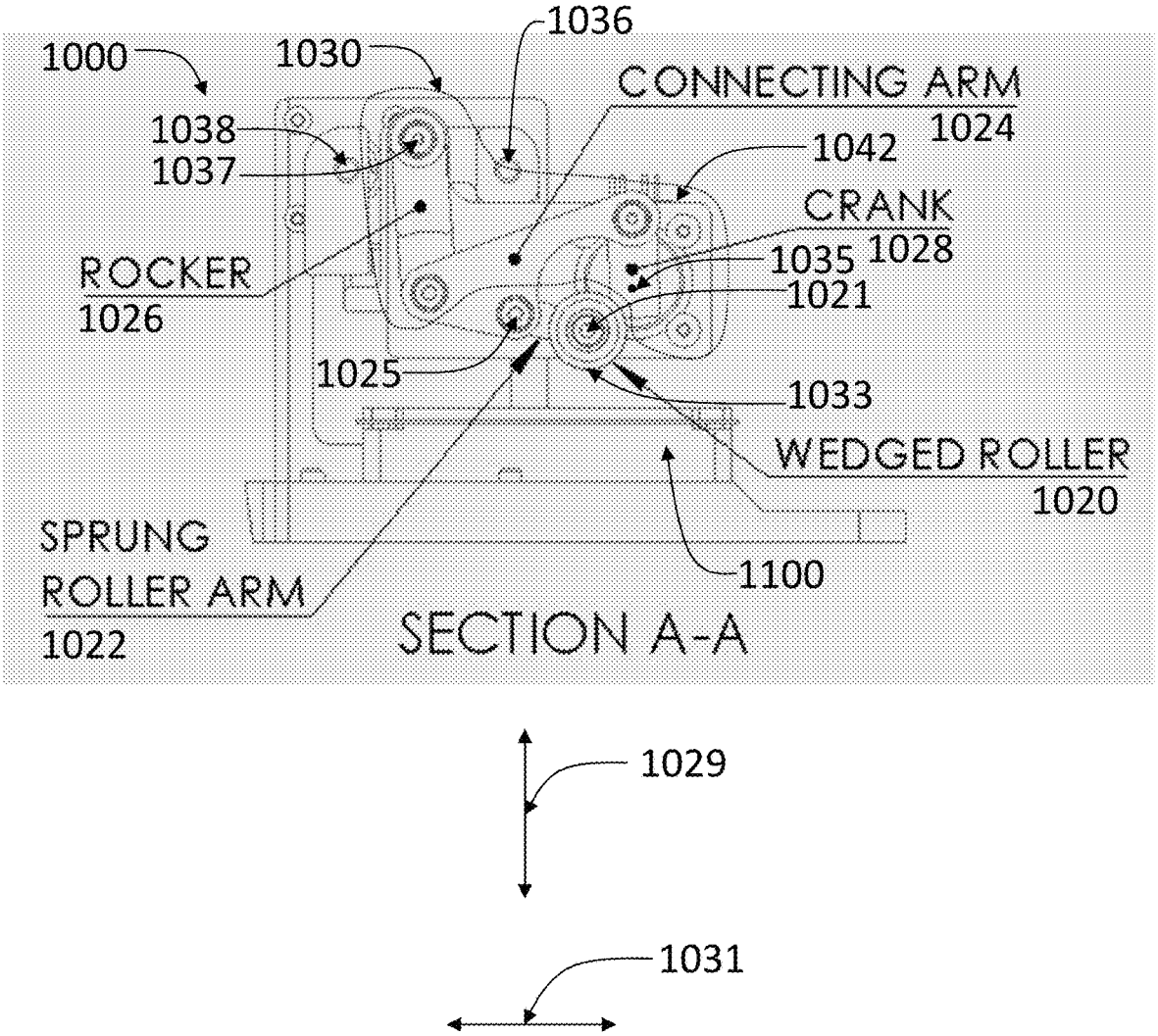
Figure 7C:
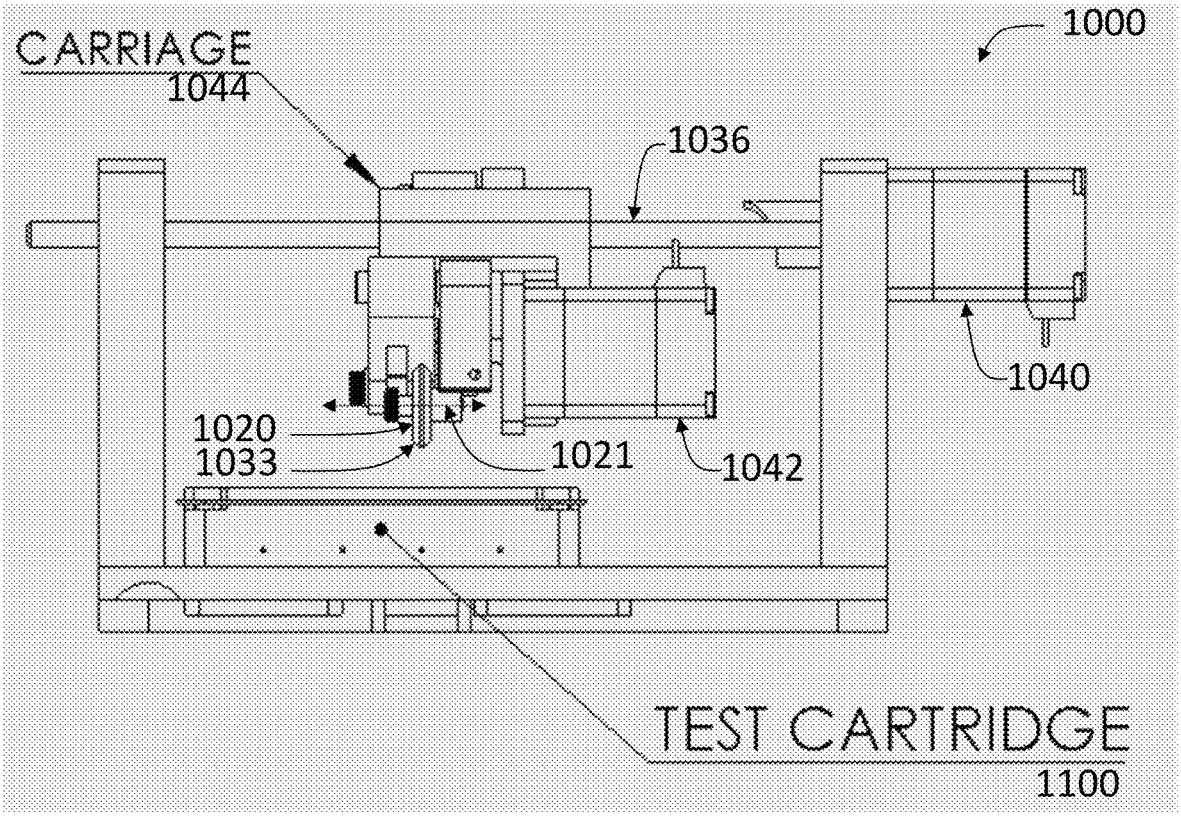
Figure 7D:
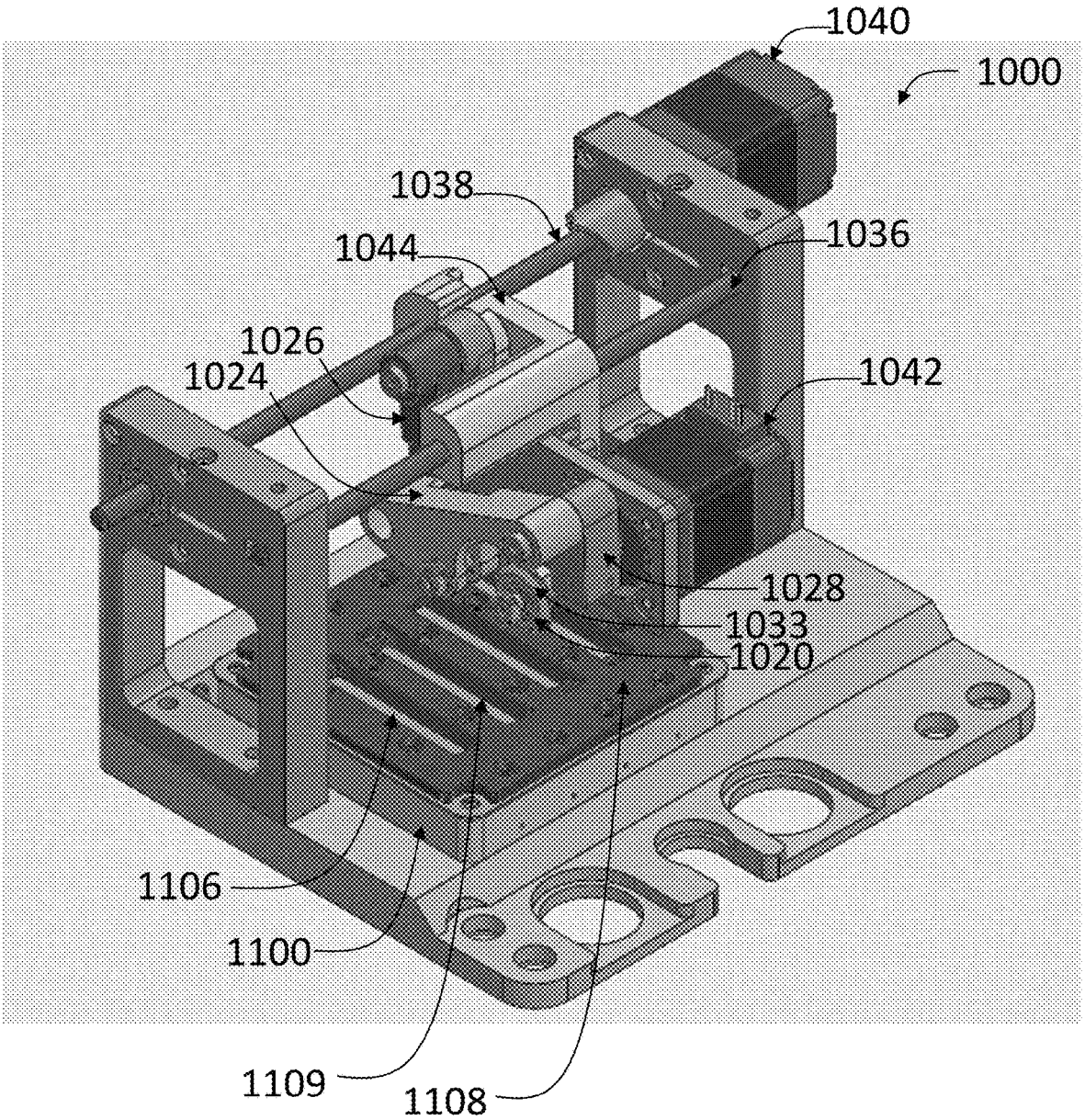
Figure 7E:
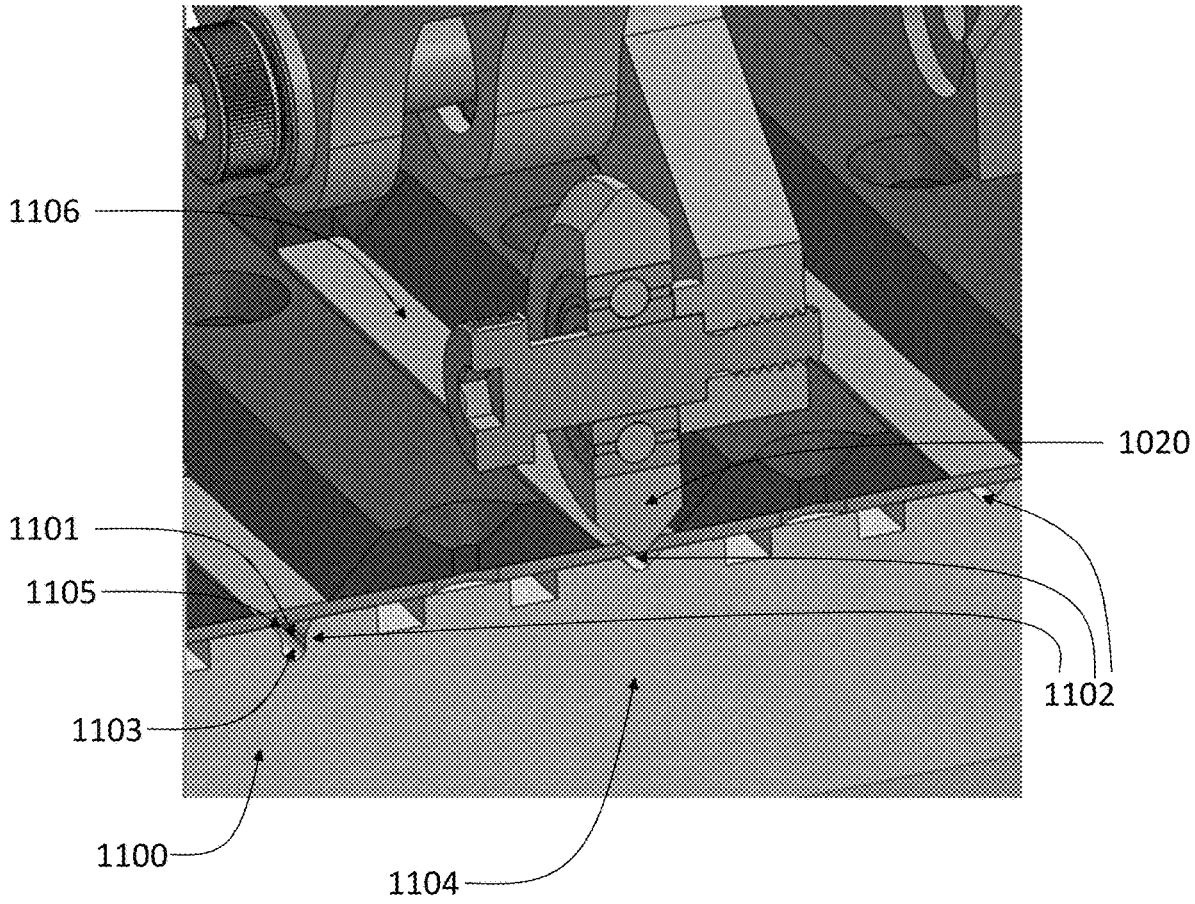
Figure 7F:
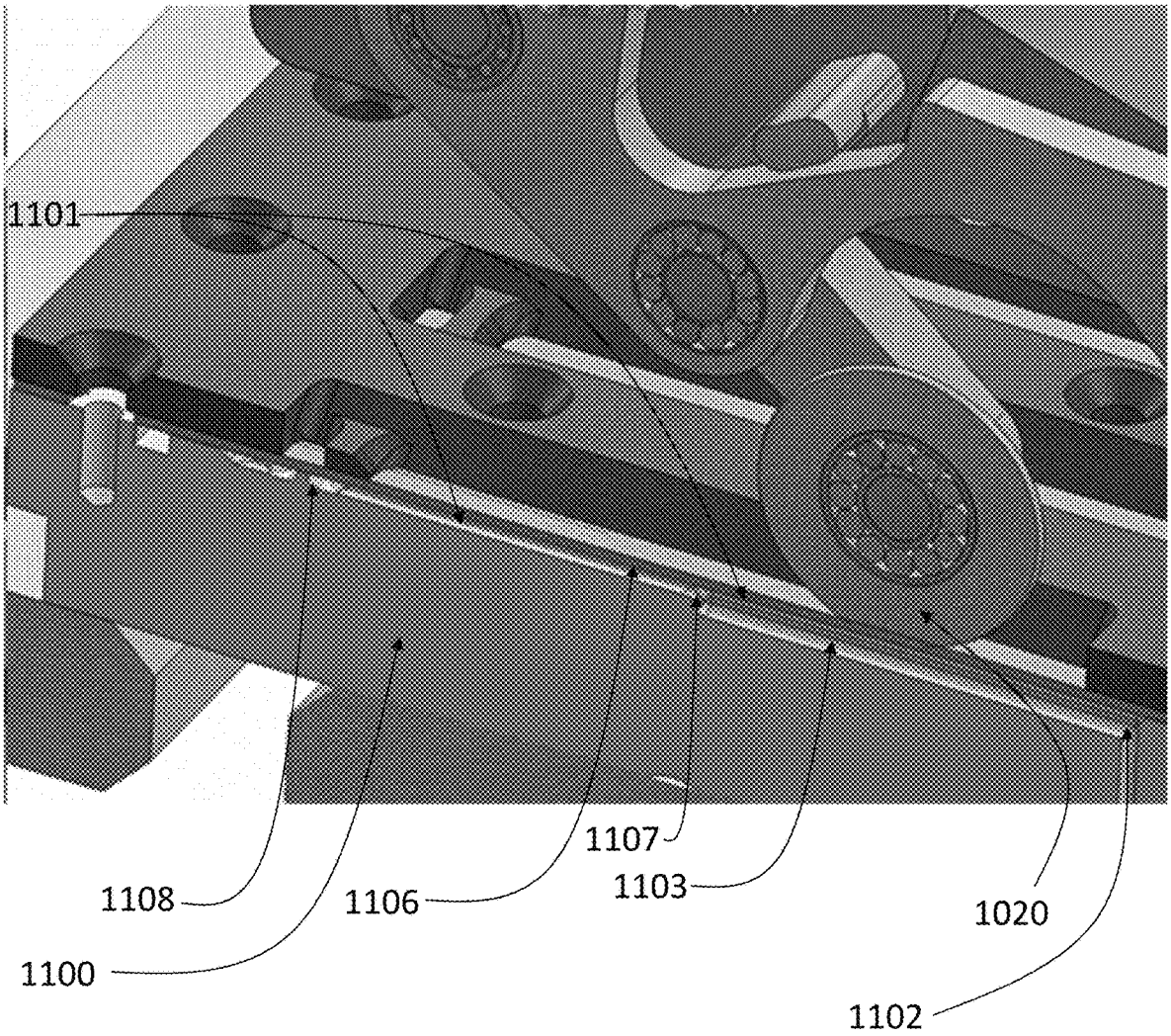

In the figures:

FIG. 1A is a schematic diagram of a pump and a downstream module, in accordance with some embodiments;

FIG. 1B is a schematic diagram of a pump, a downstream module, an optional reservoir, an optional gel, and an optional loading module, in accordance with some embodiments;

FIG. 2A is a schematic diagram of a side view of an apparatus 200, in accordance with some embodiments;

FIG. 2B is a schematic diagram of a cross-section view of a roller 220 in-plane with axis of rotation 221, in accordance with some embodiments;

FIG. 3A is a schematic diagram of a cross-section view of a cartridge 100 along the width of channels 102, in accordance with some embodiments;

FIG. 3B is a series of cross-sectional schematic diagrams of a peristaltic pump 300 along the length of a channel 102 in-plane with the base of channel 102, depicting a method 400 progressing incrementally from the top diagram to the bottom diagram, in accordance with some embodiments;

FIG. 3C is a cross-sectional schematic diagram of a peristaltic pump 300 along the width of a channel 102 in-plane with the base of channel 102, in accordance with some embodiments;

FIG. 4A is a flow diagram illustrating methods 500 of manufacturing an apparatus, device, or system, in accordance with some embodiments;

FIG. 4B is a flow diagram illustrating methods 550 of using an apparatus, device, or system, in accordance with some embodiments;

FIG. 4C is a flow diagram illustrating methods 600 of manufacturing a cartridge, device, or system, in accordance with some embodiments;

FIG. 4D is a flow diagram illustrating methods 650 of using a cartridge, device, or system, in accordance with some embodiments;

FIG. 5 depicts a cutaway perspective view of a portion of an integrated device, in accordance with some embodiments;

FIG. 6A is a block diagram depiction of an analytical instrument that includes a compact mode-locked laser module, in accordance with some embodiments;

FIG. 6B depicts a compact mode-locked laser module incorporated into an analytical instrument, in accordance with some embodiments;

FIG. 6C depicts a train of optical pulses, in accordance with some embodiments;

FIG. 6D depicts an example of parallel reaction chambers that can be excited optically by a pulsed laser via one or more waveguides and further shows corresponding detectors for each chamber, in accordance with some embodiments;

FIG. 6E illustrates optical excitation of a reaction chamber from a waveguide, in accordance with some embodiments;

FIG. 6F depicts further details of an integrated reaction chamber, optical waveguide, and time-binning photodetector in accordance with some embodiments;

FIG. 6G depicts an example of a biological reaction that can occur within a reaction chamber, in accordance with some embodiments;

FIG. 6H depicts emission probability curves for two different fluorophores having different decay characteristics, in accordance with some embodiments;

FIG. 6I depicts time-binning detection of fluorescent emission, according to some embodiments;

FIG. 6J depicts a time-binning photodetector, in accordance with some embodiments;

FIG. 6K depicts pulsed excitation and time-binned detection of fluorescent emission from a reaction chamber, in accordance with some embodiments;

FIG. 6L depicts a histogram of accumulated fluorescent photon counts in various time bins after repeated pulsed excitation of an analyte, in accordance with some embodiments;

FIG. 6M-6P depict different histograms that may correspond to the four nucleotides (T, A, C, G) or nucleotide analogs, in accordance with some embodiments;

FIG. 7A is a top-view schematic diagram of an apparatus 1000 and cartridge 1100 forming a peristaltic pump, in accordance with some embodiments;

FIG. 7B is a side-view schematic diagram, viewed from section A-A of FIG. 7A in the direction of the arrows pointing to section A-A in FIG. 7A, of the apparatus 1000 and cartridge 1100 forming the peristaltic pump of FIG. 7A, in accordance with some embodiments;

FIG. 7C is another side-view schematic diagram of the apparatus 1000 and cartridge 1100 forming the peristaltic pump of FIG. 7A, in accordance with some embodiments;

FIG. 7D is a perspective-view schematic diagram of the apparatus and cartridge 1100 forming the peristaltic pump of FIG. 7A, in accordance with some embodiments;

FIG. 7E is a zoomed in perspective-view schematic diagram of the apparatus and cartridge 1100 forming the peristaltic pump of FIG. 7A, in accordance with some embodiments; and FIG. 7F is a zoomed in perspective cross sectional schematic diagram of the apparatus and cartridge 1100 forming the peristaltic pump of FIG. 7A, in accordance with some embodiments.

DETAILED DESCRIPTION

Apparatuses, cartridges, and pumps for peristaltic pumping of fluids, and associated methods, systems and devices are generally described. The pumping of fluids is, in certain cases, an important aspect of a variety of applications, such as bioanalytical applications (e.g., biological sample analysis, sequencing, identification). The inventive features described herein may, in some embodiments, provide an ability to pump fluids in ways that combine certain advantages of robotic fluid handling systems (e.g., automation, programmability, configurability, flexibility) with certain advantages of microfluidics (e.g., small fluid volumes with high fluid resolution, precision, monolithic consumables, limiting of the wetting of components to consumables).

Some aspects relate to inventive configurations of pumps and apparatuses that include a roller (e.g., in combination with a crank-and-rocker mechanism). Other aspects relate to inventive cartridges comprising channels (e.g., microchannels) having inventive cross-sectional shapes (e.g., substantially triangular shapes), valving, deep sections, and/or surface layers (e.g., flat elastomer membranes). Certain aspects relate to a decoupling of certain components of the peristaltic pump (e.g., the roller) from other components of the pump (e.g., pumping lanes). In some cases, certain elements of apparatuses (e.g., edges of the roller) are configured to interact with elements of the cartridge (e.g., surface layers and certain shapes of the channels) in such a way (e.g., via engagement and disengagement) that any of a variety of advantages are achieved. In some non-limiting embodiments, certain inventive features and configurations of the apparatuses, cartridges, and pumps described herein contribute to improved automation of the fluid pumping process (e.g., due to the use of a translatable roller and a separate cartridge containing multiple different fluidic channels that can be indexed by the roller). In some cases, inventive features described herein contribute to an ability to handle a relatively high number of different fluids (e.g., for multiplexing with multiple samples) with a relatively high number of configurations using a relatively small number of hardware components (e.g., due to the use of separate cartridges with multiple different channels, each of which may be accessible to the roller). As one example, in some cases, the inventive features described herein allow for more than one apparatus to be paired with a cartridge to pump more than one lane simultaneously or use two pumps in one lane for other functionality. In some cases, the inventive features contribute to a reduction in required fluid volume and/or less stringent tolerances in roller/channel interactions (e.g., due to inventive cross-sectional shapes of the channels and/or the edge of the roller, and/or due to the use of inventive valving and/or deep sections of channels). In some cases, inventive features described herein result in a reduction in required washing of hardware components (e.g., due to a decoupling of an apparatus and a cartridge of the peristaltic pump). In some embodiments, aspects of the apparatuses, cartridges, and pumps described herein are useful for preparing samples. For example, some such aspects may be incorporated into a sample preparation module upstream of a detection module (e.g., for analysis/sequencing/identification of biologically-derived samples).

In some embodiments, a system (e.g., an apparatus, cartridge, device, and/or pump) is provided. In certain embodiments, a system described herein is suitable for a microfluidics application. In certain embodiments, the system is suitable for a sample preparation application. In certain embodiments, a system described herein is suitable for a diagnostics application. In certain embodiments, a system described herein is suitable for nucleic acid sequencing, genome sequencing, and/or nucleic acid molecule (e.g., deoxyribonucleic acid (DNA) molecule) identification. In certain embodiments, a system described herein is suitable for peptide sequencing, protein sequencing, peptide molecule identification, and/or protein molecule identification. The configuration of a system may depend on the desired application (e.g., sample preparation, nucleic acid sequencing, peptide sequencing, diagnostic applications). For example, in some, but not necessarily all cases, different reagents and/or sample volumes may be used depending on whether the system is configured for nucleic acid sequencing or for protein sequencing. In some such cases, difference in reagents and/or sample volumes may affect the dimensions of one or more components of the system, such as the volume of channels in a cartridge, or the volume of reservoirs (e.g., reagent reservoirs).

As mentioned above, in certain embodiments, systems (e.g., comprising apparatuses, cartridges, pumps, devices, modules) herein are configured for microfluidic application(s), sample preparation application(s), and/or diagnostics application(s). For example, in some embodiments, a device (e.g., apparatus, cartridge, peristaltic pump) can be used for sample preparation. FIG. 1A is a schematic illustration of an exemplary system 2000 that incorporates a device (e.g., apparatus, cartridge, peristaltic pump) described herein, according to some embodiments. Exemplary system 2000 can be used for detecting one or more components of a sample, according to some embodiments. In some embodiments, system 2000 comprises a sample preparation module 1700. In some embodiments, system 2000 comprises both sample preparation module 1700 and detection module 1800 downstream of sample preparation module 1700. Exemplary features and associated methods of sample preparation modules and detection modules are described in more detail below. Sample preparation module 1700 and detection module 1800 are configured such that at least a portion of a sample, after being prepared, can be transported (e.g., flowed) from sample preparation module 1700 to detection module 1800 (either directly or indirectly) where the sample is detected (e.g., analyzed, sequenced, identified, etc.), according to certain embodiments.

In some embodiments, the sample preparation module comprises a pump. Referring again to FIG. 1A, in some embodiments, sample preparation module 1700 comprises an exemplary pump 1400. In some embodiments, the pump is peristaltic pump. Some such pumps comprise one or more of the inventive components for fluid handling described herein. For example, the pump may comprise an apparatus and/or a cartridge. As one example, in FIG. 1A, exemplary pump 1400 comprises apparatus 1200 and cartridge 1300, according to some embodiments. In some embodiments, the apparatus of the pump comprises a roller, a crank, and a rocker, for example as shown in FIG. 2A and described in more detail below. In some such embodiments, the crank and the rocker are configured as a crank-and-rocker mechanism that is connected to the roller. The coupling of a crank-and-rocker mechanism with the roller of an apparatus can, in some cases, allow for certain of the advantages describe herein to be achieved (e.g., facile disengagement of the apparatus from the cartridge, well-metered stroke volumes). In certain embodiments, the cartridge of the pump comprises channels (e.g., microfluidic channels). In some embodiments, at least a portion of the channels of the cartridge have certain cross-sectional shapes and/or surface layers that may contribute to any of a number of advantages described herein, as shown in FIG. 3A and described in more detail below. It should be understood that the system shown in FIG. 1A is exemplary, and other configurations and uses for the devices (e.g., apparatus, cartridge, pump) are possible.

The inventors herein have appreciated that conventional systems of pumping fluids on a microfluidic scale (e.g., syringe pumps, air pressure pumps, positive displacement pumping mechanisms, conventional peristaltic pumps, pipetting robots) have limitations. For example, conventional systems of pumping fluids may require all hardware components to be associated with each sample simultaneously, which may hinder miniaturization of devices comprising the conventional system(s). As another example, conventional systems of pumping fluids may require large rinsing volumes and therefore long rinsing times of the system in between samples, which may decrease throughput of sample(s) through devices comprising the conventional system(s).

In certain embodiments, apparatuses herein have no wetted components, advantageously eliminating the need to rinse those components. For example, an apparatus (e.g., apparatus 1200 in FIG. 1A) herein may be paired with a cartridge (e.g., cartridge 1300 in FIG. 1A) herein, which cartridge comprises channels containing fluid in which the walls, base, and/or surface of the channels are wetted, whereas the apparatus interfaces with the cartridge at non-wetted portion(s) of the cartridge, according to certain embodiments.

In certain embodiments, apparatuses herein provide flexibility for the user, allowing for the apparatus to interface with a variety of cartridges space and to interface with a variety of channels in cartridge(s), which advantageously eliminates the requirement for all hardware components to be associated with each sample simultaneously. For example, cartridges may be moved to different locations at different times for the convenience of the user and/or increased throughput of samples. For instance, one cartridge may be switched out for another in the apparatus, or moved to another portion of the apparatus. For example, in some embodiments, the cartridge is a first cartridge, and the first cartridge can be removed and replaced by a second cartridge. As another example, an apparatus herein may accept one or more cartridges at a time, and at least a portion of the apparatus may be easily moved (e.g., by means of a carriage) to different locations within a cartridge or from one cartridge to another. The cartridges generally comprise solid articles comprising channels that can, in certain embodiments, serve as "pumping lanes" through which fluids can be transported during a peristaltic pumping process involving the apparatus. Interfacing between components of the apparatus (e.g., a roller) and the cartridge may cause the fluid to pass through the channels. In some such cases, the roller interacts by physically contacting and applying a force to one or more components of the cartridge (e.g., a surface layer) when the cartridge is associated with the pump and with the fluid (e.g., fluid sample). Additionally, in some embodiments, the cartridge may act as a "consumable" that can be removed from the system and/or disposed of following one or more uses in conjunction with the peristaltic pump.

One non-limiting aspect of some cartridges that may, in some cases, provide certain benefits is the inclusion of channels having certain cross-sectional shapes in the cartridges. For example, in some embodiments, the cartridge comprises v-shaped channels. One potentially convenient but non-limiting way to form such v-shaped channels is by molding or machining v-shaped grooves into the cartridge. The Inventors have recognized advantages of including a v-shaped channel (also referred to herein as a v-groove or a channel having a substantially triangularly-shaped cross-section) in certain embodiments in which a roller of the apparatus engages with the cartridge to cause fluid flow through the channels. For example, in some instances, a v-shaped channel is dimensionally insensitive to the roller. In other words, in some instances, there is no single dimension to which the roller (e.g., a wedge shaped roller) of the apparatus must adhere in order to suitably engage with the v-shaped channel. In contrast, certain conventional cross sectional shapes of the channels, such as semi-circular, may require that the roller have a certain dimension (e.g., radius) in order to suitably engage with the channel (e.g., to create a fluidic seal to cause a pressure differential in a peristaltic pumping process). In some embodiments, the inclusion of channels that are dimensionally insensitive to rollers can result in simpler and less expensive fabrication of hardware components and increased configurability/flexibility.

In certain aspects, the Inventors have recognized the advantages of having a portion of the cartridges comprise a surface layer (e.g., a flat surface layer). One exemplary aspect relates to potentially advantageous embodiments involving layering a membrane (also referred to herein as a surface layer) comprising (e.g., consisting essentially of) an elastomer (e.g., silicone) above the v-groove, to produce, in effect, half of a flexible tube. FIG. 3A depicts an exemplary cartridge 100 according to certain such embodiments, and is described in more detail below. Then, the Inventors have determined that, in some embodiments, by deforming the surface layer comprising an elastomer into the channel to form a pinch and by then translating the pinch, negative pressure can be generated on the trailing edge of the pinch which creates suction and positive pressure can be generated on the leading edge of the pinch, pumping fluid in the direction of the leading edge of the pinch. In certain embodiments, the Inventors have accomplished this pumping by interfacing a cartridge (comprising channels having a surface layer) with an apparatus comprising a roller, which apparatus is configured to carry out a motion of the roller that includes engaging the roller with a portion of the surface layer to pinch the portion of the surface layer with the walls and/or base of the associated channel, translating the roller along the walls and/or base of the associated channel in a rolling motion to translate the pinch of the surface layer against the walls and/or base, and/or disengaging the roller with a second portion of the surface layer. In certain embodiments, the Inventors have incorporated a crank-and-rocker mechanism into the apparatus to carry out this motion of the roller.

A conventional peristaltic pump generally involves tubing having been inserted into an apparatus comprising rollers on a rotating carriage, such that the tubing is always engaged with the remainder of the apparatus as the pump functions. By contrast, in certain embodiments, channels in cartridges herein are linear or comprise at least one linear portion, such that the roller engages with a horizontal surface. In certain embodiments, the roller is connected to a small roller arm that is spring-loaded so that the roller can track the horizontal surface while continuously pinching a portion of the surface layer. Spring loading the apparatus (e.g., a roller arm of the apparatus) can in some cases help regulate the force applied by the apparatus (e.g., roller) to the surface layer and a channel of a cartridge.

In certain embodiments, each rotation of the crank in a crank-and-rocker mechanism connected to the roller provides a discrete pumping volume. In certain embodiments, it is straightforward to park the apparatus in a disengaged position, where the roller is disengaged from any cartridge. In certain embodiments, forward and backward pumping motions are fairly symmetrical as provided by apparatuses described herein, such that a similar amount of force (torque) (e.g., within 10%) is required for forward and backward pumping motions.

In certain embodiments, it may be advantageous to, for a particular size of apparatus, have a relatively high crank radius (e.g., greater than or equal to 2 mm, optionally including associated linkages). Consequently, it may, in certain embodiments, also be advantageous to have a relatively high stroke length (e.g., greater than or equal to 10 mm) to engage with an associated cartridge. Having relatively high crank radius and stroke length, in certain embodiments, ensures no mechanical interference between the apparatus and the cartridge when moving components of the apparatus relative to the cartridge.

While there are many mechanical linkages combinations that could potentially be used to achieve different specific kinds of motion, the Inventors have found that a crank-and-rocker mechanism advantageously provides the ability to engage and disengage with an associated cartridge. FIG. 2A depicts a schematic illustration of one exemplary such apparatus 200 comprising a roller 220, a crank 228, and a rocker 226, according to some embodiments, and is described in more detail below.

The Inventors have recognized that, in certain embodiments, having v-shaped grooves advantageously allows for utilization with rollers of a variety of sizes having a wedge-shaped edge. By contrast, for example, having a rectangular channel rather than a v-groove results in the width of the roller associated with the rectangular channel needing to be more controlled and precise in relation to the width of the rectangular channel, and results in the forces being applied to the rectangular channel needing to be more precise. Similarly, the channel(s) having a semicircular cross-section may also require more controlled and precise dimension for the width of the associated roller.

In certain embodiments, an apparatus described herein may comprise a multi-axis system (e.g., robot) configured so as to move at least a portion of the apparatus in a plurality of dimensions (e.g., two dimensions, three dimensions). For example, the multi-axis system may be configured so as to move at least a portion of the apparatus to any pumping lane location among associated cartridge(s). For example, in certain embodiments, a carriage herein may be functionally connected to a multi-axis system. In certain embodiments, a roller may be indirectly functionally connected to a multi-axis system. In certain embodiments, an apparatus portion, comprising a crank-and-rocker mechanism connected to a roller, may be functionally connected to a multi-axis system. In certain embodiments, each pumping lane may be addressed by location and accessed by an apparatus described herein using a multi-axis system.

The detection module (e.g., detection module 1800 in FIG. 1A) may be configured to perform any of the variety of abovementioned applications (e.g., bioanalytical applications such as analysis, nucleic acid sequencing, genome sequencing, peptide sequencing, analyte identification, diagnosis). For example, in some embodiments, the detection module comprises an analysis module. The analysis module may be configured to analyze a sample prepared by the sample preparation module. The analysis module may be configured, for example, to determine a concentration of one or more components in a fluid sample. In some embodiments, the detection module comprises a sequencing module. As an example, referring again to FIG. 1A, detection module 1800 comprises a sequencing module, according to some embodiments. The sequencing module may be configured to perform sequencing of one or more components of a sample prepared by the sample preparation module. Exemplary types of sequencing are described in more detail below. In some embodiments, the sequencing comprises nucleic acid sequencing. The sequencing may comprise deoxyribonucleic acid (DNA) sequencing. The sequencing may comprise genome sequencing. In some embodiments, the sequencing comprises peptide sequencing. For example, the sequencing may comprise protein sequencing. In some embodiments, the detection module comprises an identification module. The identification module may be configured to identify one or more components of a sample prepared by the sample preparation module. For example, the identification module may be configured to identify nucleic acid molecules (e.g., DNA molecules). In some embodiments, the identification module is configured to identify peptide molecules (e.g., protein molecules).

It should be understood that while FIG. 1A depicts shows separate sample preparation module 1700 and detection module 1800 (e.g., analysis module, sequencing module, identification module), the sample preparation module itself (e.g., comprising a peristaltic pump, apparatus, cartridge) may, in some cases, be capable of performing analysis, sequencing, or identification processes. In some embodiments, the sample module is capable of performing a combination of analysis, sequencing, and/or identification processes. For example, in some embodiments, the pump (e.g., pump 1400) may be configured and/or used to deliver certain volumes (e.g., relatively small volumes, such as less than or equal to 10 μL per pump cycle) of sample (e.g., in sequence and/or at a certain flow rate) directly or indirectly to an integrated detector (e.g., an optical or electrical detector). The integrated detector may be used to make measurements for performing any of a variety of applications (e.g., analysis, sequencing, identification, diagnostics). As such, in certain embodiments, a sample (e.g., comprising a nucleic acid, a peptide, a protein, bodily tissue, a bodily secretion) prepared by a system described herein can be sequenced/analyzed using any suitable machine (e.g., a different module, or the same module). In certain embodiments, it may be advantageous to have a module described herein for sample preparation and a separate machine for detecting (e.g., sequencing) at least some of (e.g., all of) the samples prepared by the system, e.g., so that the machine may be used with minimal downtime (e.g., continuously) for detection (e.g., sequencing) of samples. In some embodiments, a module for sample preparation (e.g., sample preparation module 1700) may be fluidically connected with a machine (e.g., detection module 1800) for detecting (e.g., sequencing) at least some of (e.g., all of) the samples prepared by the system. In certain embodiments, a system described herein for sample preparation may be fluidically connected with a diagnostic instrument for analyzing at least some of (e.g., all of) the samples prepared by the system. In certain embodiments, the diagnostic instrument generates an output based on the presence or absence of a band or color based on the underlying sequence of a sample. It should be understood that when components (e.g., modules, devices) are described as being connected (e.g., functionally connected), the connections may be permanently connected, or the connections may be reversibly connected. In some instances, components being described as being connected are decoupleably connected, in that they may be connected (e.g., with a fluidic connection via, for example, a channel, tube, conduit) during a first period of time, but then during a second period of time, they may not be connected (e.g., by decoupling the fluidic connection). In some such embodiments, reversible/decoupleable connections may provide for modular systems in which certain components can be replaced or reconfigured, depending on the type of sample preparation/analysis/sequencing/identification being performed.

Applications for systems and devices described herein include but are not limited to biological assays or preparations that involve samples of small volume. In some embodiments, a device described herein is well suited to the transport of sample volumes down to a few tens of microliters fluid flow resolution with little loss. In some embodiments, at least because there are no wetted (e.g., or otherwise exposed through air or gas) components of at least a portion (e.g., a portion of the system that comprises a roller connected with a crank-and-rocker mechanism) of a system described herein, there may advantageously be little opportunity for run-to-run cross contamination. In some embodiments, reagent utilization is also decreased, at least due to small channel dimensions, which facilitates using relatively small total volumes for reagents that may easily be packed into a single-use disposable cartridge. In some embodiments, additionally, continuous re-circulation of sample and/or reagent may be possible with peristalsis, and applications involving mixing or agitation may easily be translated into such a format. Considering these capabilities, non-limiting examples of applications for systems described herein include polymerase chain reaction (PCR), cell culturing, emulsion-based assays, array-based diagnostics, and/or reagent multiplexing for sequencing reactions.

In some embodiments, the front-end of a diagnostic process may involve DNA capture and purification from a source, such as a cell culture, blood, or blood lysate. It should be understood that DNA capture and sequencing is used throughout the instant disclosure as an exemplary application of the inventive aspects described herein (e.g., involving inventive devices and methods for pumping fluids and related applications) solely for the sake of clarity, and not to indicate any limitation of how the inventive features may be applied. Instead, it should be understood that when DNA sequencing applications are described in conjunction with the systems and devices described herein, any of a variety of other analyses or sequencing (e.g., genome sequencing, protein sequencing, analyte identification, etc.), using any of a variety of machines for detection are also contemplated and possible. Referring again to the exemplary embodiment involving DNA capture as part of a front-end of a diagnostic process, the capture process may involve movement of sample solution over a capture surface, and/or subsequent washing and elution steps. In some embodiments, at least some of the steps of the DNA capture and purification, the movement of sample solution over the capture surface, and/or the subsequent washing and elution steps would be fluidic operations handled by a system (e.g., device, apparatus, peristaltic pump) described herein, involving, e.g., between or equal to 5 and 10 pumping lanes. The eluted DNA sample may then be transferred into an aqueous well of a gel-based detection system, which transfer would also be performed by a system described herein. In some embodiments, the DNA capture may be performed in another gel system. In some embodiments, the transfer of the DNA sample and washing of the aqueous well involves pumped fluid transport using a system described herein.

In some embodiments, the front-end of a diagnostic process may involve peptide (e.g., protein) capture and purification from a source, such as a cell culture, blood, or blood lysate. Purification may involve sample lysis, enrichment, fragmentation, and/or functionalization. The capture process may involve movement of sample solution over a capture surface (e.g., comprising a peptide capture probe), and/or subsequent washing and elution steps. In some embodiments, at least some of the steps of the capture and purification, the movement of sample solution over the capture surface, and/or the subsequent washing and elution steps would be fluidic operations handled by a system (e.g., device, apparatus, peristaltic pump) described herein, involving, e.g., between or equal to 5 and 10 pumping lanes. The purified and/or functionalized peptides (e.g., proteins) of the sample may then be transferred to and immobilized on a surface of a detection system (e.g., via iterative terminal amino acid detection and cleavage) which transfer would also be performed by a system described herein.

Some applications may require a very large number of pump lanes to handle multiple samples individually (e.g., through discrete, non-connected channels), and/or may require a large number of reagents. In some such cases, the added cost and complexity of a system configured with additional translator axes may be warranted. For example, in some embodiments, a system configured for x and y motion of a carriage would allow access to a matrix of pumping lanes. In some embodiments, a system configured for an additional axis for rotating the carriage in the z-axis would permit even more freedom, in that lanes of arbitrary angular orientation (e.g., to minimize channel length and/or allow more efficient geometrical packing) would be accessible.

In some embodiments, a system (e.g., apparatus, pump, device) comprising more than one apparatus portion (e.g., two portions), each of which apparatus portions comprises a roller connected to a crank-and-rocker mechanism, could be advantageous for a number of reasons. For example, having a system comprise more than one apparatus portion comprising a roller connected to a crank-and-rocker mechanism may facilitate parallelizing operations, for instance in cases involving handling multiple discrete samples. As another example, simultaneous push-pull of reagent or sample could be enacted with two rollers per pumping lane. In this push-pull scenario, in one operation, one apparatus portion comprising a roller connected to a crank-and-rocker mechanism may drive an input reagent into a common channel, while in another operation, a second synchronized apparatus portion comprising a roller connected to a crank-and-rocker mechanism simultaneously draws the input reagent from the common channel and drives the input reagent out of a specific output channel. In this way, a multiplexer-demultiplexer system may be facilitated without a time lag or a required holding-volume, each of which would otherwise have been associated with performing those operations in two sequenced steps.

As used herein, a "demultiplexer" is a device that takes a single input channel and drives at least a portion of its contents to one of several output channels. For example, the contents may comprise a fluid, a sample, and/or a reagent.

As used herein, a "multiplexer" is a device that selects between a plurality of input channels and drives at least a portion of the chosen input channel's contents to a single output channel. For example, the contents may comprise a fluid, a sample, and/or a reagent.

It should be understood that while FIG. 1A shows a single pump 1400 in sample preparation module 1700, sample preparation module 1700 may comprise multiple pumps 1400. In some embodiments, the sample preparation module comprises at least 1, at least 2, at least 3, at least 4, at least 5, or more peristaltic pumps as described herein. In some embodiments in which multiple pumps are present in the sample preparation module, the pumps may be configured to be in series (e.g., where a fluid is sequential transported from a first pump to a second pump) and/or in parallel (e.g., where a first fluid pumped from a first pump and a second fluid pumped from a second pump are combined downstream of the first and second pump). The inclusion of multiple peristaltic pumps may, in some cases, allow for sample preparation to be easily scaled up, or for complex sample preparation procedures and multiplexed applications to be achieved with a relative simple system comprising a relatively low number of components (e.g., motors).

It should also be understood that while FIG. 1A shows pump 1400 comprising a single apparatus 1200, pump 1400 may comprise multiple apparatuses 1200. In some embodiments, pump 1400 comprises at least 1, at least 2, at least 3, at least 4, at least 5, or more apparatuses as described herein. The inclusion of multiple apparatuses (e.g., each comprising a roller and optionally a crank and rocker) may, in some cases, allow any of a variety of advantages. For example, the inclusion of multiple apparatuses may provide for an ability to pump fluid from multiple channels of a single cartridge simultaneously (or during different periods of time), which can, in some instances, increase the degree of configurability of sample preparation processes, and allow for potentially complicated sample preparation procedures to be performed quickly and conveniently.

In certain embodiments, devices (e.g., apparatuses, cartridges, pumps) herein are configured to transport small volume(s) of fluid precisely with a well-defined fluid flow resolution, and with a well-defined flow rate in some cases. In some embodiments, devices (e.g., apparatuses, cartridges, pumps) herein are configured to transport fluid at a flow rate of greater than or equal to 0.1 μL/s, greater than or equal to 0.5 μL/s, greater than or equal to 1 μL/s, greater than or equal to 2 μL/s, greater than or equal to 5 μL/s, or higher. In some embodiments, devices herein are configured to transport fluid at a flow rate of less than or equal to 100 μL/s, less than or equal to 75 μL/s, less than or equal to 50 μL/s, less than or equal to 30 μL/s, less than or equal to 20 μL/s, less than or equal to 15 μL/s, or less. Combinations of these ranges are possible. For example, in some embodiments, devices herein are configured to transport fluid at a flow rate of greater than or equal to 0.1 μL/s and less than or equal to 100 μL/s, or greater than or equal to 5 μL/s and less than or equal to 15 μL/s. For example, in certain embodiments, systems and devices herein have a fluid flow resolution on the order of tens of microliters or hundreds of microliters. Further description of fluid flow resolution is described elsewhere herein. In certain embodiments, systems and devices here in are configured to transport small volumes of fluid through at least a portion of a cartridge.

Further detail of features, components, and methods described herein, as well as exemplary embodiments related to the systems and devices (e.g., apparatuses, cartridges, pumps) are now provided in greater detail.

In one aspect, apparatuses are provided. In some embodiments, an apparatus comprises a roller, and a crank-and-rocker mechanism connected to the roller by a connecting arm. In some embodiments, an apparatus comprises a roller, a crank, a rocker, and a connecting arm configured so as to join the crank to the rocker and the roller. Embodiments of apparatuses are further described elsewhere herein.

In another aspect, cartridges are provided. In some embodiments, a cartridge comprises a base layer having a surface comprising channels, and at least a portion of at least some of the channels (1) have a substantially triangularly-shaped cross-section having a single vertex at a base of the channel and having two other vertices at the surface of the base layer, and (2) have a surface layer, comprising an elastomer, configured to substantially seal off a surface opening of the channel. Embodiments of cartridges are further described elsewhere herein.

In another aspect, peristaltic pumps are provided. In some embodiments, a peristaltic pump comprises a roller and a cartridge, wherein the cartridge comprises a base layer having a surface comprising channels, wherein at least a portion of at least some of the channels (1) have a substantially triangularly-shaped cross-section having a single vertex at a base of the channel and having two other vertices at the surface of the base layer, and (2) have a surface layer, comprising an elastomer, configured to substantially seal off a surface opening of the channel. Embodiments of peristaltic pumps are further described elsewhere herein.

In another aspect, methods of making an apparatus are provided. In some embodiments, a method of making an apparatus comprises connecting a crank arm, a rocker arm, and a roller to a connecting arm, and connecting a shaft of the rocker arm to a shaft of the crank arm such that the axis of rotation of the rocker shaft is held stationary relative to the axis of rotation of the crank shaft. Embodiments of methods of making an apparatus are further described elsewhere herein.

In another aspect, methods of making a cartridge are provided. In some embodiments, a method of making a cartridge comprises assembling a surface article comprising a surface layer with a base layer to form the cartridge, wherein (1) the surface layer comprises an elastomer, (2) the base layer comprises one or more channels, and (3) at least some of the one or more channels have a substantially triangularly-shaped cross-section. Embodiments of methods of making a cartridge are further described elsewhere herein.

In another aspect, methods of making a pump are provided. In some embodiments, a method of making a pump comprises assembling a surface article comprising a surface layer with a base layer to form a cartridge, assembling an apparatus comprising a roller, and positioning the cartridge below the roller, wherein (1) the surface layer comprises an elastomer, (2) the base layer comprises one or more channels, and (3) at least some of the one or more channels have a substantially triangularly-shaped cross-section. Embodiments of methods of making a pump are further described elsewhere herein.

In another aspect, methods of using a system (e.g., apparatus, pump, and/or device) are provided. In some embodiments, a method of using a system comprises rotating the crank of an apparatus described herein such that a roller engages with and/or disengages from a substrate surface. In certain embodiments, the roller is connected to the crank. For example, in certain embodiments, the roller is indirectly connected to the crank. In some embodiments, a method of using a system comprises deforming a first portion of a surface layer comprising an elastomer into a channel containing a fluid, such that an inner surface of the first portion of the surface layer contacts a first portion of walls and/or a base of the channel proximal to the inner surface of the first portion of the surface layer, and translating this deformation to a second portion of the surface layer such that an inner surface of the second portion of the surface layer contacts a second portion of the walls and/or base of the channel proximal to the inner surface of the second portion of the surface layer, wherein the surface layer is configured to seal off a surface opening of the channel. Embodiments of methods of using a system are further described elsewhere herein.

In another aspect, apparatuses are provided, where the apparatuses are for performing a least one of the following on a sample: preparing the sample for analysis, analyzing the sample, and sequencing at least a portion of the sample. In some embodiments, the apparatus comprises a roller and a crack-and-rocker mechanism connected to the roller. In some embodiments, the sequencing is nucleic acid sequencing (e.g., deoxyribonucleic acid (DNA) sequencing, genome sequencing). In some embodiments the sequencing is peptide (e.g., protein) molecule sequencing.

In another aspect, methods are provided, where the methods comprise using apparatuses to perform a least one of the following on a sample: preparing the sample for analysis, analyzing the sample, and sequencing at least a portion of the sample. In some embodiments, the apparatus comprises a roller and a crack-and-rocker mechanism connected to the roller. In some embodiments, the sequencing is nucleic acid sequencing (e.g., deoxyribonucleic acid (DNA) sequencing, genome sequencing). In some embodiments the sequencing is peptide (e.g., protein) molecule sequencing.

In another aspect, systems are provided. In some embodiments, a system comprises a sample preparation module. In some embodiments, the sample preparation module comprises a peristaltic pump, as described herein. In some embodiments, the peristaltic pump comprises an apparatus comprising a roller, and the peristaltic pump also comprises a cartridge. In some embodiments, the system comprises a detection module downstream of the sample preparation module.

In some embodiments, a system comprises a sample preparation module. In some embodiments, the sample preparation module comprises a peristaltic pump, as described herein. In some embodiments, the peristaltic pump comprises an apparatus comprising a roller and a crank-and-rocker mechanism connected to the roller. In some embodiments, the system comprises a detection module downstream of the sample preparation module.

In some embodiments, a system comprises a sample preparation module. In some embodiments, the sample preparation module comprises a peristaltic pump, as described herein. In some embodiments, the peristaltic pump comprises a cartridge comprising a base layer having a surface comprising channels, wherein at least a portion of at least some of the channels have a substantially triangularly-shaped cross-section having a single vertex at a base of the channel and having two other vertices at the surface of the base layer. In some embodiments, the system comprises a detection module downstream of the sample preparation module.

In another aspect, methods are provided. In some embodiments, a method comprises flowing at least a portion of a sample from a first module to a second module using a peristaltic pump. In some embodiments, the peristaltic pump comprises an apparatus, and in some embodiments the peristaltic pump comprises a cartridge. In some such embodiments, the first module comprises a sample preparation module. In some such embodiments, the second module comprises a detection module. For example, in some embodiments, a method comprises flowing at least a portion of sample from a sample preparation module to a detection module using a peristaltic pump.

In another aspect, methods are provided. In some embodiments, a method comprises flowing at least a portion of a sample from a first module to a second using a peristaltic pump. In some embodiments, the peristaltic pump comprises an apparatus comprising a roller and a crank-and-rocker mechanism connected to the roller. In some such embodiments, the first module comprises a sample preparation module. In some such embodiments, the second module comprises a detection module. For example, in some embodiments, a method comprises flowing at least a portion of sample from a sample preparation module to a detection module using a peristaltic pump.

In another aspect, methods are provided. In some embodiments, a method comprises flowing at least a portion of a sample from a first module to a second using a peristaltic pump. In some embodiments, the peristaltic pump comprises a cartridge comprising a base layer having a surface comprising channels, wherein at least a portion of at least some of the channels have a substantially triangularly-shaped cross-section having a single vertex at a base of the channel and having two other vertices at the surface of the base layer. In some such embodiments, the first module comprises a sample preparation module. In some such embodiments, the second module comprises a detection module. For example, in some embodiments, a method comprises flowing at least a portion of sample from a sample preparation module to a detection module using a peristaltic pump.

In one aspect, apparatuses are provided. FIG. 2A is a schematic diagram of a side view of an apparatus 200, in accordance with some embodiments. It should be understood that the current disclosure is not limited to only those specific embodiments described and depicted herein. Instead, the various disclosed components, features, and methods may be arranged in any suitable combination as the disclosure is not so limited.

In some embodiments, an apparatus comprises a roller. For example, in FIG. 2A, the depicted apparatus 200 includes a roller 220. In some embodiments, a roller comprises an edge having a wedge shape. Referring again to FIG. 2A, in some embodiments, roller 220 comprises an edge (e.g., 233 of FIG. 2B), distal to an axis of rotation (e.g., 221 of FIG. 2B) of roller 220 having a wedge shape.

As used herein, the term "roller" will be understood by those of skill in the art and may refer to a mechanical component having a central axis of rotation and a substantially circular cross-section in a plane substantially perpendicular to the axis of rotation. For example, a roller may have a central axis of rotation (e.g., 221). FIG. 2B is a schematic diagram of a cross-section view of roller 220 in-plane with axis of rotation 221, in accordance with some embodiments. In some embodiments, a roller comprises an elastomer.

In some embodiments, an apparatus comprises a crank. In some embodiments, the crank is a component of a crank-and-rocker mechanism. The crank-and-rocker mechanism may be connected to a roller of the apparatus by an arm. For example, referring again to FIG. 2A, the depicted apparatus 200 includes a crank-and-rocker mechanism 230 connected to roller 220 by a connecting arm 224, according to certain embodiments. As used herein, the term "crank-and-rocker mechanism" refers to a plurality of mechanical components connected together and configured to impart motion from at least one component to at least one other component, comprising a crank and a rocker.

As used herein, the term "crank" will be understood by those of skill in the art and may refer to a mechanical component having a shaft configured to rotate and defining an axis of rotation, and an arm attached to the shaft or wherein the shaft comprises a bent portion also referred to as an arm, wherein an axis along the length of the arm is perpendicular to the axis of rotation of the shaft. In some embodiments, a shaft of a crank is connected to a motor in a configuration so that the motor is operable to drive rotation of the crank. In certain embodiments, a system (e.g., an apparatus, pump, and/or device) comprises a motor connected to a shaft of a crank in a configuration so that the motor is operable to drive rotation of the crank. For example, a crank may have a shaft configured to rotate a full 360 degrees and defining an axis of rotation (e.g., axis of rotation 235).

As used herein, the term "arm" will be understood by those of skill in the art and may refer to a mechanical component having one or more portions configured to connect with one or more other corresponding mechanical components, wherein at least one connection is configured for rotation of the arm around an axis of rotation relative to at least one other corresponding connected mechanical component or vice versa, wherein an axis along the length of the arm is perpendicular to the axis of rotation. For example, an arm may be a rigid mechanical component.

In some embodiments, an apparatus comprises a motor. In some embodiments, a motor is connected to (e.g., directly connected to, indirectly connected to) a shaft of a crank in a configuration so that the motor is operable to drive rotation of the crank.

As used herein, a first mechanical component is "indirectly connected" to a second mechanical component where there is one or more intervening mechanical component(s) connecting the first mechanical component to the second mechanical component.

In some embodiments, an apparatus comprises a rocker. For example, referring again to FIG. 2A, apparatus 200 comprises rocker 226, according to some embodiments. In some embodiments, a shaft of a rocker ("rocker shaft") is connected to a shaft of a crank ("crank shaft") such that the axis of rotation of the rocker shaft is held stationary relative to the axis of rotation of the crank shaft, e.g., during rotation of the crank and rocker. In some such cases, the shaft of the rocker and the shaft of the crank are connected such that the axis of rotation of the rocker shaft is parallel to and held stationary relative to the axis of rotation of the crank shaft. Having a first shaft be connected to a second shaft need not imply that the first shaft is in direct contact with the second shaft, as the connection may rather be indirect. In some embodiments, a shaft of a rocker is connected to a shaft of a crank via one or more mechanical components such that the axis of rotation of the rocker shaft is held stationary relative to the axis of rotation of the crank shaft. The one or more mechanical components via which the rocker shaft and crank shaft are connected could include, for example, a solid article (or multiple solid articles that are fixed with respect to each other). The solid object may be a separate, discrete component attached to each of the rocker shaft and the crank shaft, or the solid object may be monolithic with respect to the rocker shaft and the crank shaft. In certain cases, the one or more mechanical components include another connecting arm. As a particular example, the shaft of a rocker may be connected to a shaft of a crank via one or more mechanical components including a carriage. In the exemplary embodiment depicted in FIG. 2A, crank-and-rocker mechanism 230 includes a crank 228 having an axis of rotation 235 and a rocker 226 having an axis of rotation 237, according to certain embodiments. In some cases, a shaft of rocker 226 defining axis of rotation 237 is connected (e.g., indirectly connected) to a shaft of crank 228 defining axis of rotation 235 such that the shaft of rocker 226 is held stationary with respect to the shaft of crank 228. As a particular example, described in more detail below, FIG. 7D shows a shaft defining an axis of rotation of rocker 1026 connected to a shaft defining an axis of rotation of crank 1028 via carriage 1044 such that the axis rotation the shaft of rocker 1026 and the axis of the shaft of crank 1028 are held stationary relative to each other. In some embodiments, apparatus 200 is configured such that rotation of crank 228 and/or rocker 226 drives the motion of roller 220 along a horizontal axis direction 231 and/or a vertical axis direction 229.

As used herein, the term "rocker" will be understood by those of skill in the art and may refer to a mechanical component having: a shaft defining an axis of rotation and configured to rotate through a limited range of angles between 0 degrees and 180 degrees, greater than or equal to 0 degrees and less than 180 degrees, or greater than 0 degrees and less than or equal to 90 degrees; and an arm attached to the shaft, or wherein the shaft comprises a bent portion also referred to as an arm; wherein an axis along the length of the arm is perpendicular to the axis of rotation of the shaft. For example, a rocker may include a shaft defining an axis of rotation (e.g., axis of rotation 237).

As mentioned above, in some embodiments, an apparatus comprises a crank-and-rocker mechanism. In some embodiments, a crank-and-rocker mechanism is connected to a roller, e.g., by a connecting arm. More specifically, in some embodiments, the connecting arm is configured to join the crank to the rocker and the roller. Referring again to FIG. 2A, in some embodiments, connecting arm 224 is configured so as to join crank 228 to rocker 226 and roller 220. In some embodiments, a connecting arm is a component of a crank-and-rocker mechanism.

In some embodiments, an apparatus comprises a roller arm. In some embodiments, a roller arm is configured so as to join a roller to a connecting arm. Referring again to FIG. 2A, in some embodiments, apparatus 200 further includes a roller arm 222 configured so as to join roller 220 to connecting arm 224.

In some embodiments, an apparatus comprises a hinge. In some embodiments, a hinge is configured so as to join a roller arm to a connecting arm. For example, in FIG. 2A, exemplary apparatus 200 further comprises a hinge 225 configured so as to join roller arm 222 to connecting arm 224, according to some embodiments. In some embodiments, a hinge comprises a spring. As example, referring to FIG. 2A, in some embodiments, hinge 225 comprises a spring 227.

In some embodiments, an apparatus comprises a translator screw and/or a translator rod. In some embodiments, a shaft of a rocker is connected to a translator screw and/or a translator rod such that the axis of rotation of the rocker shaft is held stationary and parallel relative to a central axis along the length of the translator screw and/or a central axis along the length of the translator rod.

In some embodiments, an apparatus comprises a motor. In some embodiments, a motor is connected to a translator screw in a configuration so that the motor is operable to drive rotation of the translator screw.

In some embodiments, an apparatus comprises a carriage. In some embodiments, a carriage connects a shaft of a rocker (and/or a shaft of a crank) to a translator screw and/or a translator rod. In some embodiments, a carriage holds a shaft of a rocker and a shaft of a crank at a fixed distance from one another.

As used herein, the term "carriage" will be understood by those of skill in the art and may refer to one or more mechanical components configured to translate one or more articles in one or more dimensions. For example, a carriage may comprise one or more mechanical components configured to translate one or more articles (e.g., one or more other mechanical components) in one or more dimensions (e.g., one, two, or three dimensions).

In some embodiments, driving rotation of the translator screw translates the carriage in one dimension.

In some embodiments, a mechanical component of an apparatus (e.g., roller, crank, rocker, connecting arm, roller arm) is connected directly or indirectly to one or more other mechanical components of the apparatus, some connections or each connection by means of a hinge or other and/or additional attachment means.

In some embodiments, a mechanical component of an apparatus (e.g., roller, crank, rocker, connecting arm, roller arm) is configured to join two or more other mechanical components of the apparatus by means of two or more corresponding hinges.

As used herein, the terms "join" or "connect" will be understood by those of skill in the art and may refer to directly or indirectly joining or connecting two or more mechanical components. For example, two or more mechanical components may be directly or indirectly joined by means of one or more hinges and one or more additional mechanical components.

In some embodiments, a system (e.g., apparatus, pump, device) described herein undergoes a pump cycle. In some embodiments, a pump cycle corresponds to one rotation of a crank of the system. In some embodiments, each pump cycle may transport greater than or equal to 1 μL, greater than or equal to 2 μL, greater than or equal to 4 μL, less than or equal to 10 μL, less than or equal to 8 μL, and/or less than or equal to 6 μL of fluid. Combinations of the above-referenced ranges are also possible (e.g., between or equal to 1 μL and 10 μL). Other ranges of volumes of fluid are also possible.

In some embodiments, a system described herein has a particular stroke length. In certain embodiments, given that each pump cycle may transport on the order of between or equal to 1 μL and 10 μL of fluid, and/or given that channel dimensions may preferably be on the order of 1 mm wide and on the order of 1 mm deep (e.g., depending on what can be machined or molded to decrease channel volume and maintain reasonable tolerances), a stroke length may be greater than or equal to 10 mm, greater than or equal to 12 mm, greater than or equal to 14 mm, less than or equal to 20 mm, less than or equal to 18 mm, and/or less than or equal to 16 mm. Combinations of the above-referenced ranges are also possible (e.g., between or equal to 10 mm and 20 mm). Other ranges are also possible.

As used herein, "stroke length" refers to a distance a roller travels while engaged with a substrate. In certain embodiments, the substrate comprises a cartridge.

Regarding fluid flow resolution, in some embodiments, for applications described herein (e.g., DNA sample preparation and similar assays), displacement of a few microliters of sample or reagent solution may be required, at least in order to provide low percentage errors in total fluid volume (e.g., fluid volume consumed, fluid volume delivered, etc.). In certain embodiments, a fluid flow resolution on the order of a few microliters is possible with conventional manufacturing processes for system (e.g., cartridge, apparatus, device, pump) components. In certain embodiments, crank radius, channel dimensions, and/or roller dimensions independently contribute to determining fluid flow resolution.

In certain embodiments, all dimensions of mechanical components of systems and devices described herein may be scaled up (e.g., 2, 3, 4, 5, or more times), facilitating much larger volumes per pump, with the fluid flow resolution scaling similarly.

In certain embodiments, stroke length is directly related to the radius of a corresponding crank of a system described herein, so the crank radius may be of similar order to the stroke length. In some embodiments, a smaller crank length (also referred to herein as crank radius) facilitates a higher fluid flow resolution (a smaller volume of fluid pumped per rotation of the crank), but on the other hand, tolerances involved in locations of a corresponding roller's engagement and disengagement with a channel may become more narrow for a smaller crank length. In some embodiments, the crank length contributes to determining the vertical travel distance of the corresponding roller, which may be important for clearance between the roller and a corresponding cartridge surface when the portion of the system comprising the roller is translated from channel to channel. In certain embodiments, at least because of the height of the seal plate, at least a few mm of clearance may be needed, and hence a crank radius of the same magnitude (a few mm) may be required. In certain embodiments, a crank radius may be on the order of greater than or equal to 2 mm, greater than or equal to 4 mm, greater than or equal to 6 mm, greater than or equal to 8 mm, greater than or equal to 10 mm, greater than or equal to 12 mm, greater than or equal to 14 mm, less than or equal to 20 mm, less than or equal to 18 mm, and/or less than or equal to 16 mm. Combinations of the above-referenced ranges are also possible (e.g., between or equal to 2 mm and 20 mm). Other ranges are also possible.

In certain embodiments, one could identify a "full pump cycle" of a system described herein by a half crank rotation, or a full crank rotation if considering a disengaged portion of the crank cycle. In certain embodiments, a halted (e.g., halted and subsequently reversed) crank in mid-stroke is possible as a means to reduce the fluid flow resolution per rotation, although there may be fluid-dynamic related consequences. In some embodiments, a halting and reversing process for a stroke of a crank of the system may cause a valve of an associated channel to re-close on the reverse stroke, preventing back-flow (e.g., similar to a check valve). In some embodiments, the system may include more degrees of freedom (e.g., provided by additional motors, etc.) to engage and disengage a roller of the system from an associated channel at arbitrary locations in order to achieve partial strokes to increase fluid flow resolution. In some such embodiments, however, the tolerances involved with roller engagement and disengagement positions may still come into play, and may be exacerbated by the extra complexity of the system. In some embodiments, with further added component(s) with capability to measure the stroke length or pumped volume, along with a control system, very precise arbitrary volumes may be pumped. In some such embodiments, the positioning resolution of motor(s) (e.g., stepper motors) of the system may become a factor in determining fluid flow resolution.

In certain embodiments, a roller path through a full pump cycle in a system described herein is not exactly elliptical. In certain embodiments, the points of engagement and disengagement of the roller with the substrate (e.g., cartridge) are subject to the roller path and other geometrical constraints. In certain embodiments, the stroke length may be closely approximated as roughly twice the crank radius. In certain embodiments, given channel dimensions of the system, there is approximately 0.6 μL of fluid pumped per 1 mm of stroke, where 0.6 μL is determined by (half the channel width)*(channel depth for a v-groove)*(1 mm) for a symmetrical triangularly shaped v-groove with a vertical line of symmetry. In certain embodiments a channel comprises a deep section (e.g., where a channel has a second portion described herein in at least some cross-sections) that defines the starting point of a surface layer's temporary sealing of the corresponding portion of the channel. The location of the starting point defined by the deep section can be at any arbitrary point along the channel, depending on what fraction of the stroke volume is desired to be utilized for fluid transport. The starting point defined by the deep section may be located such that a relatively small fraction of the stroke volume is utilized. For example, in some such cases, the starting point is located such that only about half the stroke is utilized. In some such embodiments, a fluid flow resolution of around 6 μL is achieved. In certain embodiments, the fluid flow resolution ($V_{res}$) of a system described herein may be approximated as the radius of a crank ($R_{crank}$) of the system multiplied by half the width of a corresponding channel ($W_{channel}$) multiplied by the depth of the channel ($D_{channel}$): $V_{res} \simeq R_{crank} * 0.5\ W_{channel} * D_{channel}$.

In certain embodiments, a channel comprises deep sections, one on either side of a pumped section. In some such embodiments, fluid flow resolution, or volume per pump cycle, is completely dependent on the channel dimensions, if the pump stroke is sufficiently long to engage the pumped section. In some such embodiments, or in any other embodiments that include deep non-sealing sections, the total channel volume may disadvantageously be increased. In certain embodiments, this increased total channel volume results in more volume that may need to be cleared out or washed more thoroughly, depending on whether sample or reagent passes through it. Also, in some embodiments with increased total channel volume, an associated peristaltic pumping mechanism develops slightly less pressure, especially in the case of pumping air, at least because the compression ratio (ratio of volume between the valve and roller location at engagement to corresponding volume at disengagement) is decreased. In certain embodiments, a decreased compression ratio may disadvantageously decrease a system's ability to open a valve on a pump cycle.

In some embodiments, from a mechanical perspective, the length of a rocker of a system described herein may theoretically be infinite, producing perfectly linear motion at its end. In certain embodiments, at least to preserve compactness, the length of the rocker of the system is similar to the size of one or more corresponding overall size-determining components (e.g., motor, mounting brackets, screws, bearing pockets, and even the roller arm itself) of the system. The length of the rocker of the system may be on the order of a few tens of mm. For example, the length of the rocker of the system may be greater than or equal to 15 mm, greater than or equal to 20 mm, greater than or equal to 25 mm, less than or equal to 40 mm, less than or equal to 35 mm, and/or less than or equal to 30 mm. Combinations of the above-referenced ranges are also possible (e.g., between or equal to 15 mm and 40 mm). Other ranges are also possible.

In some embodiments, the length of a connecting arm of a system described herein is at least as long as the radius of a corresponding crank, and may typically be longer than the crank radius at least to accommodate a roller arm and associated spring mechanism. In some embodiments, the connecting arm length is at least as large as the crank radius, at least in order to allow movement of the crank in a full rotation. In certain embodiments, the connecting arm length is sufficiently large to contain a corresponding roller arm mechanism (e.g., spring, bearings, etc.) as well as allowing movement of the crank in a full rotation. For compactness, the connecting arm length does not exceed the dimensions of other overall size-determining mechanical components of the system.

In certain embodiments, the roller arm is not so long as to extend the roller beyond the crank shaft (in which case the roller would take on a horizontally-compressed elliptical path). In certain embodiments, the roller arm length is great enough to absorb the vertical travel of the corresponding connecting arm on a down-stroke motion once the corresponding roller begins to engage with the channel, so some significant fraction (e.g., greater than or equal to 0.4, greater than or equal to 0.6, greater than or equal to 0.8, less than or equal to 1.0, less than or equal to 0.9, between or equal to 0.4 and 1.0, other combinations of these ranges, other ranges) of the crank radius may be appropriate for the length of the roller arm. In certain embodiments, a roller arm length may be on the order of greater than or equal to 4 mm, greater than or equal to 5 mm, greater than or equal to 6 mm, less than or equal to 20 mm, less than or equal to 18 mm, and/or less than or equal to 16 mm. Combinations of the above-referenced ranges are also possible (e.g., between or equal to 4 mm and 20 mm). Other ranges are also possible. In certain embodiments, given constraints on the connecting arm, the roller arm length may preferably be on the order of between or equal to 10 mm and 20 mm. In certain embodiments, it may be advantageous to have a roller arm as long as possible within the dimensional constraints of the other mechanical components of the system. In certain embodiments, at least in order to approximate linear vertical travel of the roller during engagement with a channel, the roller arm is long compared to the roller radius. For example, the roller arm may be greater than or equal to 2 times, greater than or equal to 3 times, greater than or equal to 4 times, less than or equal to 7 times, less than or equal to 6 times, and/or less than or equal to 5 times. Combinations of the above-referenced ranges are also possible (e.g., between or equal to 2 times and 7 times). Other ranges of multiples of the roller radius are also possible.

In certain embodiments, the radius of a roller of a system described herein is larger (e.g., significantly larger) than the depth (e.g., on the order of 1 mm) of a corresponding channel. The roller radius may be larger (e.g., significantly larger) than the depth (e.g., on the order of 1 mm) of the channel at least so that the wedge of the roller can fully access and seal the channel by deforming a corresponding portion of a surface layer comprising an elastomer into the channel. In certain embodiments, an axle (e.g., a 3 mm diameter shoulder screw) of the roller is able to clear the surface of the seal plate of a corresponding cartridge, which seal plate may be on the order of 2 mm above the channel surface. For at least this reason, in certain embodiments, the roller radius is sufficiently large to elevate the axle above the surface of the seal plate. Accordingly, in certain embodiments, the roller radius is greater than or equal to 4.5 mm. In certain embodiments, considering other practical limitations of the axle/bearing mechanism, like the head diameter of the shoulder screw, the roller radius may be greater than or equal to 5 mm. In certain embodiments, a roller much larger than any of the other components may be impractical and less compact, and additionally may reduce the fluid flow resolution of the system, and may contribute to the precise locations of channel engagement and disengagement of the roller being less well defined. Accordingly, in certain embodiments, the roller radius is greater than or equal to 4.5 mm, greater than or equal to 5 mm, greater than or equal to 10 mm, less than or equal to 20 mm, less than or equal to 16 mm, and/or less than or equal to 12 mm. Combinations of the above-referenced ranges are also possible (e.g., between or equal to 4.5 mm and 20 mm). Other ranges are also possible.

In certain embodiments, a roller is at least as wide as an associated channel (e.g., on the order of 1 mm), and may typically be approximately as thick as an associated bearing of the roller. In certain embodiments, given typical small bearing widths, a roller width may be between or equal to 2 mm and 3 mm. In certain embodiments, a roller has a width of greater than or equal to 2 mm, greater than or equal to 2.5 mm, and/or less than or equal to 3 mm. Combinations of the above-referenced ranges are also possible (e.g., between or equal to 2 mm and 3 mm). Other ranges are also possible. In certain embodiments, an overly thick roller limits the possible width of beams in the seal plate that seal between each channel, as the beams would otherwise be interfering with the roller engagement with a channel.

In certain embodiments, an elastomer of a surface layer of a system (e.g., cartridge, pump) described herein requires approximately 2 pounds of force to seal against an associated channel, contributing to the requirement of the spring mechanism of an associated roller. In certain embodiments, given that this sealing force may be approximately regulated over a few mm of vertical displacement, a spring constant of the spring in a sprung roller arm of 1 pound per approximately 5 mm may be appropriate. In certain embodiments, a spring constant of the spring in the sprung roller arm may be greater than or equal to 1 pound per 5 mm, greater than or equal to 1 pound per 4 mm, greater than or equal to 1 pound per 3 mm, less than or equal to 1 pound per 1 mm, and/or less than or equal to 1 pound per 2 mm. Combinations of the above-referenced ranges are also possible (e.g., between or equal to 1 pound per 5 mm and 1 pound per 1 mm). Other ranges are also possible. In certain embodiments, this spring constant may facilitate reasonable preloading of the roller arm in the idle position, giving the required 2 pounds of sealing force with a few mm of initial displacement of the spring.

In certain embodiments, the distance between a rocker shaft and a corresponding crank shaft of a system described herein is sufficiently long to accommodate a functioning crank-and-rocker mechanism.

In certain embodiments, the location of the hinge of a roller arm of the system in relation to the rocker shaft and/or the crank shaft, in conjunction with the roller arm angle and the roller arm length, contribute to determining the specific path that the roller follows in a full pump rotation. In certain embodiments, the closer the roller is to the rocker, the more horizontal the roller may travel (e.g., along a path that is compressed vertically), and conversely, the closer the roller is to the crank, the more circular the path of the roller may be. At least for these reasons, in certain embodiments, locating the roller arm hinge more toward the middle between the crank shaft and the rocker shaft produces a somewhat elliptical path that facilitates a sufficiently long stroke length, but also facilitates enough vertical travel to clear the substrate surface (e.g., cartridge surface) during translation of the portion of the system comprising the roller. In certain embodiments, the roller arm hinge is at least greater than the radius of the roller away from the (crank shaft)-to-(rocker shaft) connecting line, as measured perpendicular to the (crank shaft)-to-(rocker shaft) connecting line (e.g., FIG. 7B).

An apparatus described herein is generally configured to transport fluids with a high fluid flow resolution. For example, in some embodiments, an apparatus is configured to transport fluids with a fluid flow resolution of less than or equal to 1000 microliters, less than or equal to 500 microliters, less than or equal to 200 microliters, less than or equal to 100 microliters, less than or equal to 50 microliters, less than or equal to 20 microliters, or less than or equal to 10 microliters. In some embodiments, an apparatus is configured to transport fluids with a fluid flow resolution of greater than or equal to 1 microliter, greater than or equal to 2 microliters, or greater than or equal to 5 microliters. Combinations of the above-referenced ranges are also possible (e.g., between or equal to 1 microliter and 1000 microliters, between or equal to 2 microliters and 100 microliters, between or equal to 5 microliters and 50 microliters). Other ranges are also possible.

In certain embodiments, a fluid comprises a liquid. In certain embodiments, the fluid comprises a liquid and solid particles in the liquid. In certain embodiments, the fluid is a liquid.

In certain embodiments, systems and devices (e.g., comprising one or more apparatuses, cartridges, pumps) herein have a fluid flow resolution of less than or equal to 1000 μL. For example, systems and devices herein may have a fluid flow resolution of less than or equal to 500 μL, less than or equal to 200 μL, less than or equal to 100 μL, less than or equal to 50 μL, less than or equal to 20 μL, or less than or equal to 10 μL. Systems and devices herein may have a fluid flow resolution of greater than or equal to 1 μL, greater than or equal to 2 μL, or greater than or equal to 5 μL. Combinations of the above-reference ranges are also possible (e.g., between or equal to 1 μL and 1000 μL, between or equal to 2 μL and 100 μL, between or equal to 5 μL and 50 μL). Other ranges are also possible. In certain embodiments, systems and devices herein have a fluid flow resolution of between or equal to 5 μL and 10 μL. In certain embodiments, fluid flow resolution is measured per pump, e.g., per single revolution of a crank in a crank-and-rocker mechanism.

As used herein, the term "fluid flow resolution" refers to the minimum amount of fluid that can be flowed through a channel at a time. In some embodiments, fluid flow resolution may be limited, e.g., by the dimensions of the channel and/or the pumping mechanism. For example, fluid flow resolution may refer to the minimum amount of fluid that can be flowed through a channel at a time, and may be limited, e.g., by the dimensions of the channel and/or the pumping mechanism (e.g., air pressure, positive displacement pump, peristalsis).

In another aspect, cartridges are provided.

In some embodiments, a cartridge comprises a base layer. In some embodiments, a base layer has a surface comprising one or more channels. For example, FIG. 3A is a schematic diagram of a cross-section view of a cartridge 100 along the width of channels 102, in accordance with some embodiments. The depicted cartridge 100 includes a base layer 104 having a surface 111 comprising channels 102. In certain embodiments, at least some of the channels are microchannels. For example, in some embodiments, at least some of channels 102 are microchannels. In certain embodiments, all of the channels microchannels. For example, referring again to FIG. 3A, in certain embodiments, all of channels 102 are microchannels.

As used herein, the term "channel" will be known to those of ordinary skill in the art and may refer to a structure configured to contain and/or transport a fluid. A channel generally comprises: walls; a base (e.g., a base connected to the walls and/or formed from the walls); and a surface opening that may be open, covered, and/or sealed off at one or more portions of the channel.

In some embodiments, the cartridge is configured such that fluid in a reservoir of the cartridge can be transported (e.g., at least in part via peristaltic pumping) from the reservoir to a channel of the cartridge and/or to another reservoir of the cartridge. In some embodiments, the cartridge is configured such that fluid in a first channel of the cartridge can be transported (e.g., at least in part via peristaltic pumping) from the first channel to a second channel of the cartridge and/or to a reservoir of the cartridge. In some embodiments, the cartridge is configured such that fluid in a channel of the cartridge can be transported (e.g., at least in part via peristaltic pumping) from a first portion of a channel to a second portion of that channel.

As used herein, the term "microchannel" refers to a channel that comprises at least one dimension less than or equal to 1000 microns in size. For example, a microchannel may comprise at least one dimension (e.g., a width, a height) less than or equal to 1000 microns (e.g., less than or equal to 100 microns, less than or equal to 10 microns, less than or equal to 5 microns) in size. In some embodiments, a microchannel comprises at least one dimension greater than or equal to 1 micron (e.g., greater than or equal to 2 microns, greater than or equal to 10 microns). Combinations of the above-referenced ranges are also possible (e.g., greater than or equal to 1 micron and less than or equal to 1000 microns, greater than or equal to 10 micron and less than or equal to 100 microns). Other ranges are also possible. In some embodiments, a microchannel has a hydraulic diameter of less than or equal to 1000 microns. As used herein, the term "hydraulic diameter" ($D_H$) will be known to those of ordinary skill in the art and may be determined as: $D_H=4A/P$, wherein A is a cross-sectional area of the flow of fluid through the channel and P is a wetted perimeter of the cross-section (a perimeter of the cross-section of the channel contacted by the fluid).

In some embodiments, at least a portion of at least some channel(s) have a substantially triangularly-shaped cross-section. In some embodiments, at least a portion of at least some channel(s) have a substantially triangularly-shaped cross-section having a single vertex at a base of the channel and having two other vertices at the surface of the base layer. Referring again to FIG. 3A, in some embodiments, at least a portion of at least some of channels 102 have a substantially triangularly-shaped cross-section having a single vertex at a base of the channel and having two other vertices at the surface of the base layer.

As used herein, the term "triangular" is used to refer to a shape in which a triangle can be inscribed or circumscribed to approximate or equal the actual shape, and is not constrained purely to a triangle. For example, a triangular cross-section may comprise a non-zero curvature at one or more portions.

A triangular cross-section may comprise a wedge shape. As used herein, the term "wedge shape" will be known by those of ordinary skill in the art and refers to a shape having a thick end and tapering to a thin end. In some embodiments, a wedge shape has an axis of symmetry from the thick end to the thin end. For example, a wedge shape may have a thick end (e.g., surface opening of a channel) and taper to a thin end (e.g., base of a channel), and may have an axis of symmetry from the thick end to the thin end.

Additionally, in certain embodiments, substantially triangular cross-sections (i.e., "v-groove(s)") may have a variety of aspect ratios. As used herein, the term "aspect ratio" for a v-groove refers to a height-to-width ratio. For example, in some embodiments, v-groove(s) may have an aspect ratio of less than or equal to 2, less than or equal to 1, or less than or equal to 0.5, and/or greater than or equal to 0.1, greater than or equal to 0.2, or greater than or equal to 0.3. Combinations of the above-referenced ranges are also possible (e.g., between or equal to 0.1 and 2, between or equal to 0.2 and 1). Other ranges are also possible.

In some embodiments, at least a portion of at least some channel(s) have a cross-section comprising a substantially triangular portion and a second portion opening into the substantially triangular portion and extending below the substantially triangular portion relative to the surface of the channel. In some embodiments, the second portion has a diameter (e.g., an average diameter) significantly smaller than an average diameter of the substantially triangular portion. Referring again to FIG. 3A, in some embodiments, at least a portion of at least some of channels 102 have a cross-section comprising a substantially triangular portion 101 and a second portion 103 opening into substantially triangular portion 101 and extending below substantially triangular portion 101 relative to surface 105 of the channel, wherein second portion 103 has a diameter 107 significantly smaller than an average diameter 109 of substantially triangular portion 101. In some embodiments a ratio of the diameter of the second portion to the average diameter of the substantially triangular portion is less than or equal to 0.8, less than or equal to 0.6, less than or equal to 0.5, less than or equal to 0.4, less than or equal to 0.3, less than or equal to 0.2, and/or as low as 0.1 or lower. In some such cases, the second portion of a channel having a significantly smaller diameter than that of the average diameter of the substantially triangular portion of the channel can result in the substantially triangular portion being accessible to the roller of the apparatus and deformed portions of the surface layer, but the second portion being inaccessible to the roller and deformed portions of the surface layer. For example, referring again to FIG. 3A, substantially triangular portion 101 of channel 102 is accessible to a roller (not pictured) and deformed portions of surface layer 106, while second portion 103 is inaccessible to the roller and deformed portions of surface layer 106, in accordance with certain embodiments. In some such cases, a seal with the surface layer 106 cannot be achieved in portions of the channel 102 having a second portion 103, because fluid can still move freely in second portion 103, even when surface layer 106 is deformed by a roller such that it fills substantially triangular portion 101 but not second portion 103. In some embodiments, a portion along a length of a channel may have both a substantially triangular portion and a second portion ("deep section"), while a different portion along the length of the channel has only the substantially triangular portion. In some such embodiments, when the apparatus (e.g., roller) engages with the portion having both a substantially triangular portion and a second portion (deep section), pump action is not started, because a seal with the surface layer is not achieved. However, as the apparatus engages along the length direction of the channel, when the apparatus deforms the surface layer at the portion of the channel having only a substantially triangular section, pump action begins because the lack of second portion (deep section) at that portion allows for a seal (and consequently a pressure differential) to be created. Therefore, in some cases, the presence and absence of deep sections along the length of the channels of the cartridge can allow for control of which portions of the channel are capable of undergoing pump action upon engagement with the apparatus.

The inclusion of such "deep sections" as second portions of at least some of the channels of the cartridge may contribute to any of a variety of potential benefits. For example, such deep sections (e.g., second portion 103) may, in some cases, contribute to a reduction in pump volume in peristaltic pumping processes. In some such cases, pump volume can be reduced by a factor of two or more for higher volume resolution. In some cases, such deep sections may also provide for a well-defined starting point for the pump volume that is not determined by where the roller lands on the channel. For example, the interface between a portion of a channel having both a substantially triangular portion and a second portion (deep section) and a portion of a channel having only a substantially triangular portion can, in some cases, be used as a well-defined starting point for the pump volume, because only fluid occupying the volume of the latter channel portion can be pumped. In some cases, where the rollers lands on the channel may have some error associated depending on any of a variety of factors, such as cartridge registration. The inclusion of deep sections may, in some cases, reduce or eliminate variations in pump volume associated with such error.

As used herein, an average diameter of a substantially triangular portion of a channel may be measured as an average over the z-axis from the vertex of the substantially triangular portion to the surface of the channel.

In certain embodiments, at least some channels (also referred to herein as pumping lanes) (e.g., all channels) each comprises a valve comprising the surface layer comprising an elastomer. In certain embodiments, each valve comprises a blockage in an associated channel formed by the geometry of the end of the channel. For example, the geometry of the end of the channel may be a wall spanning from the bottom of the channel to the top surface of the channel, where the channel interfaces with the surface layer. In some such embodiments, a channel remains closed by its associated valve until enough pressure is applied such that the valve opens. In certain embodiments, the valve opens by the surface layer ballooning outward. In certain embodiments, each valve is effectively actuated by the roller. For example, in some embodiments, pressure exerted on the surface layer by the roller when the roller is relatively close to the valve causes the surface layer to balloon outward (e.g., like a diaphragm) such that a seal between the small blockage and the surface layer is reversibly broken, thereby allowing fluid to pass through the valve. FIG. 7F in the Example below shows one non-limiting embodiment in which a cartridge 1100 comprises a valve 1108 in channel 1102. In some cases, the use of such a "passive" valve can contribute to any of a variety of advantages. For example, in some instances, the use of such an integrated valve described herein can ensure that lanes that are not being pumped (e.g., via engagement with the roller of the apparatus) remain closed. In some such cases, only fluid from channels that are engaged by the apparatus (e.g., pump) is driven from the cartridge, which can allow for a convenient, simple, and inexpensive way to selectively drive fluids from a multi-channel pump with reduced or no contamination.

In certain embodiments, channels have certain relatively small width and depth, with an aspect ratio of depth/width of generally less than or equal to 1. In some embodiments, channel width is greater than or equal to 1 mm, greater than or equal to 1.2 mm, greater than or equal to 1.5 mm, less than or equal to 2 mm, less than or equal to 1.8 mm, and/or less than or equal to 1.6 mm. Combinations of the above-referenced ranges are also possible (e.g., between or equal to 1 mm and 2 mm). Other ranges are also possible. In some embodiments, channel depth is greater than or equal to 0.6 mm, greater than or equal to 0.75 mm, greater than or equal to 0.9 mm, less than or equal to 1.5 mm, less than or equal to 1.2 mm, and/or less than or equal to 1.0 mm. Combinations of the above-referenced ranges are also possible (e.g., between or equal to 0.6 mm and 1.5 mm). Other ranges are also possible. In some embodiments, channel aspect ratio is less than or equal to 1, less than or equal to 0.8, less than or equal to 0.6, less than or equal to 0.5, greater than or equal to 0.2, and/or greater than or equal to 0.4. Combinations of the above-referenced ranges are also possible (e.g., between or equal to 0.2 and 1). Other ranges are also possible. In certain embodiments, given tolerances and capabilities of a molding process, channels on the order of 1.5 mm wide and on the order of 0.75 mm deep may be appropriate. In certain embodiments, a channel cross-section has an aspect ratio of 1/2 with a 90 degree v-groove which provides both ease of roller access into the channel (e.g., for which a shallower v-groove may be better) and higher volume precision (e.g., for which a deeper v-groove may be better at least because the volume becomes less dependent on achieving precise planarity of the surface layer comprising the elastomer). In certain embodiments, the channel depth is on the order of the thickness of the surface layer comprising the elastomer, such that the surface layer can temporarily fill in and seal against imperfections in the channel that are likely to be some significant fraction of the channel dimensions.

In some embodiments, at least a portion of at least some channel(s) have a surface layer.

In some embodiments, a surface layer comprises an elastomer. Referring again to FIG. 3A, for example, in some embodiments, at least a portion of at least some of channels 102 have a surface layer 106, comprising an elastomer, configured to substantially seal off a surface opening of channel 102. In some embodiments, at least a portion of at least some of channels 102: have a substantially triangularly-shaped cross-section having a single vertex at a base of the channel and having two other vertices at the surface of the base layer; and have a surface layer 106, comprising an elastomer, configured to substantially seal off a surface opening of channel 102.

In some embodiments, an elastomer comprises silicone. In some embodiments, the elastomer comprises silicone and/or a thermoplastic elastomer, and/or consists essentially of an elastomer.

In some embodiments, a surface layer is configured to substantially seal off a surface opening of a channel. In some embodiments, a surface layer is configured to completely seal off a surface opening of a channel such that fluid (e.g., liquid) cannot leave the channel except via an entrance or exit of the channel. In some embodiments, a surface layer is bound to a portion of a surface of a base layer (e.g., by an adhesive, by heat lamination, or any other suitable binding means). In some embodiments, a surface layer is bound to a portion of a surface of a base layer by an adhesive. In some embodiments, a surface layer is bound to a portion of a surface of a base layer by heat lamination.

As used herein, the term "seal off" refers to contact at or near the edges of an opening such that the opening is sealed.

As used herein, the term "surface opening" refers to the portion of the channel that would open the channel to a surrounding atmosphere if not covered by a surface layer. For example, a microchannel may have a surface opening.

As used herein, a surface layer may be bound to a portion of the surface of the base layer by any suitable binding means. For example, in some embodiments, a surface layer is bound to a portion of the surface of the base layer covalently, ionically, by Van der Waals interactions, by dipole-dipole interactions, by hydrogen bonding, by pi-pi stacking interactions, or by another suitable bonding means.

In some embodiments, a surface layer is held in tension directly in contact with a portion of a surface of a base layer.

As used herein, a surface (e.g., a ceiling) of a channel may correspond to an inner surface of a surface layer.

In some embodiments, at least a portion of the surface layer is flat in the absence of at least one magnitude of applied pressure. In some embodiments, an entirety of the surface layer is flat in the absence of at least one magnitude of applied pressure. For example, in some embodiments, at least a portion (or an entirety) of the surface layer is flat in the absence of engagement by the roller of the apparatus (which can cause deformation of the surface layer via the application of a pressure).

In some embodiments, at least a portion of at least some channel(s) have walls and a base comprising a material (e.g., a substantially rigid material) that is compatible with biological material. In some embodiments, at least a portion of at least some channel(s) have walls and a base comprising a substantially rigid material. For example, referring again to FIG. 3A, in some embodiments, at least a portion of at least some of channels 102 have walls and a base comprising a substantially rigid material. In certain embodiments, a base comprises a material that is the same as the material of base layer 104. In certain embodiments, a base comprises a material that is different than the material of base layer 104. For example, a base may comprise a material that is different than the material of base layer 104 in instances where the walls and base of the channel are coated with the rigid material. In some embodiments, the substantially rigid material is compatible with biological material. In some embodiments, the base layer is an injection-molded part.

In some embodiments, a cartridge further comprises a seal plate. In some embodiments, a seal plate comprises a hard plastic, and/or is an injection-molded part. In certain embodiments, a seal plate comprises one or more through-holes. In some embodiments, the one or more through-holes have a shape substantially similar to one or more associated channels in the base layer. It should be understood that in this context, the "through-holes" refer to gaps/holes/voids in the seal plate through which one or more mechanical components of, for example, an apparatus, can travel to engage and/or disengage with a surface layer of the cartridge. For example, a peristaltic pump comprising a roller and a cartridge as described herein may be configured such that the roller travels through at least a portion of the through holes of the seal plate to reach a surface layer of the cartridge when engaging and/or disengaging with that surface. The through-holes may have any of a variety of shapes and aspect ratios (rectangular, square, circular, oblong, etc.). As an example, referring to FIG. 7D described in more detail below, seal plate 1108 includes through-holes 1109 aligned over channels 1106, in accordance with certain embodiments. Roller 1020 may be able to engage and/or disengage with a surface layer of cartridge 1100 by traveling at least partially through through-holes 1109.

In certain embodiments, at least some of the one or more through-holes of the seal plate are configured in alignment with one or more associated channels in the base layer. In some embodiments, the cartridge comprises a surface layer comprising an elastomer disposed between the seal plate and the base layer. In certain embodiments, the surface layer is disposed directly between the seal plate in the base layer. In certain embodiments, a cartridge comprises one or more exposed regions of a surface layer disposed between the seal plate and a base layer, wherein each of the one or more exposed regions are defined by an associated through-hole of the seal plate and an aligned channel of the base layer. In certain embodiments, one or more exposed portions of the one or more exposed regions of the surface layer may be deformed by a roller to contact one or more associated portions of the walls and/or base of the associated channel of the base layer.

In some embodiments, at least some channel(s) connect to a reservoir. The reservoir may be used for chemical reactions involving the sample. As one non-limiting example, the reservoir may be used for enzymatic reactions involving the sample (e.g., as an upstream process prior to further analysis, sequencing, or diagnostics processes).

The reservoir may be connected to at least some channel(s) at the bottom surface of the channel(s) by intersecting on the perimeter of the reservoir. In some such cases, then, the reservoir and the channels to which it is connected each interface with the surface layer of the cartridge (e.g., the membrane such as a silicone membrane). However, in some embodiments, the reservoir is connected to at least some channel(s) via a top surface of the reservoir or cartridge. In some embodiments, the reservoir is empty (e.g., initially empty prior to one or more of the processes herein). For example, the reservoir may initially be empty at the beginning of a sequencing (or analysis or diagnostic) application, but during the application, the sample and/or a reagent (e.g., an enzymatic reaction reagent) is added. In some embodiments, the reservoir contains a reagent (e.g., a small volume, such as a few microliters, of an enzymatic reaction reagent). In some such embodiments, sample is transported into the reservoir containing the reagent and the sample and the reagent mix upon transportation of the sample into the reservoir.

In some embodiments, at least some channel(s) connect to a reservoir in a temperature zone. A reservoir may be in a temperature zone if it is in contact or at least partially (or completely) surrounded by a thermal bath that can regulate the temperature of fluids in the reservoir. For example, the reservoir may be surround by a metal cavity (e.g., a metal cavity integrated into the instrument) capable of regulating the temperature of fluids in the reservoir. Temperature regulation of the reservoir (e.g., via a temperature zone) may allow for relatively accurate temperature control. Relatively accurate temperature may be useful in certain embodiments in which desired reactions (e.g., enzymatic reactions) proceed more efficiently at specific temperature ranges.

FIG. 1B shows a schematic illustration of certain embodiments of system 2000 described above in which sample preparation module 1700 further comprises optional reservoir 1500. In some embodiments, the reservoir is connected to the peristaltic pump. In some such embodiments, fluid(s) contained in reservoir 1500 are transferred from reservoir 1500 to cartridge 1300 of peristaltic pump 1400 (e.g., during a sample preparation process). Some embodiments comprise flowing at least a portion of a sample from a reservoir to a peristaltic pump in a sample preparation module prior to flowing the at least a portion of the sample from the sample preparation module to a detection module. It should be understood that while FIG. 1B depicts optional reservoir 1500 as being a separate component from cartridge 1300, in some embodiments, optional reservoir 1500 is a part of cartridge 1300. For example, the optional reservoir may be inside the cartridge, but upstream of the channel(s) of the cartridge with respect to the direction of flow of fluid in the system, according to some embodiments. It should also be understood that the sample preparation module may comprise more than one reservoir. For example, in some embodiments, the sample preparation module comprises at least 1, at least 2, at least 3, at least 4, at least 5, or more reservoirs.

In some embodiments, at least some channel(s) connect to a gel (e.g., an electrophoresis gel). The gel may be connected to at least some channel(s) via a fluid reservoir embedded within the gel. In some such cases, the fluid reservoir embedded within the gel is connected to at least some channel(s) in a similar manner as is the reservoir (e.g., optional reservoir 1500) described above. FIG. 1B shows a schematic illustration of certain embodiments of system 2000 described above in which sample preparation module 1700 further comprises an optional gel 1600. In some embodiments, gel 1600 is an electrophoresis gel. In some embodiments, the sample preparation module comprises an electrophoresis gel connected to the peristaltic pump and the detection module. In some such embodiments, the electrophoresis gel is downstream of the peristaltic pump and upstream of the detection module. As a non-limiting example, in some embodiments, fluid(s) pumped by peristaltic pump 1400 are transferred out of cartridge 1300 of sample preparation module 1700 (e.g., via at least some channel(s)) and to optional gel 1600 (e.g., during a sample preparation process). In some embodiments, flowing at least a portion of the sample from a sample preparation module to a detection module comprises flowing the at least a portion of the sample from the peristaltic pump to the electrophoresis gel, and subsequently, flowing the at least a portion of the sample to the detection module. In some such embodiments, fluid (e.g., prepared sample) is transported from optional gel 1600 to detection module 1800 (in some cases via one or more intermediate modules, such as a loading module). It should also be understood that the sample preparation module may comprise more than one gel. For example, in some embodiments, the sample preparation module comprises at least 1, at least 2, at least 3, at least 4, at least 5, or more gels. It should also be understood that in some embodiments, the gel may be located within the cartridge. For example, the cartridge may comprise channels and a gel, and the cartridge may be configured such that fluid (e.g., at least a portion of a sample) can be transported (e.g., at least in part via peristaltic pumping) from the channels to the gel (and, in some instances, from the gel to a further downstream location within or separate from the cartridge).

The gel may be used for any of a variety of purposes. For example, in some embodiments, the gel can be used to process the sample. One such example is using an electrophoresis gel to electrophoretically transport sample fluid within the gel (e.g., from a fluid reservoir embedded within the gel to one or more other locations in the gel) to process the sample. Some such processes may be used to at least partially isolate or enrich certain components of the sample or to clean up the sample (e.g., via size selection) prior to downstream detection. Certain exemplary uses of gels are described in more detail below.

In some embodiments, a system described herein forms at least a portion of a sample in a sample preparation module, which may be functionally connected with a loading module, which may be functionally connected with a detection (e.g., sequencing) module. In some embodiments, flowing at least a portion of the sample from a sample preparation module to a detection module comprises flowing the at least a portion of the sample from the sample preparation module to a loading module, and subsequently, flowing the at least a portion of the sample to the detection module. For example, referring again to FIG. 1B, at least a portion of a sample is prepared in sample preparation module 1700, and that at least a portion the sample is transferred to an optional loading module 1900, which can be configured to load the at least a portion of the sample into detection module 1800 via any of a variety of techniques known to one or ordinary skill, depending on the configuration of detection module 1800. Exemplary methods of loading samples or portions thereof into exemplary detection modules are described in more detail below.

Channel(s) described herein are generally configured to transport fluids with a high fluid flow resolution. For example, in some embodiments, at least some channel(s) are configured to transport fluids with a fluid flow resolution of less than or equal to 1000 microliters, less than or equal to 100 microliters, less than or equal to 50 microliters, or less than or equal to 10 microliters. In some embodiments, at least some channel(s) are configured to transport fluids with a fluid flow resolution of greater than or equal to 1 microliter, greater than or equal to 2 microliters, or greater than or equal to 4 microliters. Combinations of the above-referenced ranges are also possible (e.g., between or equal to 1 microliter and 1000 microliters, between or equal to 2 microliters and 100 microliters, between or equal to 4 microliters and 50 microliters). Other ranges are also possible.

In another aspect, peristaltic pumps are provided.

In some embodiments, a peristaltic pump comprises a roller described herein.

In some embodiments, a peristaltic pump comprises a cartridge described herein.

In certain embodiments, a peristaltic pump comprises a roller described herein and a cartridge described herein, e.g., configured such that the roller may engage with and/or disengage from a channel of the cartridge.

In some embodiments, a peristaltic pump comprises an apparatus described herein.

In certain embodiments, a peristaltic pump comprises an apparatus described herein and a cartridge described herein, e.g., configured such that the apparatus (e.g., a roller of the apparatus) may engage with and/or disengage from a channel of the cartridge.

In some embodiments, a peristaltic pump comprises a crank-and-rocker mechanism described herein connected to a roller by a connecting arm.

In certain embodiments, a peristaltic pump comprises a roller described herein, a crank-and-rocker mechanism described herein connected to the roller by a connecting arm, and a cartridge described herein, e.g., configured such that the roller may engage with and/or disengage from a channel of the cartridge by operation of the crank-and-rocker mechanism.

In some embodiments, a peristaltic pump comprising a roller and a cartridge is provided. For example, in some embodiments, a peristaltic pump comprising a roller (e.g., 220 of FIG. 2A, FIG. 2B) and a cartridge (e.g., cartridge 100 of FIG. 3A) is provided. In some embodiments, a peristaltic pump comprising an apparatus and a cartridge is provided. For example, in some embodiments, a peristaltic pump comprising an apparatus (e.g., 200 of FIG. 2A) and a cartridge (e.g., cartridge 100 of FIG. 3A) is provided.

As used herein, a first mechanical component "engages with" a second mechanical component by coming into contact with the second mechanical component so as to be configured to effect movement and/or deformation of at least a portion of the second mechanical component. For example, a first mechanical component (e.g., roller, apparatus) may engage with a second mechanical component (e.g., channel, base layer) by coming into contact with the second mechanical component so as to be configured to effect movement and/or deformation of at least a portion of the second mechanical component. For example, a roller (e.g., roller 220 of FIG. 3B) may engage with a channel (e.g., channel 102 of FIG. 3B) by coming into contact with a surface layer (e.g., surface layer 106 of FIG. 3B) of the channel and deforming the surface layer into the channel, e.g., such that fluid (e.g., fluid 112 of FIG. 3B) is displaced within the channel.

As used herein, a first mechanical component "disengages from" a second mechanical component by being removed from contact with the second mechanical component, and/or being removed from a configuration for effecting movement and/or deformation of at least a portion of the second mechanical component. For example, a roller and/or apparatus may disengage from a second mechanical component (e.g., channel) by being removed from contact with the second mechanical component, and/or being removed from a configuration for effecting movement and/or deformation of at least a portion of the second mechanical component. In some embodiments, a first mechanical component is disengaged from but still in contact with a second mechanical component.

It should be appreciated that the terms "first" mechanical component and "second" mechanical component, as used herein, refer to different mechanical components within a system, and are not meant to be limiting with respect to the location of the respective mechanical component. For example, systems and devices having a first mechanical component and a second mechanical component may include an apparatus, a cartridge, and/or a peristaltic pump. Furthermore, in some embodiments, additional mechanical components may be present in addition to the ones indicated. For example, in some embodiments, "third", "fourth", "fifth", "sixth", "seventh", or a greater count of mechanical components may be present in addition to the ones indicated. It should also be appreciated that not all mechanical components shown in the figures need be present in some embodiments.

In some embodiments, a peristaltic pump comprises a crank.

In some embodiments, a peristaltic pump comprises a rocker.

In some embodiments, a peristaltic pump comprises a connecting arm configured so as to join a crank to a rocker and a roller.

In certain embodiments, a peristaltic pump comprises a roller described herein, a crank, a rocker, a connecting arm configured so as to join the crank to the rocker and the roller, and a cartridge described herein, e.g., configured such that the roller may engage with and/or disengage from a channel of the cartridge by operation of the crank.

In another aspect, methods are provided.

In some embodiments, methods of manufacture (also referred to herein as methods of making) are provided. In some embodiments, a method comprises manufacturing one or more mechanical components (e.g., arms, crank arm, rocker arm, connecting arm, roller, carriage) of a system (e.g., apparatus, peristaltic pump), e.g., wherein manufacturing comprises machining (e.g., conventional machining) and/or injection molding (e.g., thermoplastic injection molding, precision injection molding). In some embodiments, one or more mechanical components (e.g., screws, bearings, springs, rods, shoulder bolts, motors, carriage) of a system are commercially available. In some embodiments, a method comprises modifying (e.g., machining) one or more commercially available mechanical components to attain component(s) having one or more (e.g., two, three) customized dimensions. For example, in certain embodiments, a method comprises modifying the length of a commercially available translator rod and/or modifying the length of a commercially available translator screw to customized length(s).

In some embodiments, a method of making an apparatus comprises connecting a crank arm, a rocker arm, and a roller to a connecting arm. In certain embodiments, connecting the roller to the connecting arm comprises connecting the roller to the connecting arm using a roller arm. In certain embodiments, the method comprises connecting the roller arm to the connecting arm by a hinge comprising a spring.

In some embodiments, a method comprises connecting a shaft of the rocker arm to a shaft of the crank arm such that the axis of rotation of the rocker shaft is held stationary relative to the axis of rotation of the crank shaft. For example, in certain embodiments, connecting the shaft of the rocker arm to the shaft of the crank arm comprises connecting the shaft of the rocker arm and the shaft of the crank arm to a carriage. In certain embodiments, a method comprises connecting the carriage to a translator rod and a translator screw. In some such embodiments, the translator rod and translator screw are connected to the carriage in a configuration such that any motion of the carriage is independent of any motion of the crank-and-rocker mechanism.

In some embodiments, a method comprises connecting one or more mechanical components to a motor. For example, in certain embodiments, a method comprises connecting the shaft of a crank arm to a crank motor. As another example, a method may comprise connecting a translator screw to a translator motor. In certain embodiments, a method comprises both connecting the shaft of a crank arm to a crank motor and connecting a translator screw to a translator motor, in a configuration such that any motion of the crank is independent of any motion of the translator screw.

In some embodiments, a method comprises manufacturing one or more mechanical components by machining and/or injection molding. For example, in some embodiments, a method comprises machining and/or injection molding a crank arm, a rocker arm, a connecting arm, a roller, a roller arm, and/or a carriage. In certain embodiments, the method comprises machining one or more mechanical components. In certain embodiments, the method comprises injection molding one or more mechanical components. For example, injection molding may comprise thermoplastic injection molding and/or precision injection molding.

In some embodiments, a method comprises modifying one or more commercially available mechanical components to attain one or more mechanical components having one or more customized dimensions. For example, in certain embodiments, modifying one or more commercially available mechanical components comprises modifying the length of a commercially available translator rod to a customized length and/or modifying the length of a commercially available translator screw to a customized length. In certain embodiments, modifying comprises machining.

In certain embodiments, a method comprises manufacturing one or more mechanical components of a cartridge, e.g., wherein manufacturing comprises injection molding (e.g., precision injection molding). In some embodiments, a method comprises injection molding with hard-steel tooling. In certain embodiments, smooth, defect-free surfaces and tight tolerances (e.g., on the order of tens of microns) are attained for one or more mechanical components manufactured by injection molding with hard-steel tooling, which may be advantageous for manufacturing medical device consumables at high throughput.

In some embodiments, a method comprises over-molding a surface layer comprising an elastomer (e.g., silicone, thermoplastic elastomer) onto a seal plate comprising one or more through-holes (e.g., a hard plastic injection-molded part) to form a surface article comprising the surface layer and the seal plate. In some embodiments, a method comprises assembling a surface article with a base layer to form a cartridge, wherein assembling comprises, e.g., laser welding, sonic welding, adhering (e.g., using an adhesive), and/or another suitable attachment process for consumables. In certain embodiments, a method comprises aligning the one or more through-holes in the seal plate with corresponding one or more channels in the base layer.

In some embodiments, a method comprises die-cutting (e.g., as an alternative to over-molding) a surface layer comprising an elastomer from pre-made sheet stock, which may advantageously offer high precision in durometer and/or thickness. In some embodiments, a method comprises assembling a surface layer comprising an elastomer (e.g., a die-cut elastomeric layer) between a base layer (e.g., comprising and/or consisting essentially of hard plastic) and a seal plate (e.g., comprising and/or consisting essentially of hard plastic) to form a cartridge, using, e.g., laser welding, sonic welding, adhering, and/or another suitable attachment process for consumables. In certain embodiments, the base layer comprises one or more channels and the seal plate comprises one or more through-holes. In certain embodiments, a method comprises aligning the one or more through-holes in the seal plate with corresponding one or more channels in the base layer.

In certain embodiments, the surface layer functions as a peristaltic layer, a valve diaphragm, and a face-sealing gasket for the system.

In some embodiments, a method of making a cartridge comprises assembling a surface article comprising a surface layer with a base layer to form the cartridge. In certain embodiments, the surface layer comprises an elastomer. In certain embodiments, the base layer comprises one or more channels. In certain embodiments, at least some of the one or more channels have a substantially triangularly-shaped cross-section.

In some embodiments, assembling the surface article comprising the surface layer with the base layer to form the cartridge comprises laser welding, sonic welding, and/or adhering the surface layer to the base layer. For example, in some embodiments, a method comprises adhering the surface layer to the base layer using an adhesive.

In some embodiments, a method comprises die-cutting the surface layer comprising the elastomer from pre-made sheet stock. In some embodiments, the surface article consists essentially of the surface layer. In some embodiments, assembling the surface article comprising the surface layer with the base layer to form the cartridge comprises assembling the surface layer comprising the elastomer between the base layer and a seal plate to form the cartridge, wherein the seal plate comprises one or more through-holes. In some embodiments, assembling the surface layer comprising the elastomer between the base layer and the seal plate comprises laser welding, sonic welding, and/or adhering the surface layer to the base layer on one face of the surface layer and to the seal plate on the other face of the surface layer.

In some embodiments, a method comprises over-molding the surface layer comprising the elastomer onto a seal plate comprising one or more through-holes to form the surface article, wherein the surface article further comprises the seal plate.

In some embodiments, at least some of the one or more through-holes of a seal plate have a shape substantially similar to the shape of at least some of the one or more channels of the base layer. In some embodiments, a method comprises aligning one or more through-holes in the seal plate with corresponding one or more channels of the base layer. For example, in certain embodiments, aligning one or more through-holes with one or more channels results in one or more exposed regions of the surface layer, corresponding to one or more exposed regions of the surface layer above one or more associated channels in the base layer, such that a roller (e.g., a roller of an apparatus described herein) may deform an exposed portion of an exposed region of the surface layer to contact a portion of the walls and/or base of an associated channel in the base layer.

In some embodiments, a method comprises injection molding one or more mechanical components of a cartridge. For example, in certain embodiments, injection molding one or more mechanical components of the cartridge comprises injection molding to form the seal plate. In certain embodiments, injection molding one or more mechanical components of the cartridge comprises injection molding to form the base layer. Injection molding may comprise, for example, precision injection molding and/or injection molding with hard-steel tooling.

In some embodiments, methods of making a pump are provided. In certain embodiments, a method comprises assembling a surface article comprising a surface layer with a base layer to form a cartridge. In certain embodiments, the method comprises assembling an apparatus comprising a roller. In certain embodiments, a method comprises positioning the cartridge below the roller. In certain embodiments, the surface layer comprises an elastomer, the base layer comprises one or more channels, and/or at least some of the one or more channels have a substantially triangularly-shaped cross-section.

In certain embodiments, a method of making a pump comprises making an apparatus described herein by a method described herein, and/or making a cartridge described herein by a method described herein.

In some embodiments, a method comprises operating an apparatus described herein such that the apparatus engages with and/or disengages from a substrate surface (e.g., with a surface layer of a channel described herein). In some embodiments, a method comprises rotating a crank (e.g., a crank of an apparatus described herein) such that a roller engages with and/or disengages from a substrate surface (e.g., with a surface layer of a channel described herein). In some embodiments, a substrate surface is an outer surface of a surface layer (e.g., a surface layer comprising an elastomer) of a cartridge. FIG. 3B is a series of cross-sectional schematic diagrams of a peristaltic pump 300 along the length of a channel 102 in-plane with the base of channel 102, depicting a method 400 (e.g., a method of peristaltically pumping a fluid) progressing incrementally from the top diagram to the bottom diagram, in accordance with some embodiments. In some embodiments, engaging with a substrate surface comprises deforming (e.g., elastically deforming) a first portion of a surface layer (e.g., comprising an elastomer) into a channel containing a fluid, such that an inner surface of the first portion of the surface layer contacts a first portion of the walls and/or base of the channel proximal to the inner surface of the first portion of the surface layer. For example, the depicted method of FIG. 3B includes (top diagram to center diagram) elastically deforming (e.g., with a roller 220, e.g., with a roller comprising an elastomer) a first portion 116 of a surface layer 106 comprising an elastomer into channel 102 containing a fluid 112, such that an inner surface 113 of first portion 116 of surface layer 106 contacts a first portion 115 of walls and/or a base of channel 102 proximal to inner surface 113 of first portion 116 of surface layer 106, in accordance with certain embodiments. FIG. 3C is a cross-sectional schematic diagram of peristaltic pump 300 along the width of channel 102 in-plane with the base of channel 102, in accordance with some embodiments. The diagram is another view of the center diagram of FIG. 3B. First portion 116 of surface layer 106 comprising an elastomer has been deformed (e.g., elastically deformed) (e.g., with a roller 220, e.g., with a roller comprising an elastomer) into channel 102 containing fluid 112

(not shown in FIG. 3C), such that inner surface 113 of first portion 116 of surface layer 106 contacts first portion 115 of walls and/or a base of channel 102 proximal to inner surface 113 of first portion 116 of surface layer 106. In some embodiments, surface layer 106 is configured to seal off a surface opening of channel 102.

In some embodiments, disengaging with a substrate surface comprises removing a deformation (e.g., elastic deformation) from a first portion of a surface layer (e.g., a surface layer comprising an elastomer) in a channel containing a fluid, such that an inner surface of the first portion of the surface layer no longer contacts a first portion of the walls and/or base of the channel proximal to the inner surface of the first portion of the surface layer.

In some embodiments, a method comprises deforming (e.g., elastically deforming) a first portion of a surface layer described herein (e.g., a surface layer comprising an elastomer) into a channel containing a fluid, such that an inner surface of the first portion of the surface layer contacts a first portion of walls and/or a base of the channel proximal to the inner surface of the first portion of the surface layer. In certain embodiments, deforming a first portion of a surface layer comprises deforming the first portion of the surface layer with a roller. In certain embodiments, deforming a first portion of a surface layer comprises elastically deforming the first portion of the surface layer.

In some embodiments, a method comprises translating this deformation (e.g., elastic deformation) to a second portion of the surface layer such that an inner surface of the second portion of the surface layer contacts a second portion of the walls and/or base of the channel proximal to the inner surface of the second portion of the surface layer. For example, the depicted method of FIG. 3B includes (center diagram to bottom diagram) translating this elastic deformation to a second portion 118 of surface layer 106 such that an inner surface 117 of second portion 118 of surface layer 106 contacts a second portion 119 of the walls and/or base of channel 102 proximal to inner surface 117 of second portion 118 of surface layer 106, according to some embodiments. In some embodiments, translating the elastic deformation results in net flow of fluid 112 in a direction 121. In some embodiments, surface layer 106 is configured to seal off a surface opening of channel 102. In certain embodiments, translating a deformation to a second portion of a surface layer comprises rolling a roller along the surface layer such that an inner surface of the second portion of the surface layer contacts a second portion of the walls and/or base of a channel proximal to the inner surface of the second portion of the surface layer.

As used herein, the term "inner surface" regarding a surface layer is used to refer to a surface facing into a channel, whereas an "outer surface" of the surface layer faces an environment outside of the channel. For example, a microchannel may have an inner surface and an outer surface.

As used herein, the term "proximal," regarding the distance between an inner surface of a portion of a surface layer and a portion of the walls and/or base of a channel, refers to respective portions of inner surface and walls and/or base that are close to one another along the length of the channel. Proximal portions are generally close to one another, as opposed to, e.g., a portion of the inner surface at one end of the channel and a portion of the walls and/or base at the other end of the channel. For example, proximal portions may refer to respective portions of inner surface and walls and/or base that are close to one another along the length of a microchannel.

As used herein, the terms "first portion" and "second portion" may refer to portions that at least partially overlap or portions having no overlap. For example, a first portion and second portion may substantially overlap.

As used herein, the term "translating" will be known to those of ordinary skill in the art and refers to changing a location. For example, translating may refer to changing a location of a deformation (e.g., elastic deformation).

As used herein, the term "deformation" will be known to those of ordinary skill in the art and refers to a change in shape to an article in response to an applied force. For example, deformation may refer to a change in shape to a surface layer in response to an applied force.

As used herein, the term "elastic deformation" will be known to those of ordinary skill in the art and refers to a temporary change in shape to an article in response to an applied force that is spontaneously reversed upon removal of the applied force. For example, elastic deformation may refer to a temporary change in shape to a surface layer in response to an applied force that is spontaneously reversed upon removal of the applied force.

FIG. 4A is a flow diagram illustrating methods 500 of manufacturing an apparatus, device, or system, in accordance with some embodiments. As illustrated, at step 502, a crank arm, a rocker arm, and a roller are connected to a connecting arm. For example, as indicated at sub-step 503, the roller may be connected to the connecting arm using a roller arm. Sub-step 503 may include, for example, connecting the roller arm to the connecting arm by a hinge comprising a spring.

Before, during, or after step 502, at step 504, a shaft of the rocker arm is connected to a shaft of the crank arm such that the axis of rotation of the rocker shaft is held stationary relative to the axis of rotation of the crank shaft. For example, as indicated at sub-step 505, the shaft of the rocker arm may be connected to the shaft of the crank arm by connecting the shafts to a carriage.

Before, during, or after steps 502 and 504, at step 508, the shaft of the crank arm may be connected to a crank motor.

Before, during, or after steps 502, 504, and 508, at step 510, the carriage may be connected to the translator rod and the translator screw.

Before, during, or after steps 502, 504, 508, and 510, at step 512, the translator screw may be connected to a translator motor.

Optionally, before steps 502, 504, 508, 510, and 512, as illustrated at step 506, the crank arm, the rocker arm, the connecting arm, and/or the roller may be modified, machined, and/or injection molded. For example, as indicated at sub-step 507, the crank arm, the rocker arm, the connecting arm, the roller, the roller arm, the carriage, a translator rod, and/or a translator screw may be modified, machined, and/or injection molded. In certain embodiments, at sub-step 507, thermoplastic injection molding and/or precision injection molding of one or more mechanical components (e.g., at least some of those listed at sub-step 507) may be involved.

FIG. 4B is a flow diagram showing methods 550 of using an apparatus, device, or system, in accordance with some embodiments. Using an apparatus (e.g., an apparatus constructed using steps 502, 504, 508, 510, 512, and/or 506) may begin at step 514. At step 514, the crank is rotated such that the roller engages with an/or disengages from a substrate surface. For example, substrate a surface at step 514 may be an outer surface of a surface layer of a cartridge. At optional step 516 in the case where step 514 comprises engaging with the substrate surface—engaging with the substrate surface may comprise deforming a first portion of a surface layer comprising an elastomer into a channel containing a fluid, such that an inner surface of the first portion of the surface layer contacts a first portion of the walls and/or base of the channel proximal to the inner surface of the first portion of the surface layer. Deforming the first portion of the surface layer may comprise elastically deforming the first portion of the surface layer. The channel may be a microchannel. At optional step 518, the crank may be further rotated to disengage with the substrate surface. Disengaging from the substrate surface may comprise removing a deformation from a first portion of a surface layer comprising an elastomer in a channel containing a fluid, such that an inner surface of the first portion of the surface layer no longer contacts a first portion of the walls and/or base of the channel proximal to the inner surface of the first portion of the surface layer. Deformation of the first portion of the surface layer may be an elastic deformation of the first portion of the surface layer.

FIG. 4C is a flow diagram illustrating methods 600 of manufacturing a cartridge, device, or system, in accordance with some embodiments. As illustrated, at step 602, a surface article comprising a surface layer is assembled with a base layer to form a cartridge, wherein the surface layer comprises an elastomer, the base layer comprises one or more channels, and at least some of the one or more channels have a substantially triangularly-shaped cross-section. For example, as indicated at sub-step 603, assembly may include laser welding, sonic welding, and/or adhering the surface layer to the base layer on one face of the surface layer and/or laser welding, sonic welding, and/or adhering the surface layer to a seal plate on the other face of the surface layer. Sub-step 603 may include adhering, using an adhesive, the surface layer to the base layer on one face of the surface layer and/or the surface layer to a seal plate on the other face of the surface layer. As indicated at sub-step 605, assembly may include assembling the surface layer comprising the elastomer between the base layer and the seal plate to form the cartridge.

In certain embodiments, the seal plate comprises one or more through-holes. As illustrated, before step 602, at step 608, one or more through-holes in the seal plate may be aligned with corresponding one or more channels of the base layer.

Before step 602, and optionally before step 608, at step 604, the surface layer comprising the elastomer may be die-cut from pre-made sheet stock. Alternatively, before step 602, and optionally before step 608, at step 606, the surface layer comprising the elastomer may be over-molded onto the seal plate comprising one or more through-holes to form the surface article, wherein the surface article further comprises the seal plate.

Before step 602, optionally before step 608, and further optionally before step 606, at step 610 one or more mechanical components of the cartridge may be injection molded. Injection molding at step 610 may involve precision injection molding and/or injection molding with hard steel tooling. Non-limiting examples of mechanical components that may be injection molded at step 610 can include the seal plate on the base layer.

FIG. 4D is a flow diagram showing methods 650 of using a cartridge, device, or system, in accordance with some embodiments. Using a cartridge (e.g., a cartridge constructed using steps 602, 604, 606, 608, and/or 610) may begin at step 612. At step 612, a first portion of a surface layer comprising an elastomer is deformed into a channel containing a fluid, such that an inner surface of the first portion of the surface layer contacts a first portion of walls and/or a base of the channel proximal to the inner surface of the first portion of the surface layer. Then, at step 614, this deformation is translated to a second portion of the surface layer such that an inner surface of the second portion of the surface layer contacts a second portion of the walls and/or base of the channel proximal to the inner surface of the second portion of the surface layer; wherein the surface layer is generally configured to seal off a surface opening of the channel. The channel may be a microchannel. Deforming the first portion of the surface layer may comprise elastically deforming the first portion of the surface layer. Deforming the first portion of the surface layer may comprise deforming the first portion of the surface layer with a roller. Translating the deformation to a second portion of the surface layer may comprise rolling the roller along the surface layer such that the inner surface of the second portion of the surface layer contacts the second portion of the walls and/or base of the channel proximal to the inner surface of the second portion of the surface layer.

Exemplary Embodiments Involving Sample Preparation and Downstream Analysis

As mentioned above, certain aspects of the present disclosure relate to systems and devices (e.g., pumps, apparatuses, cartridges) related to the pumping of fluids (e.g., for the preparation of samples). Aspects of the present disclosure further provide methods, compositions, systems, and devices for use in a process to prepare a sample for analysis and/or analyze (e.g., analyze by sequencing) one or more target molecules in a sample. The pumps and related devices (e.g., apparatuses, cartridges) may be used as part of some such sample preparation processes. For example, the pumps and related devices (e.g., apparatuses, cartridges) may be included in a sample preparation module in which the sample preparation process is performed. In some embodiments, the pump and related devices (e.g., apparatuses, cartridges) configured to perform steps upstream or downstream of the sample preparation processes. In some embodiments, a target molecule is a nucleic acid (e.g., DNA or RNA, including without limitation, cDNA, genomic DNA, mRNA, and derivatives and fragments thereof). In some embodiments, a target molecule is a protein or a polypeptide.

Sample Preparation Process

In some embodiments, a sample may be a purified sample, a cell lysate, a single-cell, a population of cells, or a tissue. In some embodiments, a process described herein may be used to identify properties or characteristics of a sample, including the identity or sequence (e.g., nucleotide sequence or amino acid sequence) of one or more target molecules in the sample. In some embodiments, a process may include one or more sample transformation steps, such as sample lysis, sample purification, sample fragmentation, purification of a fragmented sample, library preparation (e.g., nucleic acid library preparation), purification of a library preparation, sample enrichment (e.g., using affinity SCODA), and/or detection/analysis of a target molecule.

In some embodiments, a sample (e.g., a sample comprising cells or tissue), may be lysed or otherwise digested in a process in accordance with the instant disclosure. In some embodiments, a sample comprising cells or tissue is lysed using any one of known physical or chemical methodologies to release a target molecule (e.g., a target nucleic acid or a target protein) from said cells or tissues. In some embodiments, a sample may be lysed using an electrolytic method, an enzymatic method, a detergent-based method, and/or mechanical homogenization. In some embodiments, a sample (e.g., complex tissues, gram positive or gram negative bacteria) may require multiple lysis methods performed in series. In some embodiments, if a sample does not comprise cells or tissue (e.g., a sample comprising purified nucleic acids), a lysis step may be omitted.

In some embodiments, a sample (e.g., nucleic acid or protein) may be purified, e.g., following lysis, in a process in accordance with the instant disclosure. In some embodiments, a sample may be purified using chromatography (e.g., affinity chromatography that selectively binds the sample) or electrophoresis. In some embodiments, a sample may be purified in the presence of precipitating agents. In some embodiments, after a purification step or method, a sample may be washed and/or released from a purification matrix (e.g., affinity chromatography matrix) using an elution buffer. In some embodiments, a purification step or method may comprise the use of a reversibly switchable polymer, such as an electroactive polymer. In some embodiments, a sample may be purified by electrophoretic passage of a sample through a porous matrix (e.g., cellulose acetate, agarose, acrylamide).

In some embodiments, a sample (e.g., nucleic acid or protein) may be fragmented in a process in accordance with the instant disclosure. In some embodiments, a nucleic acid sample may be fragmented to produce small (<1 kilobase) fragments for sequence specific identification to large (up to 10+ kilobases) fragments for long read sequencing applications. Fragmentation of nucleic acids may, in some embodiments, be accomplished using mechanical (e.g., fluidic shearing), chemical (e.g., Fe cleavage) and/or enzymatic (e.g., restriction enzymes, tagmentation using transposases) methods. In some embodiments, a protein sample may be fragmented to produce peptide fragments of any length. Fragmentation of proteins may, in some embodiments, be accomplished using chemical and/or enzymatic (e.g., proteolytic enzymes such as trypsin) methods. In some embodiments, mean fragment length may be controlled by reaction time, temperature, and concentration of sample and/or enzymes (e.g., restriction enzymes, transposases). In some embodiments, a nucleic acid may be fragmented by tagmentation such that the nucleic acid is simultaneously fragmented and labeled with a fluorescent molecule (e.g., a fluorophore). In some embodiments, a fragmented sample may be subjected to a round of purification (e.g., chromatography or electrophoresis) to remove small and/or undesired fragments as well as residual payload, chemicals and/or enzymes used during the fragmentation step.

In some embodiments, a nucleic acid sample may be used to generate a nucleic acid library for subsequent analysis (e.g., genomic sequencing) in a process in accordance with the instant disclosure. A nucleic acid library may be a linear library or a circular library. In some embodiments, nucleic acids of a circular library may comprise elements that allow for downstream linearization (e.g., endonuclease restriction sites, incorporation of uracil). In some embodiments, a nucleic acid library may be purified (e.g., using chromatography, e.g., affinity chromatography), or electrophoresis.

In some embodiments, a sample (e.g., nucleic acid or protein) may be enriched for a target molecule in a process in accordance with the instant disclosure. In some embodiments, a sample is enriched for a target molecule using an electrophoretic method. In some embodiments, a sample is enriched for a target molecule using affinity SCODA. In some embodiments, a sample is enriched for a target molecule using field inversion gel electrophoresis (FIGE). In some embodiments, a sample is enriched for a target molecule using pulsed field gel electrophoresis (PFGE). In some embodiments, the matrix used during enrichment (e.g., a porous media, electrophoretic polymer gel) comprises immobilized capture probes that bind to target molecule present in the sample. In some embodiments, a matrix used during enrichment comprises 1, 2, 3, 4, 5, or more unique immobilized capture probes, each of which binds to a unique target molecule and/or bind to the same target molecule with different binding affinities. In some instances, such gel-based enrichment methods can be performed using one or more gels connected to or located in the cartridges described herein.

In some embodiments, an immobilized capture probe is an oligonucleotide capture probe that hybridizes to a target nucleic acid. In some embodiments, an oligonucleotide capture probe is at least 50%, 60%, 70%, 80%, 90% 95%, or 100% complementary to a target nucleic acid. In some embodiments, a single oligonucleotide capture probe may be used to enrich a plurality of related target nucleic acids (e.g., 2, 3, 4, 5, 6, 7, 8, 9, 10, 20, 30, 40, 50, or more related target nucleic acids) that share at least 50%, 60%, 70%, 80%, 90% 95%, or 99% sequence identity. Enrichment of a plurality of related target nucleic acids may allow for the generation of a metagenomic library. In some embodiments, an oligonucleotide capture probe may enable differential enrichment of related target nucleic acids. In some embodiments, an oligonucleotide capture probe may enable enrichment of a target nucleic acid relative to a nucleic acid of identical sequence that differs in its modification state (e.g., methylation state, acetylation state).

In some embodiments, for the purposes of enriching nucleic acid target molecules with a length of 0.5-2 kilobases, oligonucleotide capture probes may be covalently immobilized in an acrylamide matrix using a 5' Acrydite moiety. In some embodiments, for the purposes of enriching larger nucleic acid target molecules (e.g., with a length of >2 kilobases), oligonucleotide capture probes may be immobilized in an agarose matrix. In some embodiments, oligonucleotide capture probes may be immobilized in an agarose matrix using thiol-epoxide chemistries (e.g., by covalently attached thiol-modified oligonucleotides to crosslinked agarose beads). Oligonucleotide capture probes linked to agarose beads can be combined and solidified within standard agarose matrices (e.g., at the same agarose percentage).

In some embodiments, an immobilized capture probe is a protein capture probe (e.g., an aptamer or an antibody) that binds to a target protein or peptide fragment. In some embodiments, a protein capture probe binds to a target protein or peptide fragment with a binding affinity of $10^{-9}$ to $10^{-8}$ M, $10^{-8}$ to $10^{-7}$ M, $10^{-7}$ to $10^{-6}$ M, $10^{-6}$ to $10^{-5}$ M, $10^{-5}$ to $10^{4}$ M, $10^{-4}$ to $10^{-3}$ M, or $10^{-3}$ to $10^{-2}$ M. In some embodiments, the binding affinity is in the picomolar to nanomolar range (e.g., between about $10^{-12}$ and about $10^{-9}$ M). In some embodiments, the binding affinity is in the nanomolar to micromolar range (e.g., between about $10^{-9}$ and about $10^{-6}$ M). In some embodiments, the binding affinity is in the micromolar to millimolar range (e.g., between about $10^{-6}$ and about $10^{-3}$ M). In some embodiments, the binding affinity is in the picomolar to micromolar range (e.g., between about $10^{-12}$ and about $10^{-6}$ M). In some embodiments, the binding affinity is in the nanomolar to millimolar range (e.g., between about $10^{-9}$ and about $10^{-3}$ M). In some embodiments, a single protein capture probe may be used to enrich a plurality of related target proteins that share at least 50%, 60%, 70%, 80%, 90% 95%, or 99% sequence identity. In some embodiments, a single protein capture probe may be used to enrich a plurality of related target proteins (e.g., 2, 3, 4, 5, 6, 7, 8, 9, 10, 20, 30, 40, 50, or more related target proteins) that share at least 50%, 60%, 70%, 80%, 90% 95%, or 99% sequence homology. Enrichment of a plurality of related target proteins may allow for the generation of a metaproteomics library. In some embodiments, a protein capture probe may enable differential enrichment of related target proteins.

In some embodiments, multiple capture probes (e.g., populations of multiple capture probe types, e.g., that bind to deterministic target molecules of infectious agents such as adenovirus, staphylococcus, pneumonia, or tuberculosis) may be immobilized in an enrichment matrix. Application of a sample to an enrichment matrix with multiple deterministic capture probes may result in diagnosis of a disease or condition (e.g., presence of an infectious agent).

In some embodiments, a target molecule or related target molecules may be released from the enrichment matrix after removal of non-target molecules, in a process in accordance with the instant disclosure. In some embodiments, a target molecule may be released from the enrichment matrix by increasing the temperature of the enrichment matrix. Adjusting the temperature of the matrix further influences migration rate as increased temperatures provide a higher capture probe stringency, requiring greater binding affinities between the target molecule and the capture probe. In some embodiments, when enriching related target molecules, the matrix temperature may be gradually increased in a stepwise manner in order to release and isolate target molecules in steps of ever-increasing homology. This may allow for the sequencing of target proteins or target nucleic acids that are increasingly distant in their relation to an initial reference target molecule, enabling discovery of novel proteins (e.g., enzymes) or functions (e.g., enzymatic function or gene function). In some embodiments, when using multiple capture probes (e.g., multiple deterministic capture probes), the matrix temperature may be increased in a step-wise or gradient fashion, permitting temperature-dependent release of different target molecules and resulting in generation of a series of barcoded release bands that represent the presence or absence of control and target molecules.

In some embodiments, a target molecule or target molecules may be finally detected after enrichment and subsequent release to enable analysis of said target molecule(s) and its upstream sample, in a process in accordance with the instant disclosure. In some embodiments, a target nucleic acid may be detected using gene sequencing, absorbance, fluorescence, electrical conductivity, capacitance, surface plasmon resonance, hybrid capture, antibodies, direct labeling of the nucleic acid (e.g., end-labeling, labeled tagmentation payloads), non-specific labeling with intercalating dyes (e.g., ethidium bromide, SYBR dyes), or any other known methodology for nucleic acid detection. In some embodiments, a target protein or peptide fragment may be detected using absorbance, fluorescence, mass spectroscopy, amino acid sequencing, or any other known methodology for protein or peptide detection.

Sample Preparation Modules and Devices

Modules or devices including apparatuses, cartridges (e.g., comprising channels (e.g., microfluidic channels)), and/or pumps (e.g., peristaltic pumps such as those described in the present disclosure) for use in a process of preparing a sample for analysis are generally provided. Modules or devices can be used in accordance with the instant disclosure to enable capture, concentration, manipulation, and/or detection of a target molecule from a biological sample. In some embodiments, devices and related methods are provided for automated processing of a sample to produce material for next generation sequencing and/or other downstream analytical techniques. Modules, devices and related methods may be used for performing chemical and/or biological reactions, including reactions for nucleic acid and/or protein processing in accordance with sample preparation or sample analysis processes described elsewhere herein.

In some embodiments, a sample preparation module or device (e.g., sample preparation module 1700) is positioned to deliver or transfer to a sequencing module or device a target molecule or sample comprising a plurality of molecules (e.g., a target nucleic acid or a target protein). In some embodiments, a sample preparation module or device is connected directly to (e.g., physically attached to) or indirectly to a sequencing device. As mentioned above, in some embodiments such connections may be permanent, while in some embodiments such connections may be reversible (decoupleable).

In some embodiments, a module or device is configured to receive one or more cartridges. In some embodiments, a cartridge comprises one or more reservoirs or reaction vessels configured to receive a fluid and/or contain one or more reagents used in a sample preparation process. In some embodiments, a cartridge comprises one or more channels (e.g., microfluidic channels) configured to contain and/or transport a fluid (e.g., a fluid comprising one or more reagents) used in a sample preparation process. Reagents include buffers, enzymatic reagents, polymer matrices, capture reagents, size-specific selection reagents, sequence-specific selection reagents, and/or purification reagents. Additional reagents for use in a sample preparation process are described elsewhere herein. For example, any of the reagents (or combinations thereof) described above for sample preparation steps (e.g., for nucleic acid or peptide or protein analysis, sequencing, or identification) may be used and/or present in the cartridge (e.g., a channel, reservoir, and/or reaction vessel of the cartridge).

In some embodiments, a cartridge includes one or more stored reagents (e.g., of a liquid or lyophilized form suitable for reconstitution to a liquid form). The stored reagents of a cartridge include reagents suitable for carrying out a desired process and/or reagents suitable for processing a desired sample type. In some embodiments, a cartridge is a single-use cartridge (e.g., a disposable cartridge) or a multiple-use cartridge (e.g., a reusable cartridge). In some embodiments, a cartridge is configured to receive a user-supplied sample. The user-supplied sample may be added to the cartridge before or after the cartridge is received by the device, e.g., manually by the user or in an automated process.

Devices and modules in accordance with the instant disclosure generally contain mechanical and electronic and/or optical components which can be used to operate a cartridge as described herein. In some embodiments, the device or module components operate to achieve and maintain specific temperatures on a cartridge or on specific regions of the cartridge. In some embodiments, the device components operate to apply specific voltages for specific time durations to electrodes of a cartridge. In some embodiments, the device or module components operate to move liquids to, from, or between reservoirs and/or reaction vessels of a cartridge. In some embodiments, the device or module components operate to move liquids through channel(s) of a cartridge, e.g., to, from, or between reservoirs and/or reaction vessels of a cartridge. As mentioned above, in some embodiments, the device or module components move liquids via a peristaltic pumping mechanism (e.g., apparatus) that interacts with an elastomeric, reagent-specific reservoir or reaction vessel of a cartridge. In some embodiments, the device or module components move liquids via a peristaltic pumping mechanism (e.g., apparatus) that is configured to interact with an elastomeric component (e.g., surface layer comprising an elastomer) associated with a channel of a cartridge to pump fluid through the channel. Device or module components can include computer resources, for example, to drive a user interface where sample information can be entered, specific processes can be selected, and run results can be reported.

The following non-limiting example is meant to illustrate aspects of the devices, methods, and compositions described herein. The use of a sample preparation module or device in accordance with the instant disclosure may proceed with one or more of the following described steps. A user may open the lid of the device and insert a cartridge that supports the desired process. The user may then add a sample, which may be combined with a specific lysis solution, to a sample port on the cartridge. The user may then close the device lid, enter any sample specific information via a touch screen interface on the device, select any process specific parameters (e.g., range of desired size selection, desired degree of homology for target molecule capture, etc.), and initiate the sample preparation process run.

Following the run, the user may receive relevant run data (e.g., confirmation of successful completion of the run, run specific metrics, etc.), as well as process specific information (e.g., amount of sample generated, presence or absence of specific target sequence, etc.). Data generated by the run may be subjected to subsequent bioinformatics analysis, which can be either local or cloud based. Depending on the process, a finished sample may be extracted from the cartridge for subsequent use (e.g., genomic sequencing, qPCR quantification, cloning, etc.). Subsequent use may include, for example, peptide or protein sequencing. The device may then be opened, and the cartridge may then be removed.

Genome Sequencing Process

Some aspects of the instant disclosure further involve sequencing nucleic acids (e.g., deoxyribonucleic acids or ribonucleic acid). In some aspects, compositions, devices, systems, and techniques described herein can be used to identify a series of nucleotides incorporated into a nucleic acid (e.g., by detecting a time-course of incorporation of a series of labeled nucleotides). In some embodiments, compositions, devices, systems, and techniques described herein can be used to identify a series of nucleotides that are incorporated into a template-dependent nucleic acid sequencing reaction product synthesized by a polymerizing enzyme (e.g., RNA polymerase).

Accordingly, also provided herein are methods of determining the sequence of a target nucleic acid. In some embodiments, the target nucleic acid is enriched (e.g., enriched using electrophoretic methods, e.g., affinity SCODA) prior to determining the sequence of the target nucleic acid. In some embodiments, provided herein are methods of determining the sequences of a plurality of nucleic acids (e.g., at least 2, 3, 4, 5, 10, 15, 20, 30, 50, or more) present in a sample (e.g., a purified sample, a cell lysate, a single-cell, a population of cells, or a tissue). In some embodiments, a sample is prepared as described herein (e.g., lysed, purified, fragmented, and/or enriched for a target nucleic acid) prior to determining the sequence of a target nucleic acid or a plurality of nucleic acids present in a sample. In some embodiments, a target nucleic acid is an enriched target nucleic acid (e.g., enriched using electrophoretic methods, e.g., affinity SCODA).

In some embodiments, methods of sequencing comprise steps of: (i) exposing a complex in a target volume to one or more labeled nucleotides, the complex comprising a target nucleic acid or a plurality of nucleic acids present in a sample, at least one primer, and a polymerizing enzyme; (ii) directing one or more excitation energies, or a series of pulses of one or more excitation energies, towards a vicinity of the target volume; (iii) detecting a plurality of emitted photons from the one or more labeled nucleotides during sequential incorporation into a nucleic acid comprising one of the at least one primers; and (iv) identifying the sequence of incorporated nucleotides by determining one or more characteristics of the emitted photons.

In another aspect, the instant disclosure provides methods of sequencing target nucleic acids or a plurality of nucleic acids present in a sample by sequencing a plurality of nucleic acid fragments, wherein the target nucleic acid comprises the fragments. In certain embodiments, the method comprises combining a plurality of fragment sequences to provide a sequence or partial sequence for the parent nucleic acid (e.g., parent target nucleic acid). In some embodiments, the step of combining is performed by computer hardware and software. The methods described herein may allow for a set of related nucleic acids (e.g., two or more nucleic acids present in a sample), such as an entire chromosome or genome to be sequenced.

In some embodiments, a primer is a sequencing primer. In some embodiments, a sequencing primer can be annealed to a nucleic acid (e.g., a target nucleic acid) that may or may not be immobilized to a solid support. A solid support can comprise, for example, a sample well (e.g., a nanoaperture, a reaction chamber) on a chip or cartridge used for nucleic acid sequencing. In some embodiments, a sequencing primer may be immobilized to a solid support and hybridization of the nucleic acid (e.g., the target nucleic acid) further immobilizes the nucleic acid molecule to the solid support. In some embodiments, a polymerase (e.g., RNA Polymerase) is immobilized to a solid support and soluble sequencing primer and nucleic acid are contacted to the polymerase. In some embodiments a complex comprising a polymerase, a nucleic acid (e.g., a target nucleic acid) and a primer is formed in solution and the complex is immobilized to a solid support (e.g., via immobilization of the polymerase, primer, and/or target nucleic acid). In some embodiments, none of the components are immobilized to a solid support. For example, in some embodiments, a complex comprising a polymerase, a target nucleic acid, and a sequencing primer is formed in situ and the complex is not immobilized to a solid support.

In some embodiments, sequencing by synthesis methods can include the presence of a population of target nucleic acid molecules (e.g., copies of a target nucleic acid) and/or a step of amplification (e.g., polymerase chain reaction (PCR)) of a target nucleic acid to achieve a population of target nucleic acids. However, in some embodiments, sequencing by synthesis is used to determine the sequence of a single nucleic acid molecule in any one reaction that is being evaluated and nucleic acid amplification may not be required to prepare the target nucleic acid. In some embodiments, a plurality of single molecule sequencing reactions are performed in parallel (e.g., on a single chip or cartridge) according to aspects of the instant disclosure. For example, in some embodiments, a plurality of single molecule sequencing reactions are each performed in separate sample wells (e.g., nanoapertures, reaction chambers) on a single chip or cartridge.

Protein Sequencing Process

Aspects of the instant disclosure also involve methods of protein sequencing and identification, methods of polypeptide sequencing and identification, methods of amino acid identification, and compositions, systems, and devices for performing such methods. Such protein sequencing and identification is performed, in some embodiments, with the same instrument that performs sample preparation and/or genome sequencing, described in more detail herein. In some aspects, methods of determining the sequence of a target protein are described. In some embodiments, the target protein is enriched (e.g., enriched using electrophoretic methods, e.g., affinity SCODA) prior to determining the sequence of the target protein. In some aspects, methods of determining the sequences of a plurality of proteins (e.g., at least 2, 3, 4, 5, 10, 15, 20, 30, 50, or more) present in a sample (e.g., a purified sample, a cell lysate, a single-cell, a population of cells, or a tissue) are described. In some embodiments, a sample is prepared as described herein (e.g., lysed, purified, fragmented, and/or enriched for a target protein) prior to determining the sequence of a target protein or a plurality of proteins present in a sample. In some embodiments, a target protein is an enriched target protein (e.g., enriched using electrophoretic methods, e.g., affinity SCODA)

In some embodiments, the instant disclosure provides methods of sequencing and/or identifying an individual protein in a sample comprising a plurality of proteins by identifying one or more types of amino acids of a protein from the mixture. In some embodiments, one or more amino acids (e.g., terminal amino acids or internal amino acids) of the protein are labeled (e.g., directly or indirectly, for example using a binding agent) and the relative positions of the labeled amino acids in the protein are determined. In some embodiments, the relative positions of amino acids in a protein are determined using a series of amino acid labeling and cleavage steps. In some embodiments, the relative position of labeled amino acids in a protein can be determined without removing amino acids from the protein but by translocating a labeled protein through a pore (e.g., a protein channel) and detecting a signal (e.g., a Förster resonance energy transfer (FRET) signal) from the labeled amino acid(s) during translocation through the pore in order to determine the relative position of the labeled amino acids in the protein molecule.

In some embodiments, the identity of a terminal amino acid (e.g., an N-terminal or a C-terminal amino acid) is determined prior to the terminal amino acid being removed and the identity of the next amino acid at the terminal end being assessed; this process may be repeated until a plurality of successive amino acids in the protein are assessed. In some embodiments, assessing the identity of an amino acid comprises determining the type of amino acid that is present. In some embodiments, determining the type of amino acid comprises determining the actual amino acid identity (e.g., determining which of the naturally-occurring 20 amino acids an amino acid is, e.g., using a binding agent that is specific for an individual terminal amino acid). However, in some embodiments, assessing the identity of a terminal amino acid type can comprise determining a subset of potential amino acids that can be present at the terminus of the protein. In some embodiments, this can be accomplished by determining that an amino acid is not one or more specific amino acids (i.e., and therefore could be any of the other amino acids). In some embodiments, this can be accomplished by determining which of a specified subset of amino acids (e.g., based on size, charge, hydrophobicity, binding properties) could be at the terminus of the protein (e.g., using a binding agent that binds to a specified subset of two or more terminal amino acids).

In some embodiments, a protein or polypeptide can be digested into a plurality of smaller proteins or polypeptides and sequence information can be obtained from one or more of these smaller proteins or polypeptides (e.g., using a method that involves sequentially assessing a terminal amino acid of a protein and removing that amino acid to expose the next amino acid at the terminus).

In some embodiments, a protein is sequenced from its amino (N) terminus. In some embodiments, a protein is sequenced from its carboxy (C) terminus. In some embodiments, a first terminus (e.g., N or C terminus) of a protein is immobilized and the other terminus (e.g., the C or N terminus) is sequenced as described herein.

As used herein, sequencing a protein refers to determining sequence information for a protein. In some embodiments, this can involve determining the identity of each sequential amino acid for a portion (or all) of the protein. In some embodiments, this can involve determining the identity of a fragment (e.g., a fragment of a target protein or a fragment of a sample comprising a plurality of proteins). In some embodiments, this can involve assessing the identity of a subset of amino acids within the protein (e.g., and determining the relative position of one or more amino acid types without determining the identity of each amino acid in the protein). In some embodiments amino acid content information can be obtained from a protein without directly determining the relative position of different types of amino acids in the protein. The amino acid content alone may be used to infer the identity of the protein that is present (e.g., by comparing the amino acid content to a database of protein information and determining which protein(s) have the same amino acid content).

In some embodiments, sequence information for a plurality of protein fragments obtained from a target protein or sample comprising a plurality of proteins (e.g., via enzymatic and/or chemical cleavage) can be analyzed to reconstruct or infer the sequence of the target protein or plurality of proteins present in the sample. Accordingly, in some embodiments, the one or more types of amino acids are identified by detecting luminescence of one or more labeled affinity reagents that selectively bind the one or more types of amino acids. In some embodiments, the one or more types of amino acids are identified by detecting luminescence of a labeled protein.

In some embodiments, the instant disclosure provides compositions, devices, and methods for sequencing a protein by identifying a series of amino acids that are present at a terminus of a protein over time (e.g., by iterative detection and cleavage of amino acids at the terminus). In yet other embodiments, the instant disclosure provides compositions, devices, and methods for sequencing a protein by identifying labeled amino content of the protein and comparing to a reference sequence database.

In some embodiments, the instant disclosure provides compositions, devices, and methods for sequencing a protein by sequencing a plurality of fragments of the protein. In some embodiments, sequencing a protein comprises combining sequence information for a plurality of protein fragments to identify and/or determine a sequence for the protein. In some embodiments, combining sequence information may be performed by computer hardware and software. The methods described herein may allow for a set of related proteins, such as an entire proteome of an organism, to be sequenced. In some embodiments, a plurality of single molecule sequencing reactions are performed in parallel (e.g., on a single chip or cartridge) according to aspects of the instant disclosure. For example, in some embodiments, a plurality of single molecule sequencing reactions are each performed in separate sample wells on a single chip or cartridge.

In some embodiments, methods provided herein may be used for the sequencing and identification of an individual protein in a sample comprising a plurality of proteins. In some embodiments, the instant disclosure provides methods of uniquely identifying an individual protein in a sample comprising a plurality of proteins. In some embodiments, an individual protein is detected in a mixed sample by determining a partial amino acid sequence of the protein. In some embodiments, the partial amino acid sequence of the protein is within a contiguous stretch of approximately 5-50, 10-50, 25-50, 25-100, or 50-100 amino acids.

Without wishing to be bound by any particular theory, it is expected that most human proteins can be identified using incomplete sequence information with reference to proteomic databases. For example, simple modeling of the human proteome has shown that approximately 98% of proteins can be uniquely identified by detecting just four types of amino acids within a stretch of 6 to 40 amino acids (see, e.g., Swaminathan, et al. *PLoS Comput Biol.* 2015, 11(2):e1004080; and Yao, et al. *Phys. Biol.* 2015, 12(5): 055003). Therefore, a sample comprising a plurality of proteins can be fragmented (e.g., chemically degraded, enzymatically degraded) into short protein fragments of approximately 6 to 40 amino acids, and sequencing of this protein-based library would reveal the identity and abundance of each of the proteins present in the original sample. Compositions and methods for selective amino acid labeling and identifying polypeptides by determining partial sequence information are described in in detail in U.S. patent application Ser. No. 15/510,962, filed Sep. 15, 2015, entitled "SINGLE MOLECULE PEPTIDE SEQUENCING," which is incorporated herein by reference in its entirety.

Sequencing in accordance with the instant disclosure, in some aspects, may involve immobilizing a protein (e.g., a target protein) on a surface of a substrate (e.g., of a solid support, for example a chip or cartridge, for example in a sequencing device as described herein). In some embodiments, a protein may be immobilized on a surface of a sample well (e.g., on a bottom surface of a sample well) on a substrate. In some embodiments, the N-terminal amino acid of the protein is immobilized (e.g., attached to the surface). In some embodiments, the C-terminal amino acid of the protein is immobilized (e.g., attached to the surface). In some embodiments, one or more non-terminal amino acids are immobilized (e.g., attached to the surface). The immobilized amino acid(s) can be attached using any suitable covalent or non-covalent linkage, for example as described in this disclosure. In some embodiments, a plurality of proteins are attached to a plurality of sample wells (e.g., with one protein attached to a surface, for example a bottom surface, of each sample well), for example in an array of sample wells on a substrate.

Sequencing Module Device

Sequencing of nucleic acids or proteins in accordance with the instant disclosure, in some aspects, may be performed using a system that permits single molecule analysis. The system may include a sequencing module or device and an instrument configured to interface with the sequencing device. As mentioned above, in some embodiments, detection module 1800 comprises such a sequencing module or device. The sequencing module or device may include an array of pixels, where individual pixels include a sample well and at least one photodetector. The sample wells of the sequencing device may be formed on or through a surface of the sequencing device and be configured to receive a sample placed on the surface of the sequencing device. In some embodiments, the sample wells are a component of a cartridge (e.g., a disposable or single-use cartridge) that can be inserted into the device. Collectively, the sample wells may be considered as an array of sample wells. The plurality of sample wells may have a suitable size and shape such that at least a portion of the sample wells receive a single target molecule or sample comprising a plurality of molecules (e.g., a target nucleic acid or a target protein). In some embodiments, the number of molecules within a sample well may be distributed among the sample wells of the sequencing device such that some sample wells contain one molecule (e.g., a target nucleic acid or a target protein) while others contain zero, two, or a plurality of molecules.

In some embodiments, a sequencing module or device is positioned to receive a target molecule or sample comprising a plurality of molecules (e.g., a target nucleic acid or a target protein) from a sample preparation device. In some embodiments, a sequencing device is connected directly (e.g., physically attached to) or indirectly to a sample preparation device. However, connection between the sample preparation device and the sequencing device or module (or any other type of detection module) is not necessary for all embodiments. In some embodiments, a target molecule or sample comprising the plurality of molecules (e.g., target nucleic acid, target protein) is manually transported from the sample preparation device (e.g., sample preparation module) to the sequencing module or device either directly (e.g., without any intervening steps that change the composition of the target molecule or sample) or indirectly (e.g., involving one or more further processing steps that may change the composition of the target molecule or sample). Manual transportation may involve, for example, transport via manual pipetting or suitable manual techniques known in the art.

Excitation light is provided to the sequencing device from one or more light sources external to the sequencing device. Optical components of the sequencing device may receive the excitation light from the light source and direct the light towards the array of sample wells of the sequencing device and illuminate an illumination region within the sample well. In some embodiments, a sample well may have a configuration that allows for the target molecule or sample comprising a plurality of molecules to be retained in proximity to a surface of the sample well, which may ease delivery of excitation light to the sample well and detection of emission light from the target molecule or sample comprising a plurality of molecules. A target molecule or sample comprising a plurality of molecules positioned within the illumination region may emit emission light in response to being illuminated by the excitation light. For example, a nucleic acid or protein (or pluralities thereof) may be labeled with a fluorescent marker, which emits light in response to achieving an excited state through the illumination of excitation light. Emission light emitted by a target molecule or sample comprising a plurality of molecules may then be detected by one or more photodetectors within a pixel corresponding to the sample well with the target molecule or sample comprising a plurality of molecules being analyzed. When performed across the array of sample wells, which may range in number between approximately 10,000 pixels to 1,000,000 pixels according to some embodiments, multiple sample wells can be analyzed in parallel.

The sequencing module or device may include an optical system for receiving excitation light and directing the excitation light among the sample well array. The optical system may include one or more grating couplers configured to couple excitation light to the sequencing device and direct the excitation light to other optical components. The optical system may include optical components that direct the excitation light from a grating coupler towards the sample well array. Such optical components may include optical splitters, optical combiners, and waveguides. In some embodiments, one or more optical splitters may couple excitation light from a grating coupler and deliver excitation light to at least one of the waveguides. According to some embodiments, the optical splitter may have a configuration that allows for delivery of excitation light to be substantially uniform across all the waveguides such that each of the waveguides receives a substantially similar amount of excitation light. Such embodiments may improve performance of the sequencing device by improving the uniformity of excitation light received by sample wells of the sequencing device. Examples of suitable components, e.g., for coupling excitation light to a sample well and/or directing emission light to a photodetector, to include in a sequencing device are described in U.S. patent application Ser. No. 14/821,688, filed Aug. 7, 2015, titled "INTEGRATED DEVICE FOR PROBING, DETECTING AND ANALYZING MOLECULES," and U.S. patent application Ser. No. 14/543,865, filed Nov. 17, 2014, titled "INTEGRATED DEVICE WITH EXTERNAL LIGHT SOURCE FOR PROBING, DETECTING, AND ANALYZING MOLECULES," both of which are incorporated herein by reference in their entirety. Examples of suitable grating couplers and waveguides that may be implemented in the sequencing device are described in U.S. patent application Ser. No. 15/844,403, filed Dec. 15, 2017, titled "OPTICAL COUPLER AND WAVEGUIDE SYSTEM," which is incorporated herein by reference in its entirety.

Additional photonic structures may be positioned between the sample wells and the photodetectors and configured to reduce or prevent excitation light from reaching the photodetectors, which may otherwise contribute to signal noise in detecting emission light. In some embodiments, metal layers which may act as a circuitry for the sequencing device, may also act as a spatial filter. Examples of suitable photonic structures may include spectral filters, a polarization filters, and spatial filters and are described in U.S. patent application Ser. No. 16/042,968, filed Jul. 23, 2018, titled "OPTICAL REJECTION PHOTONIC STRUCTURES," which is incorporated herein by reference in its entirety.

Components located off of the sequencing module or device may be used to position and align an excitation source to the sequencing device. Such components may include optical components including lenses, mirrors, prisms, windows, apertures, attenuators, and/or optical fibers. Additional mechanical components may be included in the instrument to allow for control of one or more alignment components. Such mechanical components may include actuators, stepper motors, and/or knobs. Examples of suitable excitation sources and alignment mechanisms are described in U.S. patent application Ser. No. 15/161,088, filed May 20, 2016, titled "PULSED LASER AND SYSTEM," which is incorporated herein by reference in its entirety. Another example of a beam-steering module is described in U.S. patent application Ser. No. 15/842,720, filed Dec. 14, 2017, titled "COMPACT BEAM SHAPING AND STEERING ASSEMBLY," which is incorporated herein by reference in its entirety. Additional examples of suitable excitation sources are described in U.S. patent application Ser. No. 14/821,688, filed Aug. 7, 2015, titled "INTEGRATED DEVICE FOR PROBING, DETECTING AND ANALYZING MOLECULES," which is incorporated herein by reference in its entirety.

The photodetector(s) positioned with individual pixels of the sequencing module or device may be configured and positioned to detect emission light from the pixel's corresponding sample well. Examples of suitable photodetectors are described in U.S. patent application Ser. No. 14/821,656, filed Aug. 7, 2015, titled "INTEGRATED DEVICE FOR TEMPORAL BINNING OF RECEIVED PHOTONS," which is incorporated herein by reference in its entirety. In some embodiments, a sample well and its respective photodetector(s) may be aligned along a common axis. In this manner, the photodetector(s) may overlap with the sample well within the pixel.

Characteristics of the detected emission light may provide an indication for identifying the marker associated with the emission light. Such characteristics may include any suitable type of characteristic, including an arrival time of photons detected by a photodetector, an amount of photons accumulated over time by a photodetector, and/or a distribution of photons across two or more photodetectors. In some embodiments, a photodetector may have a configuration that allows for the detection of one or more timing characteristics associated with a sample's emission light (e.g., luminescence lifetime). The photodetector may detect a distribution of photon arrival times after a pulse of excitation light propagates through the sequencing device, and the distribution of arrival times may provide an indication of a timing characteristic of the sample's emission light (e.g., a proxy for luminescence lifetime). In some embodiments, the one or more photodetectors provide an indication of the probability of emission light emitted by the marker (e.g., luminescence intensity). In some embodiments, a plurality of photodetectors may be sized and arranged to capture a spatial distribution of the emission light. Output signals from the one or more photodetectors may then be used to distinguish a marker from among a plurality of markers, where the plurality of markers may be used to identify a sample within the sample. In some embodiments, a sample may be excited by multiple excitation energies, and emission light and/or timing characteristics of the emission light emitted by the sample in response to the multiple excitation energies may distinguish a marker from a plurality of markers.

In operation, parallel analyses of samples within the sample wells are carried out by exciting some or all of the samples within the wells using excitation light and detecting signals from sample emission with the photodetectors. Emission light from a sample may be detected by a corresponding photodetector and converted to at least one electrical signal. The electrical signals may be transmitted along conducting lines in the circuitry of the sequencing device, which may be connected to an instrument interfaced with the sequencing device. The electrical signals may be subsequently processed and/or analyzed. Processing and/or analyzing of electrical signals may occur on a suitable computing device either located on or off the instrument.

The instrument may include a user interface for controlling operation of the instrument and/or the sequencing device. The user interface may be configured to allow a user to input information into the instrument, such as commands and/or settings used to control the functioning of the instrument. In some embodiments, the user interface may include buttons, switches, dials, and/or a microphone for voice commands. The user interface may allow a user to receive feedback on the performance of the instrument and/or sequencing device, such as proper alignment and/or information obtained by readout signals from the photodetectors on the sequencing device. In some embodiments, the user interface may provide feedback using a speaker to provide audible feedback. In some embodiments, the user interface may include indicator lights and/or a display screen for providing visual feedback to a user.

In some embodiments, the instrument or device described herein may include a computer interface configured to connect with a computing device. The computer interface may be a USB interface, a FireWire interface, or any other suitable computer interface. A computing device may be any general purpose computer, such as a laptop or desktop computer. In some embodiments, a computing device may be a server (e.g., cloud-based server) accessible over a wireless network via a suitable computer interface. The computer interface may facilitate communication of information between the instrument and the computing device. Input information for controlling and/or configuring the instrument may be provided to the computing device and transmitted to the instrument via the computer interface. Output information generated by the instrument may be received by the computing device via the computer interface. Output information may include feedback about performance of the instrument, performance of the sequencing device, and/or data generated from the readout signals of the photodetector.

In some embodiments, the instrument may include a processing device configured to analyze data received from one or more photodetectors of the sequencing device and/or transmit control signals to the excitation source(s). In some embodiments, the processing device may comprise a general purpose processor, and/or a specially-adapted processor (e.g., a central processing unit (CPU) such as one or more microprocessor or microcontroller cores, a field-programmable gate array (FPGA), an application-specific integrated circuit (ASIC), a custom integrated circuit, a digital signal processor (DSP), or a combination thereof). In some embodiments, the processing of data from one or more photodetectors may be performed by both a processing device of the instrument and an external computing device. In other embodiments, an external computing device may be omitted and processing of data from one or more photodetectors may be performed solely by a processing device of the sequencing device.

According to some embodiments, the instrument that is configured to analyze target molecules or samples comprising a plurality of molecules based on luminescence emission characteristics may detect differences in luminescence lifetimes and/or intensities between different luminescent molecules, and/or differences between lifetimes and/or intensities of the same luminescent molecules in different environments. The inventors have recognized and appreciated that differences in luminescence emission lifetimes can be used to discern between the presence or absence of different luminescent molecules and/or to discern between different environments or conditions to which a luminescent molecule is subjected. In some cases, discerning luminescent molecules based on lifetime (rather than emission wavelength, for example) can simplify aspects of the system. As an example, wavelength-discriminating optics (such as wavelength filters, dedicated detectors for each wavelength, dedicated pulsed optical sources at different wavelengths, and/or diffractive optics) may be reduced in number or eliminated when discerning luminescent molecules based on lifetime. In some cases, a single pulsed optical source operating at a single characteristic wavelength may be used to excite different luminescent molecules that emit within a same wavelength region of the optical spectrum but have measurably different lifetimes. An analytic system that uses a single pulsed optical source, rather than multiple sources operating at different wavelengths, to excite and discern different luminescent molecules emitting in a same wavelength region may be less complex to operate and maintain, may be more compact, and may be manufactured at lower cost.

Although analytic systems based on luminescence lifetime analysis may have certain benefits, the amount of information obtained by an analytic system and/or detection accuracy may be increased by allowing for additional detection techniques. For example, some embodiments of the systems may additionally be configured to discern one or more properties of a sample based on luminescence wavelength and/or luminescence intensity. In some implementations, luminescence intensity may be used additionally or alternatively to distinguish between different luminescent labels. For example, some luminescent labels may emit at significantly different intensities or have a significant difference in their probabilities of excitation (e.g., at least a difference of about 35%) even though their decay rates may be similar. By referencing binned signals to measured excitation light, it may be possible to distinguish different luminescent labels based on intensity levels.

According to some embodiments, different luminescence lifetimes may be distinguished with a photodetector that is configured to time-bin luminescence emission events following excitation of a luminescent label. The time binning may occur during a single charge-accumulation cycle for the photodetector. A charge-accumulation cycle is an interval between read-out events during which photo-generated carriers are accumulated in bins of the time-binning photodetector. Examples of a time-binning photodetector are described in U.S. patent application Ser. No. 14/821,656, filed Aug. 7, 2015, titled "INTEGRATED DEVICE FOR TEMPORAL BINNING OF RECEIVED PHOTONS," which is incorporated herein by reference in its entirety. In some embodiments, a time-binning photodetector may generate charge carriers in a photon absorption/carrier generation region and directly transfer charge carriers to a charge carrier storage bin in a charge carrier storage region. In such embodiments, the time-binning photodetector may not include a carrier travel/capture region. Such a time-binning photodetector may be referred to as a "direct binning pixel." Examples of time-binning photodetectors, including direct binning pixels, are described in U.S. patent application Ser. No. 15/852,571, filed Dec. 22, 2017, titled "INTEGRATED PHOTODETECTOR WITH DIRECT BINNING PIXEL," which is incorporated herein by reference in its entirety.

In some embodiments, different numbers of fluorophores of the same type may be linked to different components of a target molecule (e.g., a target nucleic acid or a target protein) or a plurality of molecules present in a sample (e.g., a plurality of nucleic acids or a plurality of proteins), so that each individual molecule may be identified based on luminescence intensity. For example, two fluorophores may be linked to a first labeled molecule and four or more fluorophores may be linked to a second labeled molecule. Because of the different numbers of fluorophores, there may be different excitation and fluorophore emission probabilities associated with the different molecule. For example, there may be more emission events for the second labeled molecule during a signal accumulation interval, so that the apparent intensity of the bins is significantly higher than for the first labeled molecule.

The inventors have recognized and appreciated that distinguishing nucleic acids or proteins based on fluorophore decay rates and/or fluorophore intensities may enable a simplification of the optical excitation and detection systems. For example, optical excitation may be performed with a single-wavelength source (e.g., a source producing one characteristic wavelength rather than multiple sources or a source operating at multiple different characteristic wavelengths). Additionally, wavelength discriminating optics and filters may not be needed in the detection system. Also, a single photodetector may be used for each sample well to detect emission from different fluorophores. The phrase "characteristic wavelength" or "wavelength" is used to refer to a central or predominant wavelength within a limited bandwidth of radiation. For example, a limited bandwidth of radiation may include a central or peak wavelength within a 20 nm bandwidth output by a pulsed optical source. In some cases, "characteristic wavelength" or "wavelength" may be used to refer to a peak wavelength within a total bandwidth of radiation output by a source.

Exemplary Embodiments Involving Instruments and Chips for Sequencing

As mentioned above, the systems and devices (e.g., apparatuses, cartridges, pumps, modules) described herein can be used for any of a variety of applications (e.g., analysis applications), using any of a variety of analysis machines (e.g., detection modules). For illustrative purposes, the following describes an exemplary instrument and corresponding chip for sequencing (e.g., genomic sequencing or protein sequencing) that can be coupled to the peristaltic pump of the present disclosure, in accordance with some embodiments.

In some embodiments, a detection module is an instrument configured to perform one or more detection processes using a disposable chip structure. It should be understood that the following description involving detection processes using a disposable chip structure is merely exemplary and is non-limiting, and any of a variety of other suitable instruments and chip designs for detection can be used. For example, a detection process using a chip that is not disposable is also envisioned, in accordance with certain embodiments. As another example, in some embodiments, an instrument for detection (e.g., detection module) may not even require a chip, and instead include detection components (e.g., photonic elements) such as optoelectronics, semiconductor substrates, and pixels itself rather than as part such components being part of a chip. While specific chips comprising a certain number of photonic elements (e.g., semiconductor substrates, pixels) are described and illustrated below, it should be understood that the chip (or instrument) may comprise as many or as few photonic elements as desired.

Example structure 4-100 for a disposable chip is shown in FIG. 5, according to some embodiments. The disposable chip structure 4-100 may include a bio-optoelectronic chip 4-110 having a semiconductor substrate 4-105 and including a plurality of pixels 4-140 formed on the substrate. In some embodiments, there may be row or column waveguides 4-115 that provide excitation radiation to a row or column of pixels 4-140. Excitation radiation may be coupled into the waveguides, for example, through an optical port 4-150. In some embodiments, a grating coupler may be formed on the surface of the bio-optoelectronic chip 4-110 to couple excitation radiation from a focused beam into one or more receiving waveguides that connect to the plurality of waveguides 4-115.

The disposable chip structure 4-100 may further include walls 4-120 that are formed around a pixel region on the bio-optoelectronic chip 4-110. The walls 4-120 may be part of a plastic or ceramic casing that supports the bio-optoelectronic chip 4-110. The walls 4-120 may form at least one reservoir 4-130 into which at least one sample may be placed and come into direct contact with reaction chambers on the surface of the bio-optoelectronic chip 4-110. The walls 4-120 may prevent the sample in the reservoir 4-130 from flowing into a region containing the optical port 4-150 and grating coupler, for example. In some embodiments, the disposable chip structure 4-100 may further include electrical contacts on an exterior surface of the disposable chip and interconnects within the package, so that electrical connections can be made between circuitry on the bio-optoelectronic chip 4-110 and circuitry in an instrument into which the disposable chip is mounted.

In some embodiments, a semiconductor absorber may be integrated at each pixel in a disposable chip structure like that shown in FIG. 5, however the semiconductor absorber is not limited to integration in only the assemblies shown and described herein. Semiconductor absorbers of the present embodiments may also be integrated into other semiconductor devices that may not include optical waveguides and/or may not include reaction chambers. For example, semiconductor absorbers of the present embodiments may be integrated into optical sensors for which rejection of one or multiple wavelengths over a range may be desired. In some implementations, semiconductor absorbers of the present embodiments may be incorporated into CCD and/or CMOS imaging arrays. For example, a semiconductor absorber may be formed over a photodiode at one or more pixels in an imaging array so that the absorber filters radiation received by the photodiode(s). Such imaging arrays may be used, for example, in fluorescence microscopy imaging, where excitation radiation is preferentially attenuated by the semiconductor absorber.

According to some implementations, a rejection ratio $R_r$ for a semiconductor absorber integrated into an assembly can have a value between 10 and 100. In some implementations, the rejection ratio $R_r$ can have a value between 100 and 500. In some cases, the rejection ratio $R_r$ can have a value between 500 and 1000. In some implementations, the rejection ratio $R_r$ can have a value between 1000 and 2000. In some implementations, the rejection ratio $R_r$ can have a value between 2000 and 5000. One possible advantage of a semiconductor absorber is that the rejection ratio $R_r$ can be selected more easily than for a multi-layer filter by selecting the thickness of the semiconductor absorbing layer. One possible additional advantage of a semiconductor absorber is that scatter excitation radiation can be absorbed rather than reflected (as would be the case for a multi-layer filter), reducing cross-talk between pixels. Another advantage is that an effective thickness of the semiconductor absorber can be significantly greater than an actual thickness of the semiconductor absorbing layer for rays incident at angles away from normal to the surface of the semiconductor absorbing layer. Further, as noted above, performance of the semiconductor absorber is nowhere near as sensitive to thickness variations of the semiconductor absorbing layer due to microfabrication tolerances as a multi-layer filter's performance is dependent on constituent layer thicknesses.

An example bioanalytic application is described in which an integrated semiconductor absorber can be used to improve detection of radiation emitted from reaction chambers on a disposable chip that is used in an advanced analytical instrument (e.g., in a detection module connected to a sample preparation module described herein). For example, a semiconductor absorber can, in some cases, significantly reduce excitation radiation incident on the sensor and thereby reduce detected background noise appreciably that might otherwise overwhelm emitted radiation from the reaction chamber. In some cases, the rejection of the excitation radiation can be 800 times more than attenuation of the emission radiation, leading to a significant improvement in signal-to-noise ratio from the sensor.

When mounted in a receptacle of the instrument, the disposable chip can be in optical and electronic communication with optical and electronic apparatus within the advanced analytic instrument. The instrument may include hardware for an external interface, so that data from the chip can be communicated to an external network. In embodiments, the term "optical" may refer to ultra-violet, visible, near-infrared, and short-wavelength infrared spectral bands. Although various types of analyses can be performed on various samples, the following explanation describes genetic sequencing. However, the invention is not limited to instruments configured for genetic sequencing.

In overview and referring to FIG. 6A, a portable, advanced analytic instrument 5-100 can comprise one or more pulsed optical sources 5-108 mounted as a replaceable module within, or otherwise coupled to, the instrument 5-100. The portable analytic instrument 5-100 can include an optical coupling system 5-115 and an analytic system 5-160. The optical coupling system 5-115 can include some combination of optical components (which may include, for example, none, one from among, or more than one component from among the following components: lens, mirror, optical filter, attenuator, beam-steering component, beam shaping component) and be configured to operate on and/or couple output optical pulses 5-122 from the pulsed optical source 5-108 to the analytic system 5-160. The analytic system 5-160 can include a plurality of components that are arranged to direct the optical pulses to at least one reaction chamber for sample analysis, receive one or more optical signals (e.g., fluorescence, backscattered radiation) from the at least one reaction chamber, and produce one or more electrical signals representative of the received optical signals. In some embodiments, the analytic system 5-160 can include one or more photodetectors and may also include signal-processing electronics (e.g., one or more microcontrollers, one or more field-programmable gate arrays, one or more microprocessors, one or more digital signal processors, logic gates, etc.) configured to process the electrical signals from the photodetectors. The analytic system 5-160 can also include data transmission hardware configured to transmit and receive data to and from external devices (e.g., one or more external devices on a network to which the instrument 5-100 can connect via one or more data communications links). In some embodiments, the analytic system 5-160 can be configured to receive a bio-optoelectronic chip 5-140, which holds one or more samples to be analyzed.

FIG. 6B depicts a further detailed example of a portable analytical instrument 5-100 that includes a compact pulsed optical source 5-108. In this example, the pulsed optical source 5-108 comprises a compact, passively mode-locked laser module 5-110. A passively mode-locked laser can produce optical pulses autonomously, without the application of an external pulsed signal. In some implementations, the module can be mounted to an instrument chassis or frame 5-102, and may be located inside an outer casing of the instrument. According to some embodiments, a pulsed optical source 5-108 can include additional components that can be used to operate the optical source and operate on an output beam from the optical source 5-108. A mode-locked laser 5-110 may comprise an element (e.g., saturable absorber, acousto-optic modulator, Kerr lens) in a laser cavity, or coupled to the laser cavity, that induces phase locking of the laser's longitudinal frequency modes. The laser cavity can be defined in part by cavity end mirrors 5-111, 5-119. Such locking of the frequency modes results in pulsed operation of the laser (e.g., an intracavity pulse 5-120 bounces back-and-forth between the cavity end mirrors) and produces a stream of output optical pulses 5-122 from one end mirror 5-111 which is partially transmitting.

In some cases, the analytic instrument 5-100 is configured to receive a removable, packaged, bio-optoelectronic or optoelectronic chip 5-140 (also referred to as a "disposable chip"). The disposable chip can include a bio-optoelectronic chip 4-110, as depicted in FIG. 4 for example, that comprises a plurality of reaction chambers, integrated optical components arranged to deliver optical excitation energy to the reaction chambers, and integrated photodetectors arranged to detect fluorescent emission from the reaction chambers. In some implementations, the chip 5-140 can be disposable after a single use, whereas in other implementations the chip 5-140 can be reused two or more times. When the chip 5-140 is received by the instrument 5-100, it can be in electrical and optical communication with the pulsed optical source 5-108 and with apparatus in the analytic system 5-160. Electrical communication may be made through electrical contacts on the chip's package, for example.

In some embodiments and referring to FIG. 6B, the disposable chip 5-140 can be mounted (e.g., via a socket connection) on an electronic circuit board 5-130, such as a printed circuit board (PCB) that can include additional instrument electronics. For example, the PCB 5-130 can include circuitry configured to provide electrical power, one or more clock signals, and control signals to the chip 5-140, and signal-processing circuitry arranged to receive signals representative of fluorescent emission detected from the reaction chambers. Data returned from the chip 5-140 can be processed in part or entirely by electronics on the instrument 5-100, although data may be transmitted via a network connection to one or more remote data processors, in some implementations. The PCB 5-130 can also include circuitry configured to receive feedback signals from the chip relating to optical coupling and power levels of the optical pulses 5-122 coupled into waveguides of the chip 5-140. The feedback signals can be provided to one or both of the pulsed optical source 5-108 and optical system 5-115 to control one or more parameters of the output beam of optical pulses 5-122. In some cases, the PCB 5-130 can provide or route power to the pulsed optical source 5-108 for operating the optical source and related circuitry in the optical source 5-108.

According to some embodiments, the pulsed optical source 5-108 comprises a compact mode-locked laser module 5-110. The mode-locked laser can comprise a gain medium 5-105 (which can be solid-state material in some embodiments), an output coupler 5-111, and a laser-cavity end mirror 5-119. The mode-locked laser's optical cavity can be bound by the output coupler 5-111 and end mirror 5-119. An optical axis 5-125 of the laser cavity can have one or more folds (turns) to increase the length of the laser cavity and provide a desired pulse repetition rate. The pulse repetition rate is determined by the length of the laser cavity (e.g., the time for an optical pulse to make a round-trip within the laser cavity).

In some embodiments, there can be additional optical elements (not shown in FIG. 6B) in the laser cavity for beam shaping, wavelength selection, and/or pulse forming. In some cases, the end mirror 5-119 comprises a saturable-absorber mirror (SAM) that induces passive mode locking of longitudinal cavity modes and results in pulsed operation of the mode-locked laser. The mode-locked laser module 5-110 can further include a pump source (e.g., a laser diode, not shown in FIG. 6B) for exciting the gain medium 5-105. Further details of a mode-locked laser module 5-110 can be found in U.S. patent application Ser. No. 15/844,469, titled "Compact Mode-Locked Laser Module," filed Dec. 15, 2017, which application is incorporated herein by reference.

When the laser 5-110 is mode locked, an intracavity pulse 5-120 can circulate between the end mirror 5-119 and the output coupler 5-111, and a portion of the intracavity pulse can be transmitted through the output coupler 5-111 as an output pulse 5-122. Accordingly, a train of output pulses 5-122, as depicted in the graph of FIG. 6C, can be detected at the output coupler as the intracavity pulse 5-120 bounces back-and-forth between the output coupler 5-111 and end mirror 5-119 in the laser cavity.

FIG. 6C depicts temporal intensity profiles of the output pulses 5-122, though the illustration is not to scale. In some embodiments, the peak intensity values of the emitted pulses may be approximately equal, and the profiles may have a Gaussian temporal profile, though other profiles such as a $sech^2$ profile may be possible. In some cases, the pulses may not have symmetric temporal profiles and may have other temporal shapes. The duration of each pulse may be characterized by a full-width-half-maximum (FWHM) value, as indicated in FIG. 6C. According to some embodiments of a mode-locked laser, ultrashort optical pulses can have FWHM values less than 100 picoseconds (ps). In some cases, the FWHM values can be between approximately 5 ps and approximately 30 ps.

The output pulses 5-122 can be separated by regular intervals T. For example, T can be determined by a round-trip travel time between the output coupler 5-111 and cavity end mirror 5-119. According to some embodiments, the pulse-separation interval T can be between about 1 ns and about 30 ns. In some cases, the pulse-separation interval T can be between about 5 ns and about 20 ns, corresponding to a laser-cavity length (an approximate length of the optical axis 5-125 within the laser cavity) between about 0.7 meter and about 3 meters. In embodiments, the pulse-separation interval corresponds to a round trip travel time in the laser cavity, so that a cavity length of 3 meters (round-trip distance of 6 meters) provides a pulse-separation interval T of approximately 20 ns.

According to some embodiments, a desired pulse-separation interval T and laser-cavity length can be determined by a combination of the number of reaction chambers on the chip 5-140, fluorescent emission characteristics, and the speed of data-handling circuitry for reading data from the chip 5-140. In embodiments, different fluorophores can be distinguished by their different fluorescent decay rates or characteristic lifetimes. Accordingly, there needs to be a sufficient pulse-separation interval T to collect adequate statistics for the selected fluorophores to distinguish between their different decay rates. Additionally, if the pulse-separation interval T is too short, the data handling circuitry cannot keep up with the large amount of data being collected by the large number of reaction chambers. Pulse-separation interval T between about 5 ns and about 20 ns is suitable for fluorophores that have decay rates up to about 2 ns and for handling data from between about 60,000 and 10,000,000 reaction chambers.

According to some implementations, a beam-steering module 5-150 can receive output pulses from the pulsed optical source 5-108 and is configured to adjust at least the position and incident angles of the optical pulses onto an optical coupler (e.g., grating coupler) of the chip 5-140. In some cases, the output pulses 5-122 from the pulsed optical source 5-108 can be operated on by a beam-steering module 5-150 to additionally or alternatively change a beam shape and/or beam rotation at an optical coupler on the chip 5-140. In some implementations, the beam-steering module 5-150 can further provide focusing and/or polarization adjustments of the beam of output pulses onto the optical coupler. One example of a beam-steering module is described in U.S. patent application Ser. No. 15/161,088 titled "Pulsed Laser and Bioanalytic System," filed May 20, 2016, which is incorporated herein by reference. Another example of a beam-steering module is described in a separate U.S. patent application No. 62/435,679, filed Dec. 16, 2016 and titled "Compact Beam Shaping and Steering Assembly," which is incorporated herein by reference.

Referring to FIG. 6D, the output pulses 5-122 from a pulsed optical source can be coupled into one or more optical waveguides 5-312 on a disposable bio-optoelectronic chip 5-140, for example. In some embodiments, the optical pulses can be coupled to one or more waveguides via a grating coupler 5-310, though coupling to an end of one or more optical waveguides on the chip 5-140 can be used in some embodiments. According to some embodiments, a quad detector 5-320 can be located on a semiconductor substrate 5-305 (e.g., a silicon substrate) for aiding in alignment of the beam of optical pulses 5-122 to a grating coupler 5-310. The one or more waveguides 5-312 and reaction chambers or reaction chambers 5-330 can be integrated on the same semiconductor substrate with intervening dielectric layers (e.g., silicon dioxide layers) between the substrate, waveguide, reaction chambers, and photodetectors 5-322.

Each waveguide 5-312 can include a tapered portion 5-315 below the reaction chambers 5-330 to equalize optical power coupled to the reaction chambers along the waveguide. The reducing taper can force more optical energy outside the waveguide's core, increasing coupling to the reaction chambers and compensating for optical losses along the waveguide, including losses for radiation coupling into the reaction chambers. A second grating coupler 5-317 can be located at an end of each waveguide to direct optical energy to an integrated photodiode 5-324. The integrated photodiode can detect an amount of power coupled down a waveguide and provide a detected signal to feedback circuitry that controls the beam-steering module 5-150, for example.

The reaction chambers 5-330 or reaction chambers 5-330 can be aligned with the tapered portion 5-315 of the waveguide and recessed in a tub 5-340. There can be photodetectors 5-322 located on the semiconductor substrate 5-305 for each reaction chamber 5-330. In some embodiments, a semiconductor absorber (shown in FIG. 6-F as an optical filter 5-530) may be located between the waveguide and a photodetector 5-322 at each pixel. A metal coating and/or multilayer coating 5-350 can be formed around the reaction chambers and above the waveguide to prevent optical excitation of fluorophores that are not in the reaction chambers (e.g., dispersed in a solution above the reaction chambers). The metal coating and/or multilayer coating 5-350 may be raised beyond edges of the tub 5-340 to reduce absorptive losses of the optical energy in the waveguide 5-312 at the input and output ends of each waveguide.

There can be a plurality of rows of waveguides, reaction chambers, and time-binning photodetectors on the chip 5-140. For example, there can be 128 rows, each having 512 reaction chambers, for a total of 65,536 reaction chambers in some implementations. Other implementations may include fewer or more reaction chambers, and may include other layout configurations. Optical power from the pulsed optical source 5-108 can be distributed to the multiple waveguides via one or more star couplers or multi-mode interference couplers, or by any other means, located between an optical coupler 5-310 to the chip 5-140 and the plurality of waveguides 5-312.

FIG. 6E illustrates optical energy coupling from an optical pulse 5-122 within a tapered portion of waveguide 5-315 to a reaction chamber 5-330. The drawing has been produced from an electromagnetic field simulation of the optical wave that accounts for waveguide dimensions, reaction chamber dimensions, the different materials' optical properties, and the distance of the tapered portion of waveguide 5-315 from the reaction chamber 5-330. The waveguide can be formed from silicon nitride in a surrounding medium 5-410 of silicon dioxide, for example. The waveguide, surrounding medium, and reaction chamber can be formed by microfabrication processes described in U.S. application Ser. No. 14/821,688, filed Aug. 7, 2015, titled "Integrated Device for Probing, Detecting and Analyzing Molecules." According to some embodiments, an evanescent optical field 5-420 couples optical energy transported by the waveguide to the reaction chamber 5-330.

A non-limiting example of a biological reaction taking place in a reaction chamber 5-330 is depicted in FIG. 6F. The example depicts sequential incorporation of nucleotides or nucleotide analogs into a growing strand that is complementary to a target nucleic acid. The sequential incorporation can take place in a reaction chamber 5-330, and can be detected by an advanced analytic instrument to sequence DNA. The reaction chamber can have a depth between about 150 nm and about 250 nm and a diameter between about 80 nm and about 160 nm. A metallization layer 5-540 (e.g., a metallization for an electrical reference potential) can be patterned above a photodetector 5-322 to provide an aperture or iris that blocks stray radiation from adjacent reaction chambers and other unwanted radiation sources. According to some embodiments, polymerase 5-520 can be located within the reaction chamber 5-330 (e.g., attached to a base of the chamber). The polymerase can take up a target nucleic acid 5-510 (e.g., a portion of nucleic acid derived from DNA), and sequence a growing strand of complementary nucleic acid to produce a growing strand of DNA 5-512. Nucleotides or nucleotide analogs labeled with different fluorophores can be dispersed in a solution above and within the reaction chamber.

When a labeled nucleotide or nucleotide analog 5-610 is incorporated into a growing strand of complementary nucleic acid, as depicted in FIG. 6G, one or more attached fluorophores 5-630 can be repeatedly excited by pulses of optical energy coupled into the reaction chamber 5-330 from the waveguide 5-315. In some embodiments, the fluorophore or fluorophores 5-630 can be attached to one or more nucleotides or nucleotide analogs 5-610 with any suitable linker 5-620. An incorporation event may last for a period of time up to about 100 ms. During this time, pulses of fluorescent emission resulting from excitation of the fluorophore(s) by pulses from the mode-locked laser can be detected with a time-binning photodetector 5-322, for example. In some embodiments, there can be one or more additional integrated electronic devices 5-323 at each pixel for signal handling (e.g., amplification, read-out, routing, signal preprocessing, etc.). According to some embodiments, each pixel can include at least one optical filter 5-530 (e.g., a semiconductor absorber) that passes fluorescent emission and reduces transmission of radiation from the excitation pulse. Some implementations may not use the optical filter 5-530. By attaching fluorophores with different emission characteristics (e.g., fluorescent decay rates, intensity, fluorescent wavelength) to the different nucleotides (A,C,G,T), detecting and distinguishing the different emission characteristics while the strand of DNA 5-512 incorporates a nucleic acid and enables determination of the genetic sequence of the growing strand of DNA.

According to some embodiments, an advanced analytic instrument 5-100 that is configured to analyze samples based on fluorescent emission characteristics can detect differences in fluorescent lifetimes and/or intensities between different fluorescent molecules, and/or differences between lifetimes and/or intensities of the same fluorescent molecules in different environments. By way of explanation, FIG. 6H plots two different fluorescent emission probability curves (A and B), which can be representative of fluorescent emission from two different fluorescent molecules, for example. With reference to curve A (dashed line), after being excited by a short or ultrashort optical pulse, a probability $p_A(t)$ of a fluorescent emission from a first molecule may decay with time, as depicted. In some cases, the decrease in the probability of a photon being emitted over time can be represented by an exponential decay function $p_A(t)=P_{Ao}e^{-t/\tau^1}$, where $P_{Ao}$ is an initial emission probability and $\tau_1$ is a temporal parameter associated with the first fluorescent molecule that characterizes the emission decay probability. $\tau_1$ may be referred to as the "fluorescence lifetime," "emission lifetime," or "lifetime" of the first fluorescent molecule. In some cases, the value of $\tau_1$ can be altered by a local environment of the fluorescent molecule. Other fluorescent molecules can have different emission characteristics than that shown in curve A. For example, another fluorescent molecule can have a decay profile that differs from a single exponential decay, and its lifetime can be characterized by a half-life value or some other metric.

A second fluorescent molecule may have a decay profile $p_B(t)$ that is exponential, but has a measurably different lifetime $\tau_2$, as depicted for curve B in FIG. 6H. In the example shown, the lifetime for the second fluorescent molecule of curve B is shorter than the lifetime for curve A, and the probability of emission $p_B(t)$ is higher sooner after excitation of the second molecule than for curve A. Different fluorescent molecules can have lifetimes or half-life values ranging from about 0.1 ns to about 20 ns, in some embodiments.

Differences in fluorescent emission lifetimes can be used to discern between the presence or absence of different fluorescent molecules and/or to discern between different environments or conditions to which a fluorescent molecule is subjected. In some cases, discerning fluorescent molecules based on lifetime (rather than emission wavelength, for example) can simplify aspects of an analytical instrument 5-100. As an example, wavelength-discriminating optics (such as wavelength filters, dedicated detectors for each wavelength, dedicated pulsed optical sources at different wavelengths, and/or diffractive optics) can be reduced in number or eliminated when discerning fluorescent molecules based on lifetime. It should be understood, however, that while fluorescence lifetime discrimination is described in detail in the present exemplary embodiment, other methods for discerning the presence or absence of different molecules and/or discern between different environments or conditions to which a fluorescent molecule is subject are possible in sequencing processes described generally herein. For example, in some embodiments, fluorescent molecules are discerned based on emission wavelength, rather than fluorescence lifetime. In some cases, a single pulsed optical source operating at a single characteristic wavelength can be used to excite different fluorescent molecules that emit within a same wavelength region of the optical spectrum but have measurably different lifetimes. An analytic system that uses a single pulsed optical source, rather than multiple sources operating at different wavelengths, to excite and discern different fluorescent molecules emitting in a same wavelength region can be less complex to operate and maintain, more compact, and can be manufactured at lower cost.

Although analytic systems based on fluorescent lifetime analysis can have certain benefits, the amount of information obtained by an analytic system and/or detection accuracy can be increased by allowing for additional detection techniques. For example, some analytic systems 5-160 can additionally be configured to discern one or more properties of a specimen based on fluorescent wavelength and/or fluorescent intensity.

Referring again to FIG. 6H, according to some embodiments, different fluorescent lifetimes can be distinguished with a photodetector that is configured to time-bin fluorescent emission events following excitation of a fluorescent molecule. The time binning can occur during a single charge-accumulation cycle for the photodetector. A charge-accumulation cycle is an interval between read-out events during which photo-generated carriers are accumulated in bins of the time-binning photodetector. The concept of determining fluorescent lifetime by time-binning of emission events is introduced graphically in FIG. 6I. At time $t_e$ just prior to $t_1$, a fluorescent molecule or ensemble of fluorescent molecules of a same type (e.g., the type corresponding to curve B of FIG. 6H) is (are) excited by a short or ultrashort optical pulse. For a large ensemble of molecules, the intensity of emission can have a time profile similar to curve B, as depicted in FIG. 6I. It should be understood that while particular methods for discerning fluorescent molecules based on binning are described in detail in the present exemplary embodiment, other methods for determining and discerning fluorescence lifetimes are possible in sequencing processes described generally herein. For example, in some embodiments, fluorescence lifetimes are determined using single wavelength amplitude techniques (e.g., by monitoring the amplitude of emission at a single wavelength as a function of time following excitation).

For a single molecule or a small number of molecules, however, the emission of fluorescent photons occurs according to the statistics of curve B in FIG. 6H, for this example. A time-binning photodetector 5-322 can accumulate carriers generated from emission events into discrete time bins. Three bins are indicated in FIG. 6I, though fewer bins or more bins may be used in embodiments. The bins are temporally resolved with respect to the excitation time $t_e$ of the fluorescent molecule(s). For example, a first bin can accumulate carriers produced during an interval between times $t_1$ and $t_2$, occurring after the excitation event at time $t_e$. A second bin can accumulate carriers produced during an interval between times $t_2$ and $t_3$, and a third bin can accumulate carriers produced during an interval between times $t_3$ and $t_4$. When a large number of emission events are summed, carriers accumulated in the time bins can approximate the decaying intensity curve shown in FIG. 6J, and the binned signals can be used to distinguish between different fluorescent molecules or different environments in which a fluorescent molecule is located.

Examples of a time-binning photodetector 5-322 are described in U.S. patent application Ser. No. 14/821,656, filed Aug. 7, 2015, titled "Integrated Device for Temporal Binning of Received Photons" and in U.S. patent application Ser. No. 15/852,571, filed Dec. 22, 2017, titled "Integrated Photodetector with Direct Binning Pixel," which are both incorporated herein by reference in their entirety. For explanation purposes, a non-limiting embodiment of a time-binning photodetector is depicted in FIG. 6J. A single time-binning photodetector 5-322 can comprise a photon-absorption/carrier-generation region 5-902, a carrier-discharge channel 5-906, and a plurality of carrier-storage bins 5-908*a*, 5-908*b* all formed on a semiconductor substrate. Carrier-transport channels 5-907 can connect between the photon-absorption/carrier-generation region 5-902 and carrier-storage bins 5-908*a*, 5-908*b*. In the illustrated example, two carrier-storage bins are shown, but there may be more or fewer. There can be a read-out channel 5-910 connected to the carrier-storage bins. The photon-absorption/carrier-generation region 5-902, carrier-discharge channel 5-906, carrier-storage bins 5-908*a*, 5-908*b*, and read-out channel 5-910 can be formed by doping the semiconductor locally and/or forming adjacent insulating regions to provide photodetection capability, confinement, and transport of carriers. A time-binning photodetector 5-322 can also include a plurality of electrodes 5-920, 5-921, 5-922, 5-923, 5-924 formed on the substrate that are configured to generate electric fields in the device for transporting carriers through the device.

In operation, a portion of an excitation pulse 5-122 from a pulsed optical source 5-108 (e.g., a mode-locked laser) is delivered to a reaction chamber 5-330 over the time-binning photodetector 5-322. Initially, some excitation radiation photons 5-901 may arrive at the photon-absorption/carrier-generation region 5-902 and produce carriers (shown as light-shaded circles). There can also be some fluorescent emission photons 5-903 that arrive with the excitation radiation photons 5-901 and produce corresponding carriers (shown as dark-shaded circles). Initially, the number of carriers produced by the excitation radiation can be too large compared to the number of carriers produced by the fluorescent emission. The initial carriers produced during a time interval $|t_e-t_1|$ can be rejected by gating them into a carrier-discharge channel 5-906 with a first electrode 5-920, for example.

At a later times mostly fluorescent emission photons 5-903 arrive at the photon-absorption/carrier-generation region 5-902 and produce carriers (indicated a dark-shaded circles) that provide useful and detectable signal that is representative of fluorescent emission from the reaction chamber 5-330. According to some detection methods, a second electrode 5-921 and third electrode 5-923 can be gated at a later time to direct carriers produced at a later time (e.g., during a second time interval $|t_1-t_2|$) to a first carrier-storage bin 5-908*a*. Subsequently, a fourth electrode 5-922 and fifth electrode 5-924 can be gated at a later time (e.g., during a third time interval $|t_2-t_3|$) to direct carriers to a second carrier-storage bin 5-908*b*. Charge accumulation can continue in this manner after excitation pulses for a large number of excitation pulses to accumulate an appreciable number of carriers and signal level in each carrier-storage bin 5-908*a*, 5-908*b*. At a later time, the signal can be read out from the bins. In some implementations, the time intervals corresponding to each storage bin are at the sub-nanosecond time scale, though longer time scales can be used in some embodiments (e.g., in embodiments where fluorophores have longer decay times).

The process of generating and time-binning carriers after an excitation event (e.g., excitation pulse from a pulsed optical source) can occur once after a single excitation pulse or be repeated multiple times after multiple excitation pulses during a single charge-accumulation cycle for the time-binning photodetector 5-322. After charge accumulation is complete, carriers can be read out of the storage bins via the read-out channel 5-910. For example, an appropriate biasing sequence can be applied to electrodes 5-923, 5-924 and at least to electrode 5-940 to remove carriers from the storage bins 5-908*a*, 5-908*b*. The charge accumulation and read-out processes can occur in a massively parallel operation on the chip 5-140 resulting in frames of data.

Although the described example in connection with FIG. 6J includes multiple charge storage bins 5-908*a*, 5-908*b*, in some cases a single charge storage bin may be used instead. For example, only binl may be present in a time-binning photodetector 5-322. In such a case, a single storage bins 5-908*a* can be operated in a variable time-gated manner to look at different time intervals after different excitation events. For example, after pulses in a first series of excitation pulses, electrodes for the storage bin 5-908*a* can be gated to collect carriers generated during a first time interval (e.g., during the second time interval $|t_1-t_2|$), and the accumulated signal can be read out after a first predetermined number of pulses. After pulses in a subsequent series of excitation pulses at the same reaction chamber, the same electrodes for the storage bin 5-908*a* can be gated to collect carriers generated during a different interval (e.g., during the third time interval $|t_2-t_3|$), and the accumulated signal can be read out after a second predetermined number of pulses. Carriers could be collected during later time intervals in a similar manner if needed. In this manner, signal levels corresponding to fluorescent emission during different time periods after arrival of an excitation pulse at a reaction chamber can be produced using a single carrier-storage bin.

Regardless of how charge accumulation is carried out for different time intervals after excitation, signals that are read out can provide a histogram of bins that are representative of the fluorescent emission decay characteristics, for example. An example process is illustrated in FIG. 6K and FIG. 6L, for which two charge-storage bins are used to acquire fluorescent emission from the reaction chambers. The histogram's bins can indicate a number of photons detected during each time interval after excitation of the fluorophore(s) in a reaction chamber 5-330. In some embodiments, signals for the bins will be accumulated following a large number of excitation pulses, as depicted in FIG. 6K. The excitation pulses can occur at times $t_{e1}$, $t_{e2}$, $t_{e3}$, . . . $t_{eN}$ which are separated by the pulse interval time T. In some cases, there can be between $10^5$ and $10^7$ excitation pulses 5-122 (or portions thereof) applied to a reaction chamber during an accumulation of signals in the electron-storage bins for a single event being observed in the reaction chamber (e.g., a single nucleotide incorporation event in DNA analysis). In some embodiments, one bin (bin 0) can be configured to detect an amplitude of excitation energy delivered with each optical pulse, and may be used as a reference signal (e.g., to normalize data). In other cases, the excitation pulse amplitude may be stable, determined one or more times during signal acquisition, and not determined after each excitation pulse so that there is no bin( ) signal acquisition after each excitation pulse. In such cases, carriers produced by an excitation pulse can be rejected and dumped from the photon-absorption/carrier-generation region 5-902 as described above in connection with FIG. 6J.

In some implementations, only a single photon may be emitted from a fluorophore following an excitation event, as depicted in FIG. 6K. After a first excitation event at time $t_{e1}$, the emitted photon at time $tf_1$ may occur within a first time interval (e.g., between times $t_1$ and $t_2$), so that the resulting electron signal is accumulated in the first electron-storage bin (contributes to bin 1). In a subsequent excitation event at time $t_{e2}$, the emitted photon at time 42 may occur within a second time interval (e.g., between times $t_2$ and $t_3$), so that the resulting electron signal contributes to bin 2. After a next excitation event at time $t_{e3}$, a photon may emit at a time tea occurring within the first time interval.

In some implementations, there may not be a fluorescent photon emitted and/or detected after each excitation pulse received at a reaction chamber 5-330. In some cases, there can be as few as one fluorescent photon that is detected at a reaction chamber for every 10,000 excitation pulses delivered to the reaction chamber. One advantage of implementing a mode-locked laser 5-110 as the pulsed excitation source 5-108 is that a mode-locked laser can produce short optical pulses having high intensity and quick turn-off times at high pulse-repetition rates (e.g., between 50 MHz and 250 MHz). With such high pulse-repetition rates, the number of excitation pulses within a 10 millisecond charge-accumulation interval can be 50,000 to 250,000, so that detectable signal can be accumulated.

After a large number of excitation events and carrier accumulations, the carrier-storage bins of the time-binning photodetector 5-322 can be read out to provide a multi-valued signal (e.g., a histogram of two or more values, an N-dimensional vector, etc.) for a reaction chamber. The signal values for each bin can depend upon the decay rate of the fluorophore. For example and referring again to FIG. 6I, a fluorophore having a decay curve B will have a higher ratio of signal in bin 1 to bin 2 than a fluorophore having a decay curve A. The values from the bins can be analyzed and compared against calibration values, and/or each other, to determine the particular fluorophore present. For a sequencing application, identifying the fluorophore can determine the nucleotide or nucleotide analog that is being incorporated into a growing strand of DNA, for example. For other applications, identifying the fluorophore can determine an identity of a molecule or specimen of interest, which may be linked to the fluorophore or marked with a fluorophore.

Figure 6M:
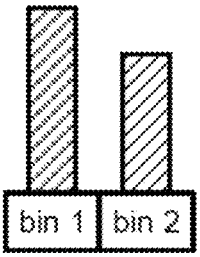
Figure 6N:
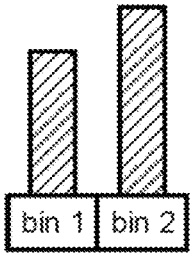
Figure 6O:
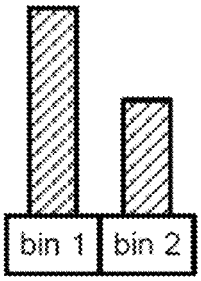
Figure 6P:
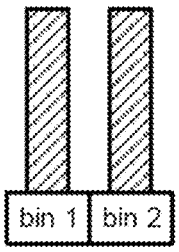

To further aid in understanding the signal analysis, the accumulated, multi-bin values can be plotted as a histogram, as depicted in FIG. 6L for example, or can be recorded as a vector or location in N-dimensional space. Calibration runs can be performed separately to acquire calibration values for the multi-valued signals (e.g., calibration histograms) for four different fluorophores linked to the four nucleotides or nucleotide analogs. As an example, the calibration histograms may appear as depicted in FIG. 6M (fluorescent label associated with the T nucleotide), FIG. 6N (fluorescent label associated with the A nucleotide), FIG. 6O (fluorescent label associated with the C nucleotide), and FIG. 6P (fluorescent label associated with the G nucleotide). A comparison of the measured multi-valued signal (corresponding to the histogram of FIG. 6L) to the calibration multi-valued signals can determine the identity "T" (FIG. 6K) of the nucleotide or nucleotide analog being incorporated into the growing strand of DNA.

In some implementations, fluorescent intensity can be used additionally or alternatively to distinguish between different fluorophores. For example, some fluorophores may emit at significantly different intensities or have a significant difference in their probabilities of excitation (e.g., at least a difference of about 35%) even though their decay rates may be similar. By referencing binned signals (bins 5-3) to measured excitation energy and/or other acquired signals, it can be possible to distinguish different fluorophores based on intensity levels.

In some embodiments, different numbers of fluorophores of the same type can be linked to different nucleotides or nucleotide analogs, so that the nucleotides can be identified based on fluorophore intensity. For example, two fluorophores can be linked to a first nucleotide (e.g., "C") or nucleotide analog and four or more fluorophores can be linked to a second nucleotide (e.g., "T") or nucleotide analog. Because of the different numbers of fluorophores, there may be different excitation and fluorophore emission probabilities associated with the different nucleotides. For example, there may be more emission events for the "T" nucleotide or nucleotide analog during a signal accumulation interval, so that the apparent intensity of the bins is significantly higher than for the "C" nucleotide or nucleotide analog.

Distinguishing nucleotides or any other biological or chemical specimens based on fluorophore decay rates and/or fluorophore intensities enables a simplification of the optical excitation and detection systems in an analytical instrument 5-100. For example, optical excitation can be performed with a single-wavelength source (e.g., a source producing one characteristic wavelength rather than multiple sources or a source operating at multiple different characteristic wavelengths). Additionally, wavelength-discriminating optics and filters may not be needed in the detection system to distinguish between fluorophores of different wavelengths. Also, a single photodetector can be used for each reaction chamber to detect emission from different fluorophores.

Fluorophores having emission wavelengths in a range between about 560 nm and about 900 nm can provide adequate amounts of fluorescence to be detected by a time-binning photodetector (which can be fabricated on a silicon wafer using CMOS processes). These fluorophores can be linked to biological molecules of interest, such as nucleotides or nucleotide analogs for genetic sequencing applications. Fluorescent emission in this wavelength range can be detected with higher responsivity in a silicon-based photodetector than fluorescence at longer wavelengths. Additionally, fluorophores and associated linkers in this wavelength range may not interfere with incorporation of the nucleotides or nucleotide analogs into growing strands of DNA. In some implementations, fluorophores having emission wavelengths in a range between about 560 nm and about 660 nm can be optically excited with a single-wavelength source. An example fluorophore in this range is Alexa Fluor 647, available from Thermo Fisher Scientific Inc. of Waltham, Massachusetts. Excitation energy at shorter wavelengths (e.g., between about 500 nm and about 650 nm) may be used to excite fluorophores that emit at wavelengths between about 560 nm and about 900 nm. In some embodiments, the time-binning photodetectors can efficiently detect longer-wavelength emission from the reaction chambers, e.g., by incorporating other materials, such as Ge, into the photodetectors' active regions.

U.S. Provisional Application No. 62/927,385, filed Oct. 29, 2019, and entitled, "Peristaltic Pumping of Fluids and Associated Methods, Systems, and Devices," and U.S. Provisional Application No. 62/927,405, filed Oct. 29, 2019, and entitled, "Peristaltic Pumping of Fluids For Bioanalytical Applications and Associated Methods, Systems, and Devices," are each incorporated herein by reference in its entirety for all purposes.

EXAMPLE

The following example illustrates an exemplary apparatus and cartridge forming a peristaltic pump, in accordance with some embodiments.

FIG. 7A is a top-view schematic diagram of an apparatus 1000 and cartridge 1100 forming a peristaltic pump, in accordance with some embodiments. FIG. 7B is a side-view schematic diagram, viewed from section A-A of FIG. 7A in the direction of the arrows pointing to section A-A in FIG. 7A, of apparatus 1000 and test cartridge 1100 forming the peristaltic pump of FIG. 7A, in accordance with some embodiments. FIG. 7C is another side-view schematic diagram of apparatus 1000 and cartridge 1100 forming the peristaltic pump of FIG. 7A, in accordance with some embodiments. FIG. 7D is a perspective-view schematic diagram of apparatus 1000 and cartridge 1100 forming the peristaltic pump of FIG. 7A, in accordance with some embodiments.

The depicted apparatus 1000 includes a wedged roller (1020; below connecting arm 1024 along vertical axis direction 1029). The depicted wedged roller 1020 comprises an edge 1033, distal to an axis of rotation of the roller, having a wedge shape. The depicted apparatus 1000 includes a crank-and-rocker mechanism, comprising a crank 1028 and a rocker 1026, connected to wedged roller 1020 by connecting arm 1024. The depicted connecting arm 1024 is configured so as to join crank 1028 to rocker 1026 and wedged roller 1020. The depicted apparatus 1000 further includes a sprung roller arm (1022; below connecting arm 1024 along vertical axis direction 1029) configured so as to join wedged roller 1020 to connecting arm 1024. The depicted apparatus 1000 further comprises a hinge 1025 configured so as to join sprung roller arm 1022 to connecting arm 1024. In some embodiments, hinge 1025 comprises a spring (not shown). The depicted apparatus 1000 is configured such that rotation of crank 1028 and/or rocker 1026 drives the motion of the roller along horizontal axis direction 1031 and/or vertical axis direction 1029.

The depicted apparatus 1000 comprises a translator screw 1038 and a translator rod 1036. As depicted, a shaft of rocker 1026 is indirectly connected to translator screw 1038 and translator rod 1036 such that axis of rotation 1037 of the rocker shaft is held stationary and parallel relative to axis of rotation 1039 of the translator screw 1038 and a central axis 1041 along the length of translator rod 1036.

The depicted apparatus 1000 comprises a translator motor 1040 and a pump motor 1042.

The depicted translator motor 1040 is connected to translator screw 1038 in a configuration so that translator motor 1040 is operable to drive rotation of translator screw 1038. In some embodiments, driving rotation of translator screw 1038 in either direction drives the motion of carriage 1044 along an axis parallel to the axis of rotation 1039 of translator screw 1038.

The depicted pump motor 1042 is connected to crank 1028 in a configuration so that pump motor 1042 is operable to drive rotation of crank 1028.

The depicted apparatus 1000 comprises a carriage 1044. As depicted, carriage 1044 connects the shaft of rocker 1026 and the shaft of crank 1028 to translator screw 1038 and translator rod 1036. In some embodiments, carriage 1044 holds the shaft of rocker 1026 and the shaft of crank 1028 at a fixed distance from one another.

The depicted test cartridge 1100 comprises a surface layer 1106 over channels (not shown). In some embodiments, surface layer 1106 comprises an elastomer. For example, surface layer 1106 may comprise a silicone elastomer. In some embodiments, the depicted surface layer 1106 is sufficiently thin and/or flexible such that: deforming a portion of surface layer 1106, e.g. using wedged roller 1020 driven by pump motor 1042 of apparatus 1000, may result in contacting the walls and/or base of a channel associated with the portion of surface layer 1106; and rolling wedged roller 1020 to translate the deformation to a second portion of surface layer 1106 results in peristaltic pumping of a fluid in the channel, with net fluid flow in the direction of rolling of wedged roller 1020.

FIG. 7E shows a zoomed in perspective view of test cartridge 1100 comprising surface layer 1106 over channels 1102 in base layer 1104. In some embodiments, wedged roller 1020 can be used to deform a portion of surface layer 1106 over a channel 1102 during a part of a pumping process. At least some of channels 1102 may comprise a substantially triangular portion 1101 and a second portion 1103 opening into substantially triangular portion 1101 and extending below substantially triangular portion 1101 relative to surface 1105 of the channel, where the second portion 1103 has a diameter significantly smaller than an average diameter of substantially triangular portion 1101. As described above, second portion 1103 may form a "deep section" of channel 1102.

FIG. 7F shows a perspective view of a cross section of test cartridge 1100 comprising surface layer 1106 over channel 1102 (shown as a cross section of a channel), according to some embodiments. As shown in FIGS. 7D-7E, a wedged roller 1020 may engage with cartridge 1100 by contacting and deforming surface layer 1106 over channel 1102, according to certain embodiments. Referring again to FIG. 7F, channel 1102 comprises a portion along the length of channel 1102 having both substantially triangular portion 1101 and second portion 1103 (e.g., a "deep section"), as well as a portion along the length of channel 1102 having only substantially triangular portion 1101. The pump volume may be defined by an interface 1107 between portion of channel 1102 comprising only substantially triangular portion 1101 and portion of channel 1102 comprising both substantially triangular portion 1101 and second portion 1103. In some embodiments, only fluid in the portion of channel 1102 comprising only substantially triangular portion 1101 is part of the pump volume when roller 1020 engages with cartridge 1100, while fluid that is in the portion of channel 1102 comprising both substantially triangular portion 1101 and second portion 1102 is not part of the pump volume. In some embodiments, the pump volume may be the volume of channel 1102 between interface 1107 and valve 1108 of channel 1102, the entirety of which lacks a second portion 1103, in accordance with some embodiments.

Equivalents and Scope

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

All references, patents, and patent applications disclosed herein are incorporated by reference with respect to the subject matter for which each is cited, which in some cases may encompass the entirety of the document.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be appreciated that embodiments described in this document using an open-ended transitional phrase (e.g., "comprising") are also contemplated, in alternative embodiments, as "consisting of" and "consisting essentially of" the feature described by the open-ended transitional phrase. For example, if the disclosure describes "a composition comprising A and B," the disclosure also contemplates the alternative embodiments "a composition consisting of A and B" and "a composition consisting essentially of A and B."

Any terms as used herein related to shape, orientation, alignment, and/or geometric relationship of or between, for example, one or more articles, structures, forces, fields, flows, directions/trajectories, and/or subcomponents thereof and/or combinations thereof and/or any other tangible or intangible elements not listed above amenable to characterization by such terms, unless otherwise defined or indicated, shall be understood to not require absolute conformance to a mathematical definition of such term, but, rather, shall be understood to indicate conformance to the mathematical definition of such term to the extent possible for the subject matter so characterized as would be understood by one skilled in the art most closely related to such subject matter. Examples of such terms related to shape, orientation, and/or geometric relationship include, but are not limited to terms descriptive of: shape—such as, round, square, circular/circle, rectangular/rectangle, triangular/triangle, cylindrical/cylinder, elliptical/ellipse, (n)polygonal/(n)polygon, etc.; angular orientation—such as perpendicular, orthogonal, parallel, vertical, horizontal, collinear, etc.; contour and/or trajectory—such as, plane/planar, coplanar, hemispherical, semi-hemispherical, line/linear, hyperbolic, parabolic, flat, curved, straight, arcuate, sinusoidal, tangent/tangential, etc.; direction—such as, north, south, east, west, etc.; surface and/or bulk material properties and/or spatial/temporal resolution and/or distribution—such as, smooth, reflective, transparent, clear, opaque, rigid, impermeable, uniform(ly), inert, non-wettable, insoluble, steady, invariant, constant, homogeneous, etc.; as well as many others that would be apparent to those skilled in the relevant arts. As one example, a fabricated article that would described herein as being "square" would not require such article to have faces or sides that are perfectly planar or linear and that intersect at angles of exactly 90 degrees (indeed, such an article can only exist as a mathematical abstraction), but rather, the shape of such article should be interpreted as approximating a "square," as defined mathematically, to an extent typically achievable and achieved for the recited fabrication technique as would be understood by those skilled in the art or as specifically described. As another example, two or more fabricated articles that would described herein as being "aligned" would not require such articles to have faces or sides that are perfectly aligned (indeed, such an article can only exist as a mathematical abstraction), but rather, the arrangement of such articles should be interpreted as approximating "aligned," as defined mathematically, to an extent typically achievable and achieved for the recited fabrication technique as would be understood by those skilled in the art or as specifically described.

What is claimed is:

1. A peristaltic pump, comprising:

(i) a cartridge, comprising:

a base layer having a surface comprising channels, wherein at least a portion of at least some of the channels:

have a substantially triangularly-shaped cross-section having a single vertex at a base of the channel and having two other vertices at the surface of the base layer; and have a surface layer, comprising an elastomer, configured to substantially seal off a surface opening of the channel;

(ii) a roller configured to engage at least a portion of the surface layer;

(iii) a crank-and-rocker mechanism connected to the roller by a connecting arm;

(iv) a roller arm configured so as to join the roller to the connecting arm; and (v) a hinge configured so as to join the roller arm to the connecting arm, wherein the hinge comprises a spring.

2. A peristaltic pump as in claim 1, wherein at least some of the channels are microchannels.

3. A peristaltic pump as in claim 1, wherein at least one portion of at least some of the channels have walls and a base comprising a substantially rigid material compatible with biological material.

4. A peristaltic pump as in claim 1, wherein the peristaltic pump is configured to transport fluids with a fluid flow resolution of less than or equal to 1000 microliters.

5. A peristaltic pump as in claim 1, wherein the peristaltic pump is configured to transport fluids with a fluid flow resolution of less than or equal to 100 microliters.

6. A peristaltic pump as in claim 1, wherein the peristaltic pump is configured to transport fluids with a fluid flow resolution of less than or equal to 50 microliters.

7. A peristaltic pump as in claim 1, wherein the peristaltic pump is configured to be used for sample preparation.

8. A peristaltic pump as in claim 7, wherein the sample preparation comprises preparing a sample for one or more of analysis, sequencing, or identification.

9. A peristaltic pump as in claim 7, wherein the sample comprises a nucleic acid, a peptide, a protein, tissue, blood, and/or a secretion.

10. A peristaltic pump as in claim 1, wherein the roller interfaces with the cartridge at a non-wetted portion of the cartridge.

11. A peristaltic pump as in claim 1, wherein the cartridge is a first cartridge, and the first cartridge can be removed and replaced by a second cartridge.

12. A peristaltic pump as in claim 1, wherein the peristaltic pump is configured such that each pump cycle of the peristaltic pump transports greater than or equal to 1 μL of fluid.

13. A peristaltic pump as in claim 1, wherein the peristaltic pump is configured such that each pump cycle of the peristaltic pump transports less than or equal to 10 μL of fluid.

14. A peristaltic pump as in claim 1, wherein the peristaltic pump is configured to have a stroke length of greater than or equal to 10 mm.

15. A peristaltic pump as in claim 14, wherein the peristaltic pump is configured to have a stroke length of less than or equal to 20 mm.

* * * * *